US006927020B2

(12) United States Patent
Sakuragi et al.

(10) Patent No.: US 6,927,020 B2
(45) Date of Patent: Aug. 9, 2005

(54) SILVER HALIDE COLOR PHOTOGRAPHIC MATERIAL

(75) Inventors: Rie Sakuragi, Hino (JP); Satoru Ikesu, Fuchu (JP); Takatugu Suzuki, Hachioji (JP)

(73) Assignee: Konica Minolta Holdings, Inc., Tokyo (JP)

( * ) Notice: Subject to any disclaimer, the term of this patent is extended or adjusted under 35 U.S.C. 154(b) by 1 day.

(21) Appl. No.: 10/771,420

(22) Filed: Feb. 5, 2004

(65) Prior Publication Data

US 2004/0157173 A1 Aug. 12, 2004

(30) Foreign Application Priority Data

Feb. 10, 2003 (JP) ..... 2003-032244

(51) Int. Cl.[7] ..... G03C 1/08; G03C 7/26; G03C 7/32

(52) U.S. Cl. ..... 430/557; 430/556; 430/502

(58) Field of Search ..... 430/556, 557, 430/502

(56) References Cited

U.S. PATENT DOCUMENTS 4,404,274 A * 9/1983 Arai et al. ..... 430/557

* cited by examiner

*Primary Examiner*—Geraldine Letscher
(74) *Attorney, Agent, or Firm*—Finnegan, Henderson, Farabow, Garrett & Dunner, L.L.P.

(57) ABSTRACT

A silver halide color photographic material is disclosed, comprising on a support a silver halide emulsion layer comprising an yellow dye forming coupler represented by formula (I):

A—B formula (I)

wherein A is represented by formula (Ia), (Ia'), (Ia"), (Ib), (Ic), (Id), (Id'), (Ie), (Ie'), (Ie"), (If) or (If'); and B is represented by formula (II) described in the specification.

9 Claims, No Drawings

SILVER HALIDE COLOR PHOTOGRAPHIC MATERIAL

FIELD OF THE INVENTION

The present invention relates to a silver halide color photographic material containing a noble yellow dye forming coupler.

BACKGROUND OF THE INVENTION

In general, silver halide color photographic materials, after exposed, are subjected to color development to form color images upon reaction of a dye-forming coupler with an oxidized aromatic primary amine color developing agent. In this system, color reproduction by a subtractive color system is employed, in which to reproduced blue, green and red images, complementary color images, i.e., yellow, magenta and cyan images are employed.

There are broadly used acylacetoanilide type couplers to form yellow dye images. Specifically, benzoylacetoanilide type compounds which exhibit a superior color forming property are employed in color film and pivaloylacetoanilide type couplers which exhibit superior color tone are employed in color paper. Basic properties required in these couplers include not only forming a dye but also exhibiting various characteristics such as the formed dye exhibiting superior spectral absorption characteristics, the dye forming rate being relatively high, relatively high color density, and the formed dye exhibiting high fastness against light heat or moisture. Along with recent trend desiring further enhanced speed and improved image quality in photographic materials, there has been demanded development of a coupler which forms a dye exhibiting an enhanced molecular extinction coefficient, superior color density and improved light fastness.

Examples of a yellow dye forming coupler (hereinafter, also denoted simply as a yellow coupler) which achieved superior color reproducibility, enhanced dye formability and improved light fastness include a yellow coupler which contains an alkoxy group and an acylamino group at the 2-position and the 5-position of the anilide portion, respectively, as described in JP-A No. 63-123047 (hereinafter, the term JP-A refers to Publication of Japanese Patent Application). U.S. Pat. Nos. 4,149,886, 4,095,984 and 4,477,563 and British Patent No. 1,204,680 disclosed malondianilide type yellow couplers, which exhibiteded in an improved dye forming property but azomethine dyes obtained from which caused tailing in the absorption of the longer wavelength side, and an improvement in color reproduction is therefore desired. N,N-substituted malondiamide type yellow coupler described in JP-A Nos. 4-218042, 5-11416 and 2002-296738 achieved improved color reproducibility but was not at the satisfied level in dye forming property. Alkoxyacetoanilide type yellow couplers described in French Patent No. 991,453, U.S. Pat. No. 2,500,487 and JP-A No. 57-151944 achieved superior color reproducibility but was still insufficient in dye forming property.

A malonamide monoester type yellow couplers described JP-A No. 5-313323 had no problem in color reproduction and resulted in improved dye forming property but were unsatisfactory in fastness against light, heat and moisture. There were disclosed a pyrroloylacetoanilide type yellow coupler described in U.S. Pat. Nos. 5,674,667 and 6,057,087; a thenoylacetoanilide type yellow coupler described in U.S. Pat. No. 5,693,458; a benzofuranyl type yellow coupler described in JP-A No. 2000-221646; an imidazoloneacetoanilide type yellow coupler described in JP-A No. 2002-341498; yellow couplers having nitrogen-containing heterocyclic group in the acyl portion of the acylacetoanilide, as described in, for example, JP-A Nos. 2001-281781 (page 1–14), 2001-249434 (page 1–18) and 2000-2976 (page 27–38). However, these couplers, which achieved improvements in dye forming property and color reproduction, are not satisfied in dye forming property and fastness.

SUMMARY OF THE INVENTION

The present invention has come into being in light of the foregoing. Thus, it is an object of the invention to provide a silver halide color photographic material containing a noble yellow coupler forming a dye capable of giving a high color image density and a low fog density. It is another object of the invention to provide a silver halide color photographic material containing a noble yellow coupler which exhibits superior storage stability and image lasting quality.

Thus, one aspect of the invention is a silver halide color photographic material comprising on a support a silver halide emulsion layer comprising an yellow dye forming coupler represented by formula (I):

A—B formula (I)

wherein A is represented by the following formula (Ia), (Ia'), (Ia"), (Ib), (Ic), (Id), (Id'), (Ie), (Ie'), (Ie"), (If) or (If'); and B is represented by the following formula (II):

formula (Ia)

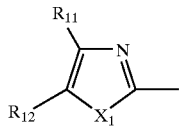

formula (Ia')

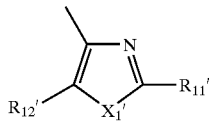

formula (Ia")

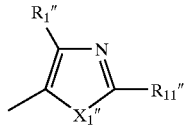

wherein $R_{11}$, $R_{12}$, $R_{12}'$ and $R_{12}''$ each represents a hydrogen atom or a substituent; $R_{11}'$ and $R_{11}''$ each represents a hydrogen atom, an alkyl group, cycloalkyl group, aryl group, heterocyclic group, alkoxy group, aryloxy group, alkoxycarbonyl group, aryloxycarboxyl group, acylamino group, sulfonamido group, carbamoyl group, sulfamoyl group, ureido group, acyl group, sulfonyl group, sulfonyloxy group, alkylamino group, arylamino group or cyano group; $X_1$, $X_1'$ and $X_1''$ each represents —N($R_{13}$)—, an oxygen atom or sulfur atom, in which $R_{13}$ represents a hydrogen atom or a substituent;

formula (Ib)

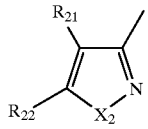

-continued formula (Ib′)

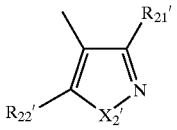

formula (Ib″)

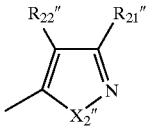

wherein $R_{21}$, $R_{22}$, $R_{21}'$, $R_{22}'$, $R_{21}''$ and $R_{22}''$ each represents a hydrogen atom or a substituent; $X_2$, $X_2'$ and $X_2''$ each represents —N($R_{23}$)—, an oxygen atom or sulfur atom, in which $R_{23}$ represents a hydrogen atom or a substituent;

formula (Ic)

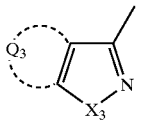

wherein $X_3$ represents an oxygen atom or sulfur atom; $Q_3$ represents a nonmetallic atom group necessary to form a carbon containing ring;

formula (Id)

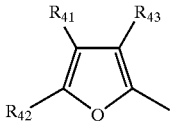

formula (Id′)

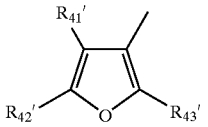

wherein $R_{41}$, $R_{42}$, $R_{43}$, $R_{41}'$, $R_{42}'$ and $R_{43}'$ each represents a hydrogen atom or a substituent, provided that $R_{41}$ and $R_{42}$, and $R_{41}'$ and $R_{42}'$ do not form a ring;

formula (Ie)

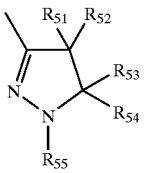

formula (Ie′)

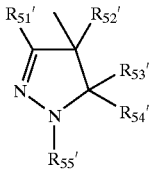

-continued formula (Ie″)

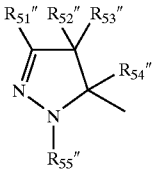

wherein $R_{51}$, $R_{52}$, $R_{53}$, $R_{54}$, $R_{55}$, $R_{51}'$, $R_{52}'$, $R_{53}'$, $R_{54}'$, $R_{55}'$, $R_{51}''$, $R_{52}''$, $R_{53}''$, $R_{54}''$ and $R_{55}''$ each represents a hydrogen atom or a substituent, provided that two selected from $R_{51}$ to $R_{55}$, two selected from $R_{51}'$ to $R_{55}'$, or two selected from $R_{51}''$ to $R_{55}''$ may combine with each other to form a ring;

formula (If)

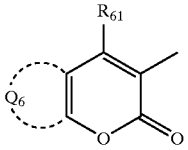

formula (If′)

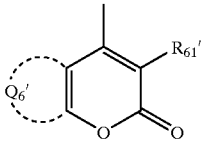

wherein $R_{61}$ and $R_{61}'$ each represents a hydrogen atom or a substituent; $Q_6$ and $Q_6'$ represents a nonmetallic atom group necessary to form a carbon containing ring;

formula (II)

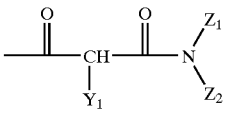

wherein $Y_1$ represents a hydrogen or a group capable of being released upon reaction with an oxidation product of a color developing agent; $Z_1$ and $Z_2$ each represents a hydrogen atom or a substituent.

DETAILED DESCRIPTION OF THE INVENTION

In the foregoing formulas (Ia), (Ia′), (Ia″), (Ib), (Ib′), (Ib″), (Ic), (Id), (Id′), (Ie), (Ie′), (Ie″), (If) and (If′), $R_{11}$, $R_{12}$, $R_{12}'$, $R_{12}''$, $R_{21}$, $R_{22}$, $R_{21}'$, $R_{22}'$, $R_{21}''$, $R_{22}''$, $R_{41}$, $R_{42}$, $R_{43}$, $R_{41}'$, $R_{42}'$, $R_{43}'$, $R_{51}$, $R_{52}$, $R_{53}$, $R_{54}$, $R_{55}$, $R_{51}'$, $R_{52}'$, $R_{53}'$, $R_{54}'$, $R_{55}'$, $R_{51}''$, $R_{52}''$, $R_{53}''$, $R_{54}''$, $R_{55}''$, $R_{61}$ and $R_{61}'$ each represents a hydrogen atom or a substituent. Examples of the substituent represented by the foregoing $R_{11}$, $R_{12}$, $R_{12}'$, $R_{12}''$, $R_{21}$, $R_{22}$, $R_{21}'$, $R_{22}'$, $R_{21}''$, $R_{22}''$, $R_{41}$, $R_{42}$, $R_{43}$, $R_{41}'$, $R_{42}'$, $R_{43}'$, $R_{51}$, $R_{52}$, $R_{53}$, $R_{54}$, $R_{55}$, $R_{51}'$, $R_{52}'$, $R_{53}'$, $R_{54}'$, $R_{55}'$, $R_{51}''$, $R_{52}''$, $R_{53}''$, $R_{54}''$, $R_{55}''$, $R_{61}$ and $R_{61}'$ include an alkyl group, a cycloalkyl group, an alkenyl group, an alkynyl group, an aryl group, a heterocyclic group, a halogen atom, an alkoxy group, aryloxy group, alkoxycarbonyl group, aryloxycarbonyl group, acylamino group, sulfonamido group, carbamoyl group, sulfamoyl group, ureido group, acyl group, sulfonyl group, sulfonyloxy group, sulfinyl group, phosphonyl group, amino group, alkylamino group, arylamino group, imino group, alkylthio group, arylthio group, acyloxy group, cyano group, nitro group, sulfo group, carboxyl group, hydroxy group, a heterocyclic group, heterocyclic-oxy group and heterocyclic-thio group, each of which is a 3- to 7-membered heterocyclic group containing at least one heteroatom selected from oxygen, nitrogen and sulfur and which may be substituted, a quaternary ammonium group and silyloxy group. These substituents may further be substituted by the above-described substituents. In the foregoing, $R_{41}$ and $R_{42}$, and $R_{41}'$ and $R_{42}'$ do not combine with each other to form a ring.

Of the foregoing substituents represented by $R_{11}$, $R_{12}$, $R_{12}'$, $R_{12}''$, $R_{21}$, $R_{22}$, $R_{21}'$, $R_{22}'$, $R_{21}''$, $R_{22}''$, $R_{41}$, $R_{42}$, $R_{43}$, $R_{41}'$, $R_{42}'$, $R_{43}'$, $R_{51}$, $R_{52}$, $R_{53}$, $R_{54}$, $R_{55}$, $R_{51}'$, $R_{52}'$, $R_{53}'$, $R_{54}'$, $R_{55}'$, $R_{51}''$, $R_{52}''$, $R_{53}''$, $R_{54}''$, $R_{55}''$, $R_{61}$ and $R_{61}$, specific preferred examples include an alkyl group [e.g., methyl, ethyl, trifluoromethyl, t-butyl, 3-(2,4-di-t-amylphenoxy) propyl, octyl, dodecyl, tetradecyl], a cycloalkyl group (e.g., cyclopropyl, cyclohexyl), an aryl group (e.g., phenyl, 4-t-butylphenyl, 2,4,6-trimethylphenyl, naphthyl), a heterocyclic group (e.g., pyrrolyl, thiazolyl, pyridyl), a halogen atom (e.g., fluorine, chlorine, bromine atoms), an alkoxy group [e.g., methoxy, ethoxy, propoxy, 2-methoxyethoxy, n-butoxy, s-butoxy, t-butoxy, hexyloxy, 2-ethylhexyloxy, tetradecyloxy, 2-(2,4-di-t-pentylphenoxy)ethoxy, dodecyloxy, hexadecyloxy, 2-dodecyloxyethyoxy], aryloxy group (e.g., phenoxy, 2-methylphenoxy, α- or β-naphthyloxy, 4-tolyloxy), alkoxycarbonyl group (e.g., methoxycarbonyl, ethoxycarbonyl), aryloxycarbonyl group (e.g., phenoxycarbonyl), acylamino group (e.g., acetoamide, butylylamino, stearoylamino), carbonamido group [e.g., acetoamide, benzamido, butylamido, tetradecaneamido, α-(2,4-di-t-pentylphenoxy)acetoamide, α-(2,4-di-t-pentylphenoxy)butylamido, α-(3-pentadecylphenoxy) hexaneamido, -(4-hydroxy-3-t-butylphenoxy) tetradecaneamido, 2-oxo-pyrrolidine-1-yl, 2-oxo-5-tetradecylpyrroline-1-yl, N-methyltetradecaneamido, N-succineimido, N-phthalimido, 2,5-dioxo-1-oxazolidinyl, 3-dodecyl-2,5-dioxo-1-imidazolyl, N-acetyl,-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl)carbonylamino, p-dodecylphenylcarbonylamino, p-tolylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-tolylureido, N-(m-hexadecylphenyl)ureido, N,N-(2,5-di-t-pentylphenyl)-N'-ethylureido, t-butylcarbonamido] sulfonamido group (e.g., methanesulfoneamido, phenylsulfoneamido, methylsulfoneamido, p-tolylsulfoneamido, p-dodecylbenzenesulfoneamido, N-methyltetradecylsulfoneamido, N,N-dipropylsulfamoylamino, hexadecylsulfoneamido), carbamoyl group [e.g., N-methylcarbamoyl, N,N-dibutylcarbamoyl, N-octylcarbamoyl, N-octadecylcarbamoyl, N-[4-(2,4-di-t-pentylphenoxy)butyl]carbamoyl, N-methyl-N-tetradecycarbamoyl, N,N-diocylcarbamoyl], sulfamoyl group [e.g., N-methylsulfamoyl, N-ethylsulfamoyl, N,N-dipropylsulfamoyl, N-hexadecylsulfamoyl, N,N-dimethylsulfamoyl, N-[3-(dodecyloxy)propyl]sulfamoyl, N-[4-(2,4-di-t-pentylphenoxy)butyl]sulfamoyl, N-methyl-N-tetradecylsulfamoyl, N-phenylsulfamoyl, N-dodecylsulfamoyl], acyl group [e.g., acetyl, propionyl, (2,4-di-t-amylphenoxy)acetyl, phenoxycarbonyl, p-dodecyloxyphenoxycarbonyl, methoxycarbonyl, butoxycarbonyl, tetradecyloxycarbonyl, ethoxycarbonyl, benzyloxycarbonyl, 3-pentadecyloxycarbonyl, dodecyoxycarbonyl], sulfonyl group (e.g., methoxysulfonyl, octyloxysulfonyl, tetradecyloxysulfonyl, 2-ethylhexyloxysulfonyl, phenoxysulfonyl, methylsulfonyl, 2,4-di-t-pentylphenoxysulfonyl, octylsulfonyl, 2-ethylhexylsulfonyl, dodecylsulfonyl, hexadecylsulfonyl, phenylsulfonyl, 4-noylphenylsulfonyl, p-tolylsulfonyl), sulfonyloxy group (e.g., dodecylsulfonyloxy, hexadecylsulfonyloxy), sulfinyl group (e.g., methylsulfinyl, octylsulfinyl, 2-ethylhexylsulfinyl, dodecylsulfinyl, hexadecylsulfinyl, phenylsulfinyl, 4-nonylphenylsulfinyl, p-tolylsulfinyl), alkylamino group and arylamino group (e.g., phenylanilino, 2-chloroanilino, diethylamino, dodecylamino), imino group [e.g., 1-(N-phenylimido)ethyl, N-succineimido, 3-benzylhydantoin], alkylthio group and arylthio group [e.g., ethylthio, ocylthio, benzylthio, tetradecylthio, 2-(2,4-di-t-pentylphenoxy)ethylthio, phenylthio, 2-butoxy-5-t-octylphenylthio, p-tolylthio], and acyloxy group (e.g., acetyloxy, benzoyloxy, octadecanoyloxy, p-dodecylamidobenzoyloxy, N-phenylcarbamoyloxy, N-ethylcarbamoyloxy, cyclohexylcarbonyloxy).

In the formulas (Ia') and (Ia''), $R_{11}'$ and $R_{11}''$ each represents a hydrogen atom, an alkyl group, cycloalkyl group, aryl group, heterocyclic group, alkoxy group, aryloxy group, alkoxycarbonyl group, aryloxycarbonyl group, acylamino group, sulfonamido group, carbamoyl group, sulfamoyl group, ureido group, acyl group, sulfonyl group, sulfonyloxy group, alkylamino group, arylamino group or cyano group.

In the formulas (Ie), (Ie'), and (Ie''), $R_{55}$, $R_{55}'$ and $R_{55}''$ each represents a hydrogen atom or a substituent. Examples of the substituent represented by $R_{55}$, $R_{55}'$ and $R_{55}''$ include an alkyl group, a cycloalkyl group, an alkenyl group, an alkynyl group, an aryl group, a heterocyclic group, a halogen atom, an alkoxy group, aryloxy group, alkoxycarbonyl group, aryloxycarbonyl group, acylamino group, sulfonamido group, carbamoyl group, sulfamoyl group, ureido group, acyl group, sulfonyl group, sulfinyl group, phosphonyl group, amino group, alkylamino group, arylamino group, alkylthio group, arylthio group, acyloxy group, cyano group, nitro group, sulfo group, carboxyl group, and hydroxy group. Of these substituents, an alkyl group, aryl group or heterocyclic group is preferred. Specific examples thereof include methyl, ethyl, n-butyl, benzyl, phenyl, dodecyl, tetradecyl, hexadecyl, phenylethyl and pyridyl.

In the formulas (Ia), (Ia') and (Ia''), $X_1$, $X_1'$ and $X_1''$ each represents —N($R_{23}$)—, an oxygen atom (or —O—) or sulfur atom (or —S—), in which $R_{13}$ represents a hydrogen atom or a substituent. Examples of the substituent include an alkyl group, a cycloalkyl group, an alkenyl group, an alkynyl group, an aryl group, a heterocyclic group, a halogen atom, an alkoxy group, aryloxy group, alkoxycarbonyl group, aryloxycarbonyl group, acylamino group, sulfonamido group, carbamoyl group, sulfamoyl group, ureido group, acyl group, sulfonyl group, group, sulfinyl group, phosphonyl group, amino group, alkylamino group, arylamino group, alkylthio group, arylthio group, acyloxy group, cyano group, nitro group, sulfo group, carboxyl group and hydroxy group. Of these, an alkyl group, aryl group and heterocyclic group are preferred, such as methyl, ethyl, n-butyl, benzyl, phenyl, dodecyl and tetradecyl; and methyl, benzyl and phenyl are more preferred. $X_1$, $X_1'$ and $X_1''$ are preferably —N($R_{23}$)—.

In the formulas (Ib), (Ib') and (Ib''), $X_2$, $X_2'$ and $X_2''$ each represents —N($R_{23}$)—, an oxygen atom (or —O—) or sulfur atom (or —S—), in which $R_{13}$ represents a hydrogen atom or a substituent. Examples of the substituent include an alkyl group, a cycloalkyl group, an alkenyl group, an alkynyl group, an aryl group, a heterocyclic group, a halogen atom, an alkoxy group, aryloxy group, alkoxycarbonyl group, aryloxycarbonyl group, acylamino group, sulfonamido group, carbamoyl group, sulfamoyl group, ureido group, acyl group, sulfonyl group, group, sulfinyl group, phosphonyl group, amino group, alkylamino group, arylamino group, alkylthio group, arylthio group, acyloxy group, cyano group, nitro group, sulfo group, carboxyl group and hydroxy group. Of these, an alkyl group, aryl group and heterocyclic group are preferred, and specific examples thereof include methyl, ethyl, n-butyl, benzyl, phenyl, dodecyl, tetradecyl, hexadecyl, phenylethyl and pyridyl; and methyl, benzyl and phenyl are more preferred. $X_2$, $X_2'$ and $X_2''$ are preferably —N($R_{23}$)—.

In the formula (Ic), $X_3$ represents an oxygen atom (or —O—) or sulfur atom (or —S—). $Q_3$ represents a nonmetallic atom group necessary to form a carbon-containing ring. The carbon-containing ring may be a saturated or unsaturated, carbon ring or heterocyclic ring, and substituted or unsubstituted ring, which may further be condensed with a saturated or unsaturated, carbon or heterocyclic ring. Specific examples of such a ring include benzene ring, naphthalene ring, cyclohexane ring, pyridine ring, furan ring, thiophene ring, pyrrole ring, benzofuran ring, benzothiophene ring, imidazole ring, pyrazole ring, triazole ring, pyrimidine ring, benzimidazole ring, benzoxazole ring and benzothiazole ring. Of these, a benzene ring, cyclohexane ring and cyclopentane ring are preferred, and a benzene ring is more preferred.

In the formulas (Ie), (Ie') and (Ie"), any two selected from $R_{51}$ to $R_{55}$, any two selected from $R_{51}'$ to $R_{55}'$, and any two selected from $R_{51}''$ to $R_{55}''$ may combine with each other to form a ring.

In the formulas (If) and (If'), $Q_6$ and $Q_6'$ each represents a nonmetallic atom group necessary to form a carbon-containing ring. The carbon-containing ring may be a saturated or unsaturated, carbon ring or heterocyclic ring, and substituted or unsubstituted ring, which may further be condensed with a saturated or unsaturated, carbon or heterocyclic ring. Specific examples of such a ring include benzene ring, naphthalene ring, cyclohexane ring, pyridine ring, furan ring, thiophene ring, pyrrole ring, benzofuran ring, benzothiophene, imidazole ring, pyrazole ring, triazole ring, pyrimidine ring, benzimidazole, benzoxazole ring and benzothiazole ring. Of these, a benzene ring and pyridine ring are preferred, and a benzene ring is more preferred.

In the formula (II), $Y_1$ represents a group capable of being released upon reaction with an oxidation product of a color developing agent. Examples of the group capable of being released include an aryloxy group (e.g., phenoxy, naphthoxy), heterodoxy group, arylthio group, heterocyclic-thio group, imino group in which the nitrogen atom binds to the coupling position (e.g., 2,4-dioxo-1,3-imidazolidine-3-yl, 2,4-dioxo-1,3-oxazolidine-3-yl, 3,5-dioxo-1,2,4-triazolidine-4-yl, succineamido, phthalimido, 2,4-dioxol, 3-imidazolidine-1-yl) and an unsaturated nitrogen-containing heterocyclic group in which the nitrogen atom binds to the coupling position (e.g., 1-imidazolyl, 1-pyrazolyl, 1,2,4-triazole-1 (or 4)-yl, 1,2,3-triazole-1-yl, benzotriazole-1-yl, 3-pyrazoline-5-one-1-yl). Of these, aryoxy or imido group is preferred.

The group capable of being released may be any one of a non-photographic useful group, photographic useful group and their precursors (e.g., development inhibitor, development accelerator, bleach accelerator, fogging agent, dye, hardening agent, coupler, scavenger of an oxidized developing agent, fluorescent dye, developing agent electron transfer agent). Specific examples of the photographic useful group, represented by $Y_1$ include those commonly known in the art, as described in U.S. Pat. Nos. 4,248,962, 4,409,323, 4,438,193, 4,421,845, 4,618,5714,652,516, 4,861,701, 4,782,012, 4,857,440, 4,847,185, 4,477,563, 4,628,024, 4,741,994; Publication of European Patent Application Nos. 193,389A, 348,139A and 272,573A. Of the foregoing photographic useful groups, a development inhibitor is preferred.

In the formula (II), $Z_1$ and $Z_2$ represent a hydrogen atom or a substituent. The substituent is preferably an alkyl group, aryl group or heterocyclic group. Specific examples thereof include methyl, ethyl, phenyl, cyclohexyl and naphthyl. It is preferred that $Z_1$ is a phenyl group and $Z_2$ is a hydrogen atom. When $Z_1$ is a phenyl group, $Z_1$ is preferably represented by the following formula (i):

formula (i)

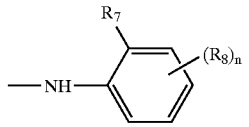

In the formula (i), $R_7$ represents a hydrogen atom or a substituent, such as a halogen atom, an alkoxy group, acyl group or amido group. Preferred examples include an alkoxy group such as methoxy, ethoxy, propoxy or isopropoxy, and halogen atom such as bromine or chlorine. $R_8$ represents a substituent, for example, —$SO_2R_9$, —$SO_2NHR_9$, —$CO_2R_9$, —$CONR_9$, —$COR_9$, —$NR_9COR_9$, or —$NR_9SO_2R_9$, in which the respective $R_9$s are each a hydrogen atom or a substituent. $R_9$ may be intervened by one or more heteroatoms or groups. $R_8$ is preferably —$SO_2R_9$, —$SO_2NHR_9$, —$CO_2R_9$ or —$NR_9COR_9$. $R_9$ is a hydrogen atom or any substituent, such as an alkyl group or aryl group, specifically an alkyl group having 4 to 20 carbon atoms. The designation "n" is an integer of 0 to 4, preferably 0 to 3, and more preferably 0 to 2. The foregoing phenyl ring may contain a ballast group, as described later. The group represented by the foregoing formula (i) is preferably represented by the following formula (ii) or (iii):

formula (ii)

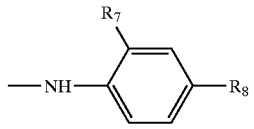

formula (iii)

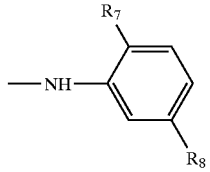

wherein $R_7$ represents a chlorine atom or an alkoxy group; and $R_8$ represents a substituent, which is the same as $R_8$ defined in the foregoing formula (i). Representative ballast groups include substituted or unsubstituted alkyl or aryl group having 8 to 48 carbon atoms. Representative substituents include an alkyl group, aryl group, alkoxy group, aryloxy group, alkylthio group, hydroxy group, halogen atom, alkoxycarbonyl group, aryloxycarbonyl group, carboxyl group, acyl group, acyloxy group, amino group, anilino group, carbonamido group, carbamoyl group, alkylsulfonyl group, arylsulfonyl group, sulfonamido group, and sulfamoyl group, and these substituents generally contain 1 to 42 carbon atoms. Such substituents may further be substituted.

Specific examples of yellow couplers, characterized in that in the foregoing formula (I), A is represented by the foregoing formula (Ia), (Ia'), (Ia"), (Ib), (Ib'), (Ib"), (Ic), (Id), (Id'), (Ie), (Ie'), (Ie"), (If), or (If'); and B is represented by the foregoing formula (II) are shown below but the present invention is by no means limited to these examples.

YA-1

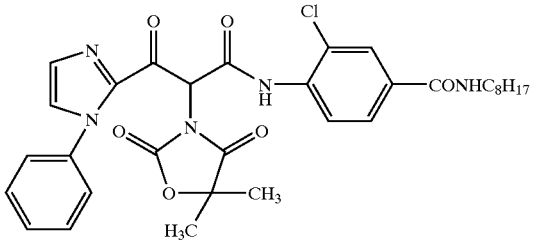

YA-2

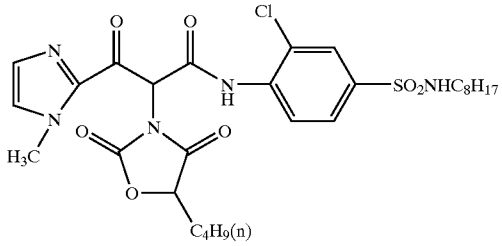

YA-3

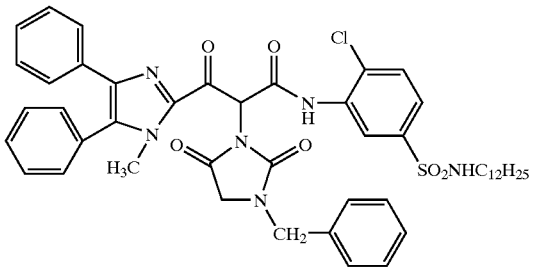

YA-4

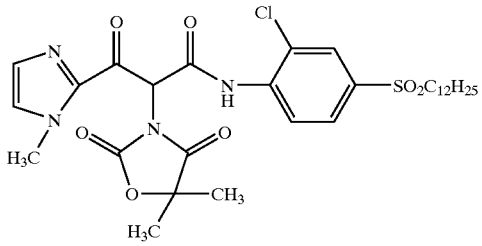

YA-5

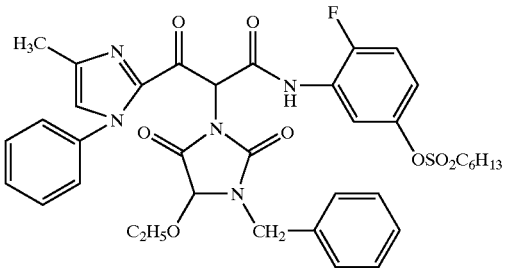

YA-6

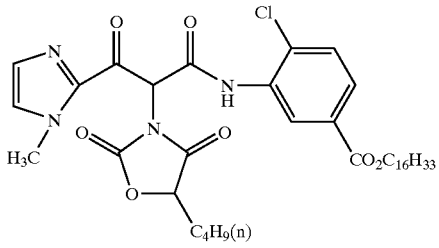

YA-7

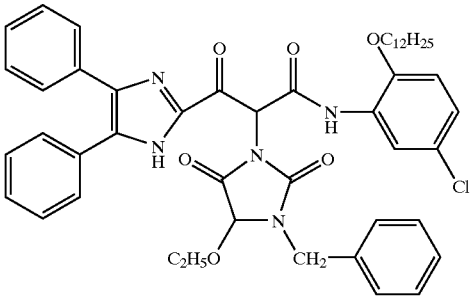

YA-8

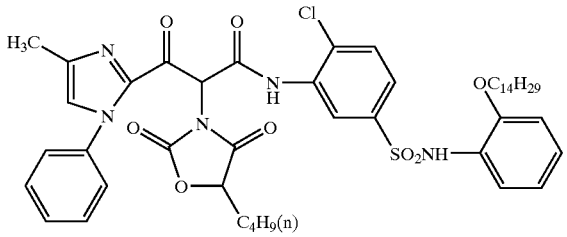

-continued
YA-9
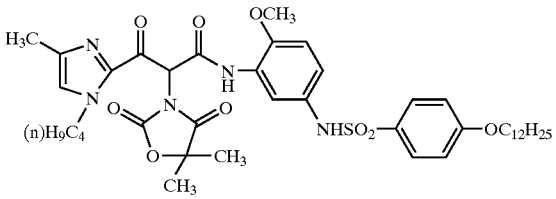
YA-10
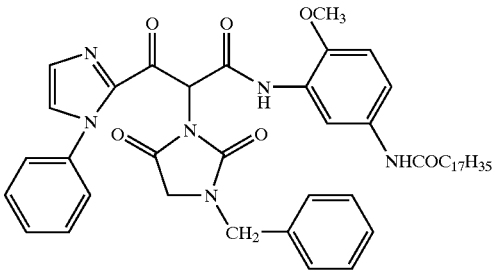
YA-11
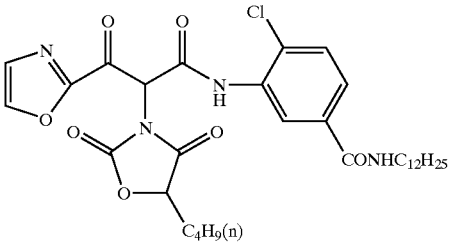
YA-12
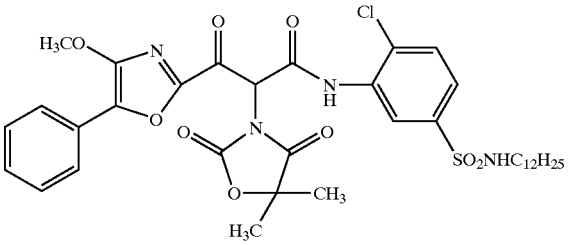
YA-13
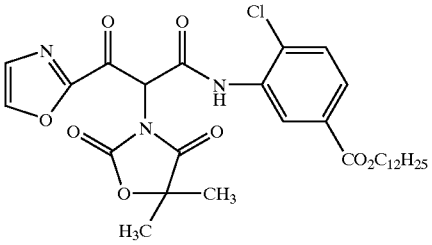
YA-14
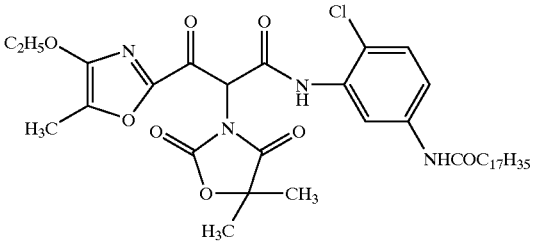
YA-15
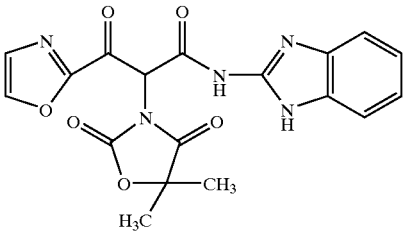
YA-16
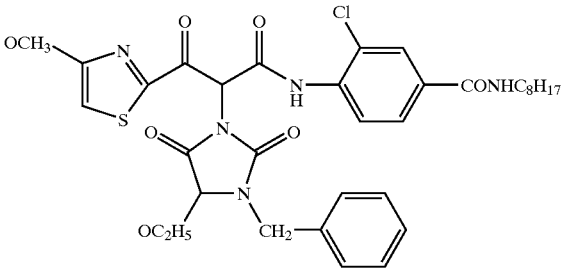
YA-17
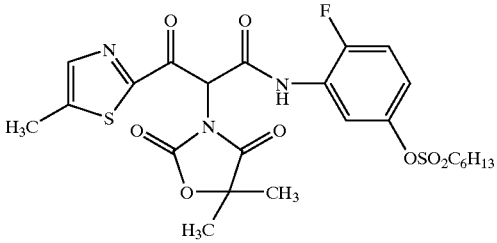
YA-18
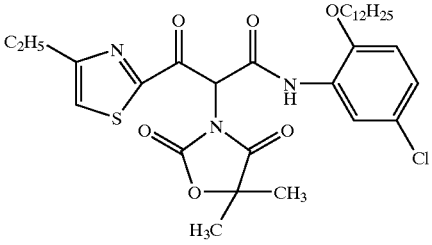

-continued
YA-19
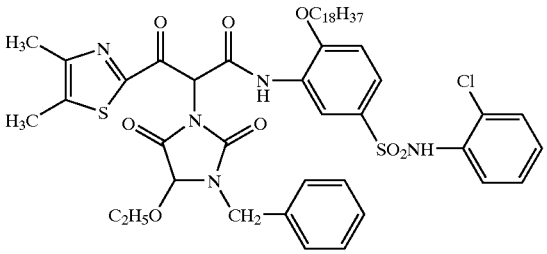
YA-20
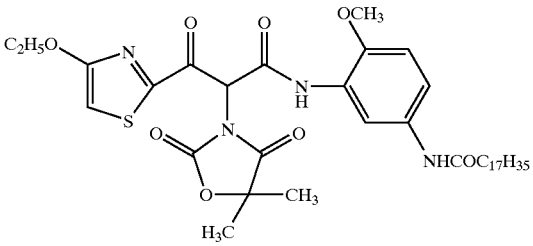
YA-21
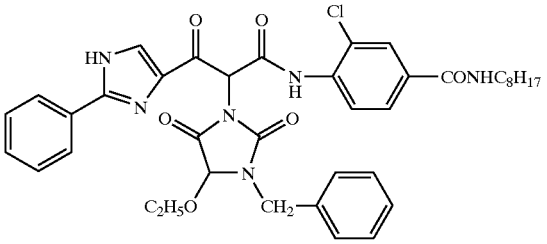
YA-22
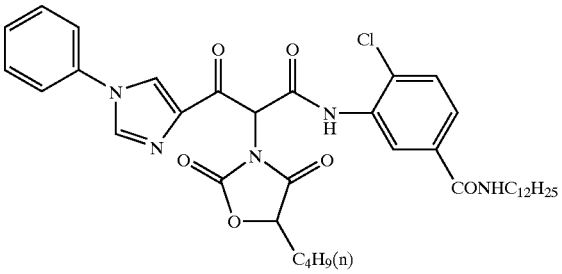
YA-23
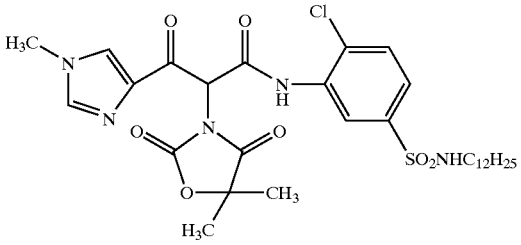
YA-24
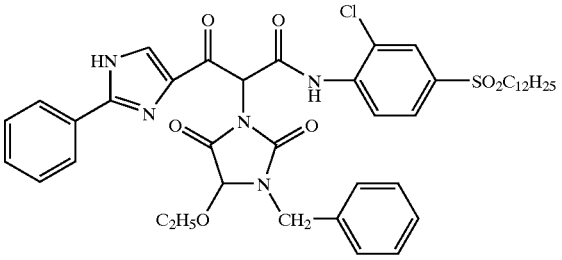
YA-25
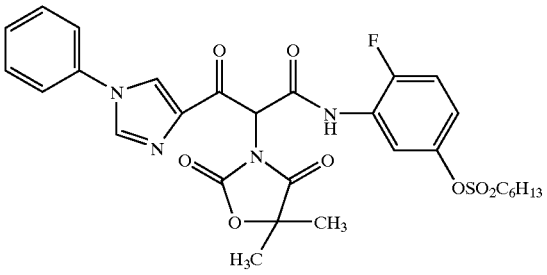
YA-26
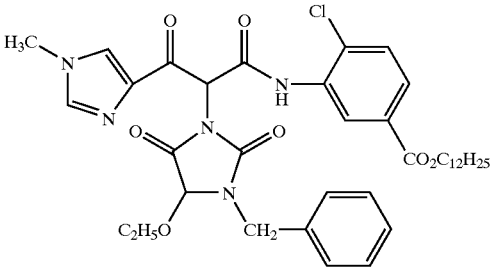
YA-27
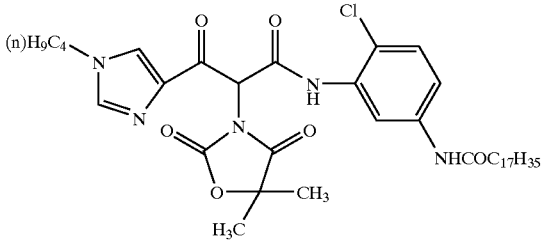
YA-28
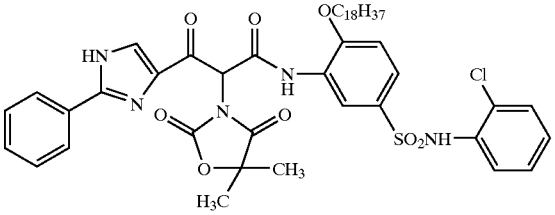

-continued
YA-29
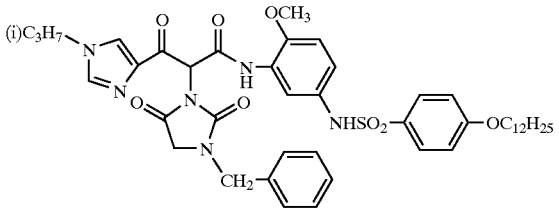
YA-30
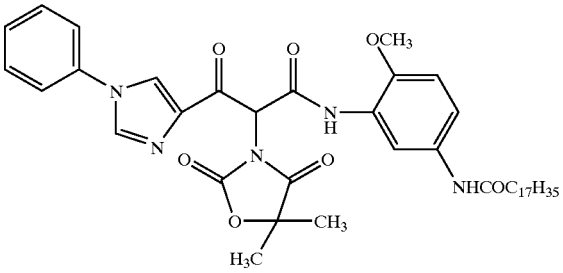
YA-31
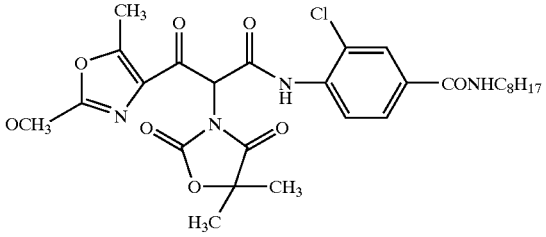
YA-32
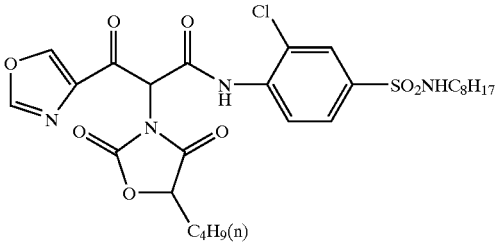
YA-33
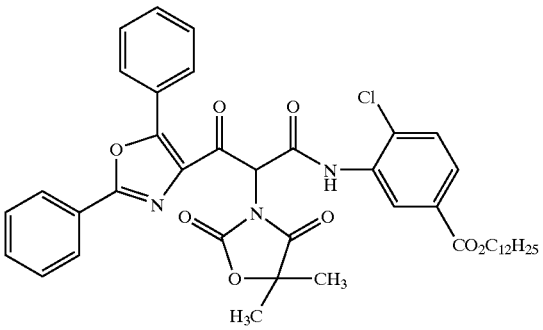
YA-34
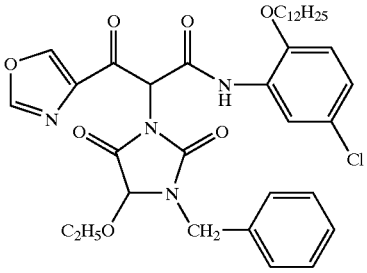
YA-35
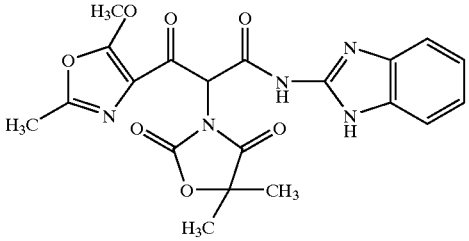
YA-36
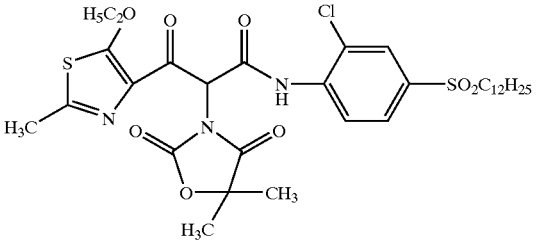
YA-37
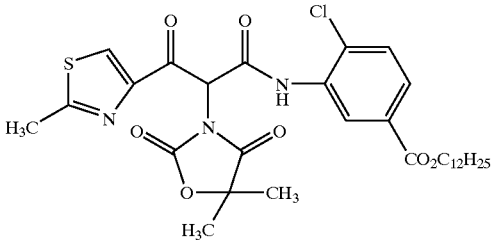
YA-38
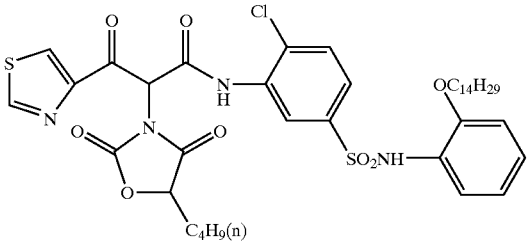

-continued
YA-39
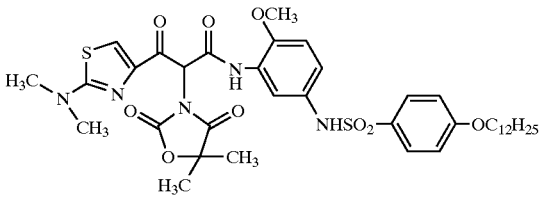
YA-40
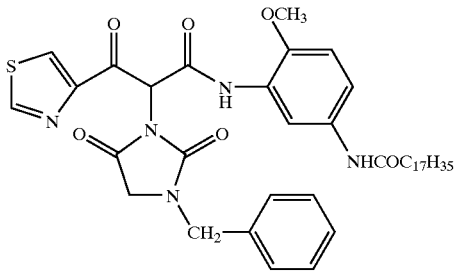
YA-41
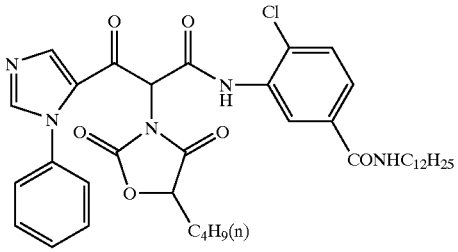
YA-42
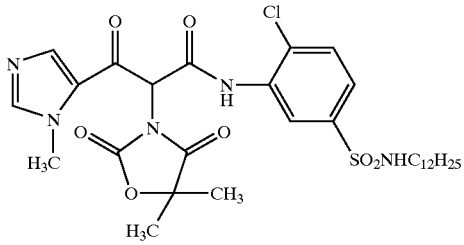
YA-43
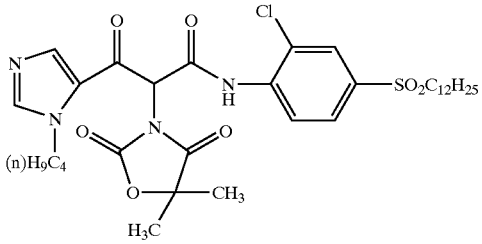
YA-44
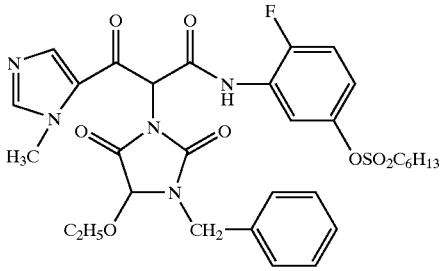
YA-45
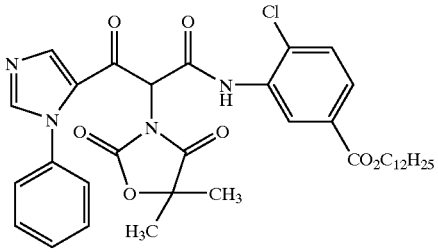
YA-46
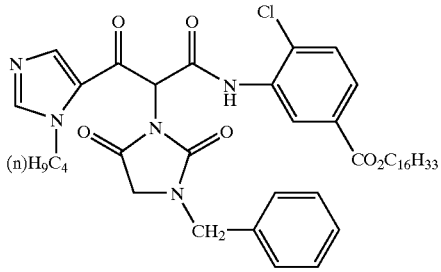
YA-47
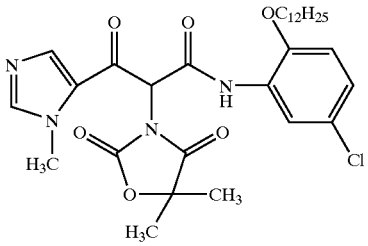
YA-48
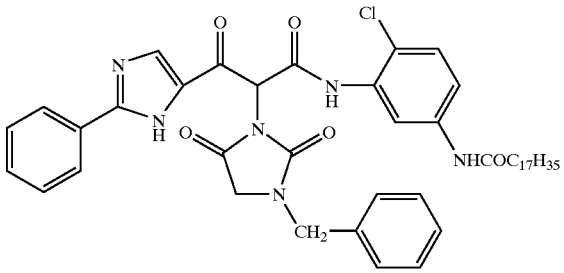

-continued
YA-49
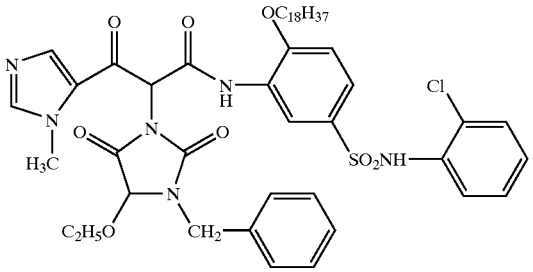
YA-50
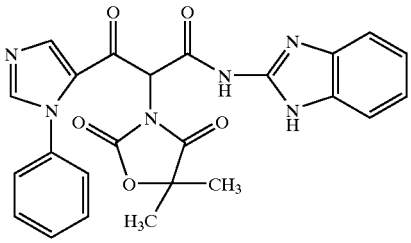
YA-51
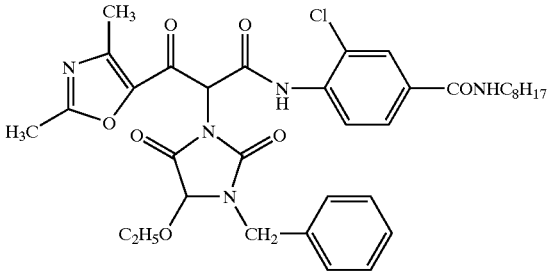
YA-52
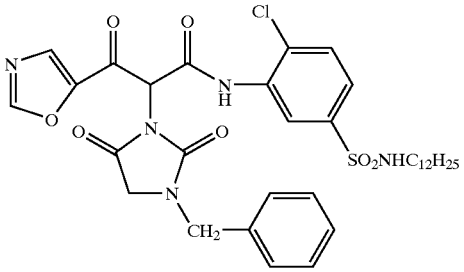
YA-53
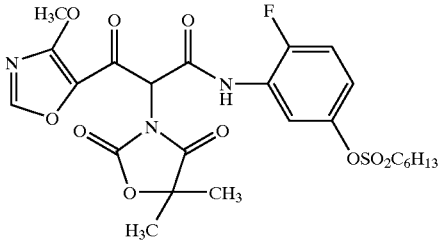
YA-54
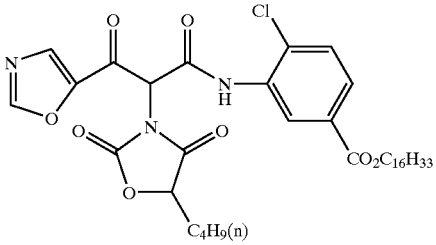
YA-55
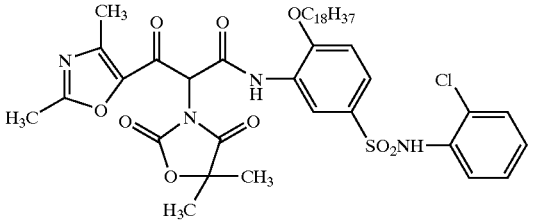
YA-56
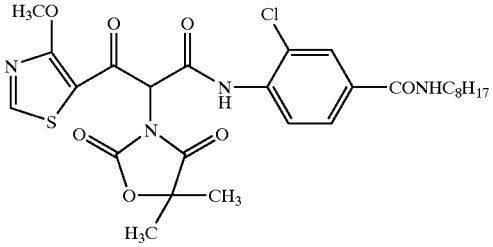
YA-57
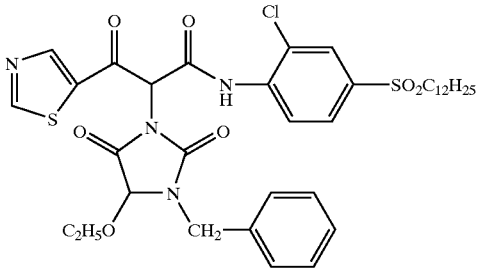
YA-58
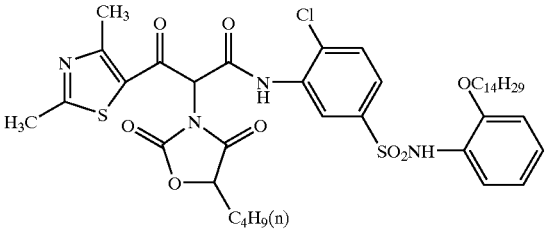

-continued
YA-59
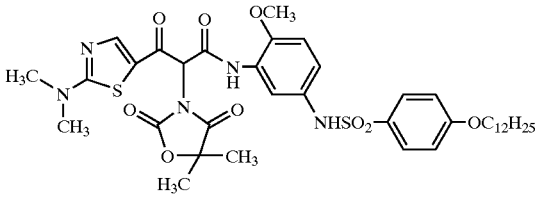
YA-60
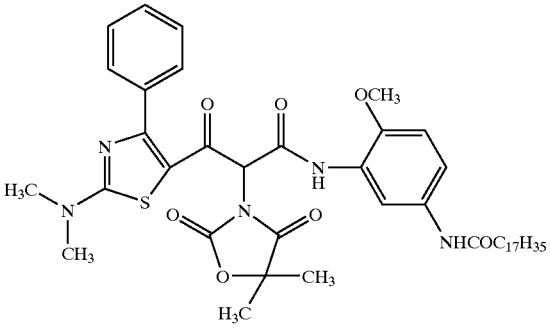
YA-61
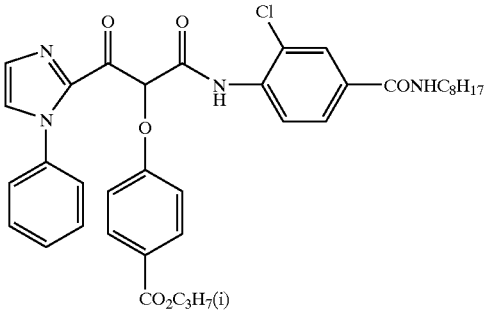
YA-62
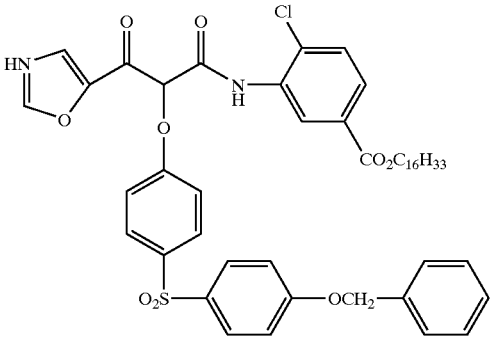
YA-63
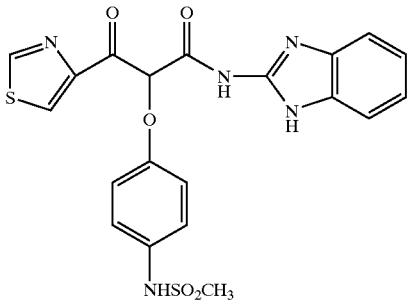
YB-1
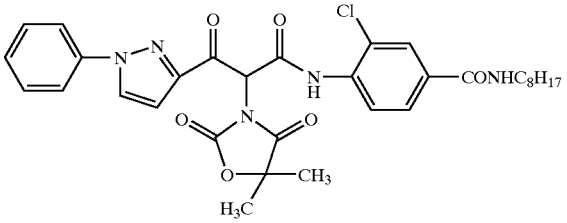
YB-3
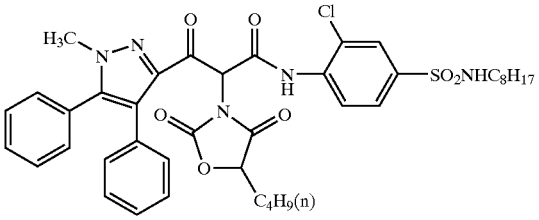
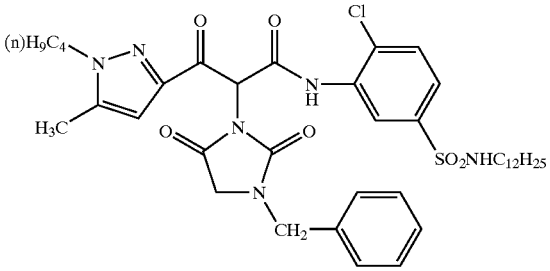
YB-4
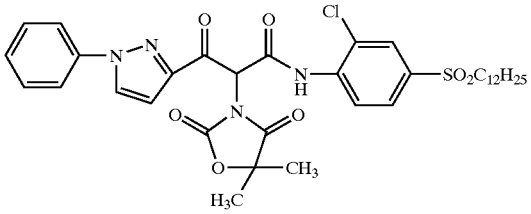
YB-5
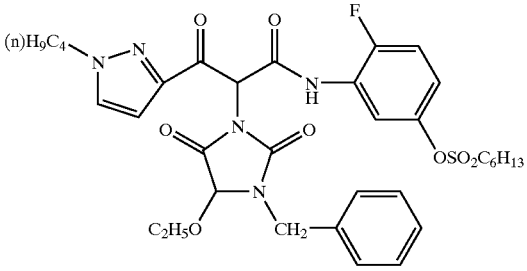

-continued
YB-6
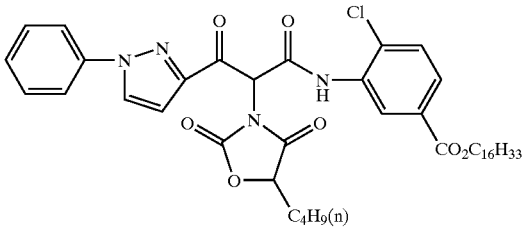
YB-7
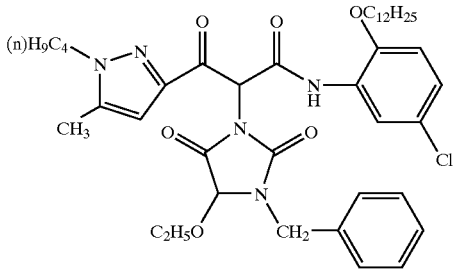
YB-8
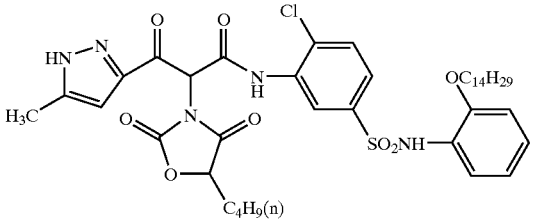
YB-9
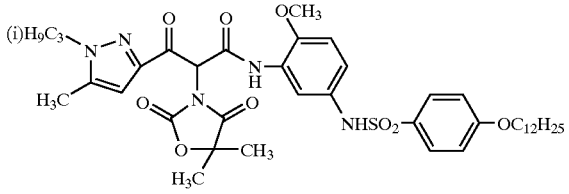
YB-10
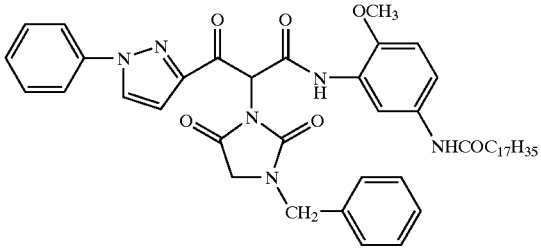
YB-11
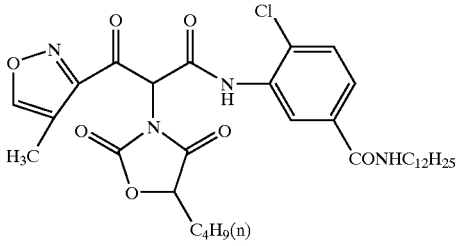
YB-12
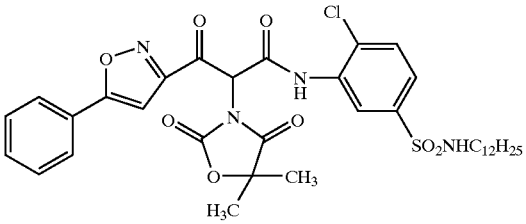
YB-13
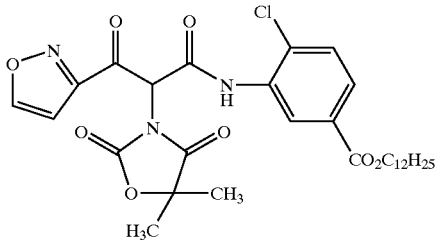
YB-14
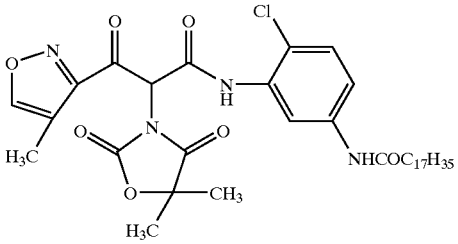
YB-15
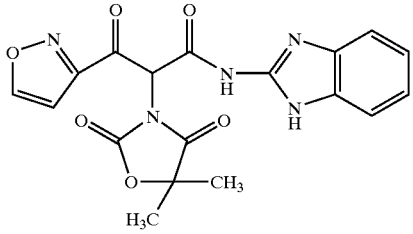
YB-18
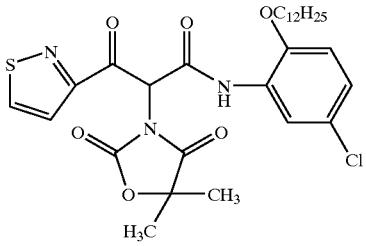
YB-19
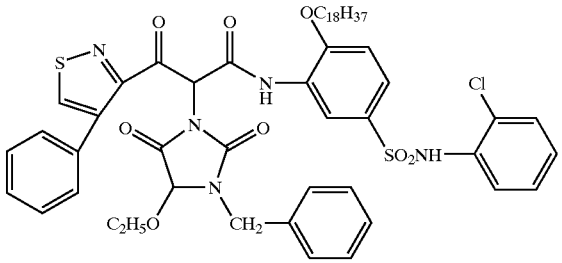

-continued
YB-20
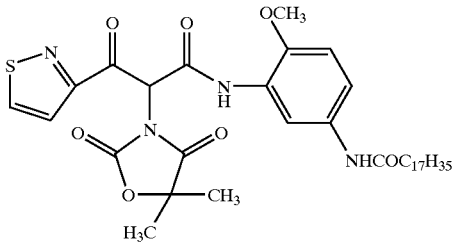
YB-21
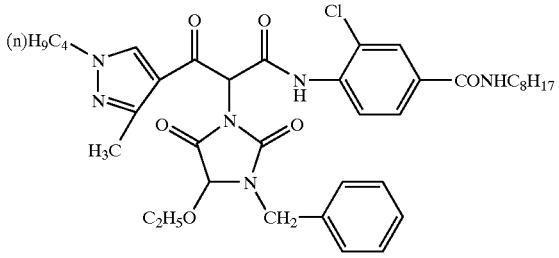
YB-22
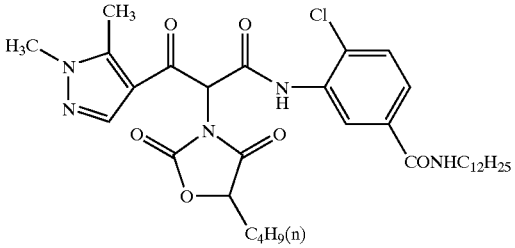
YB-23
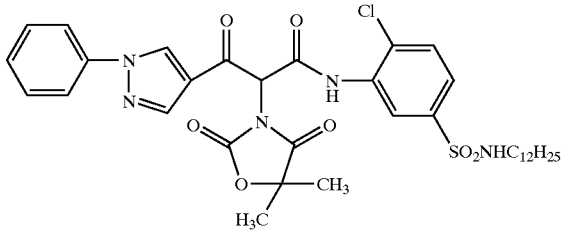
YB-24
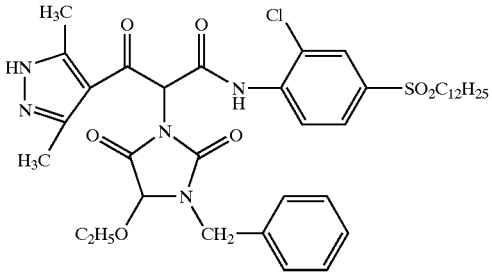
YB-25
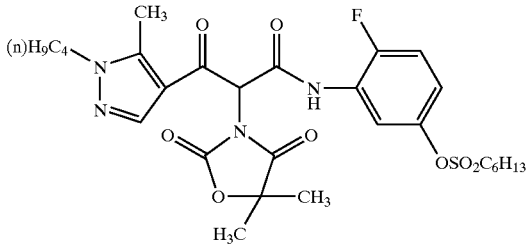
YB-26
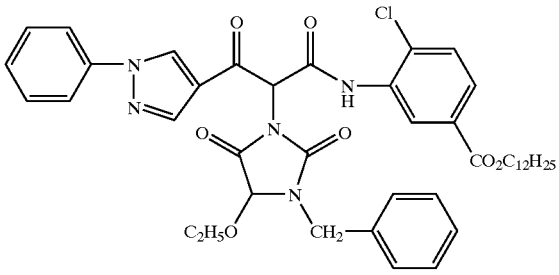
YB-27
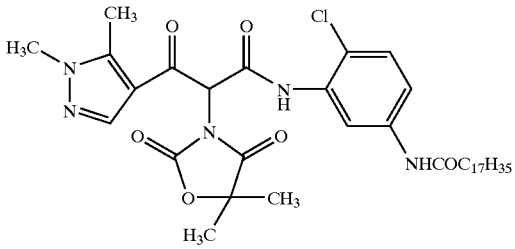
YB-28
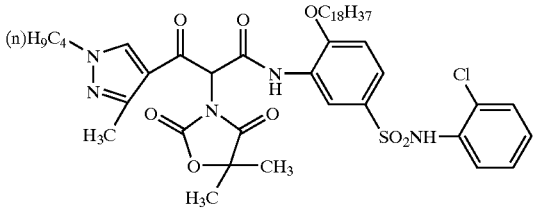
YB-29
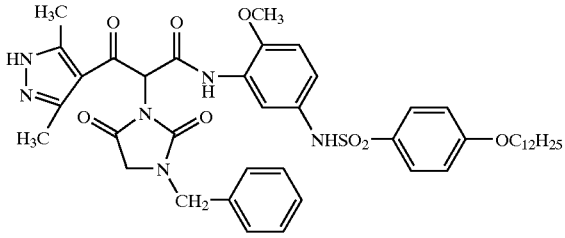

-continued
YB-30
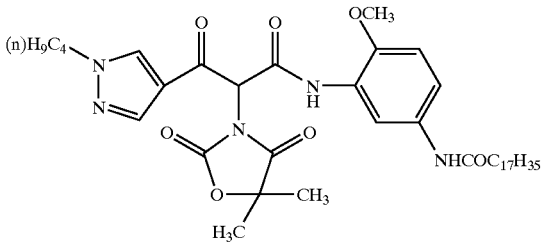
YB-31
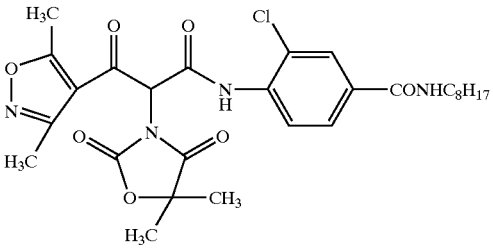
YB-32
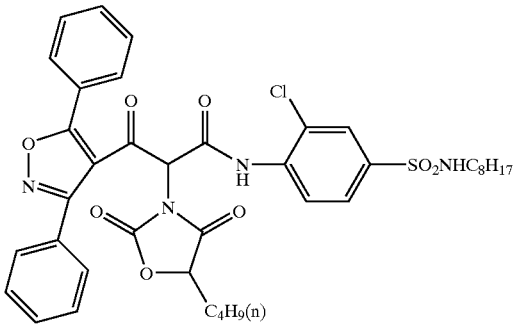
YB-33
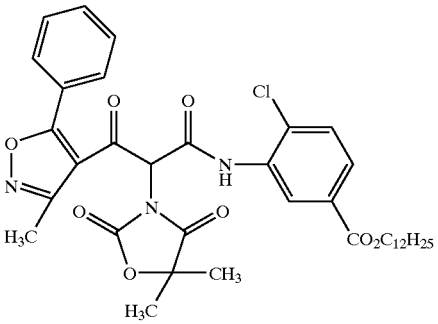
YB-34
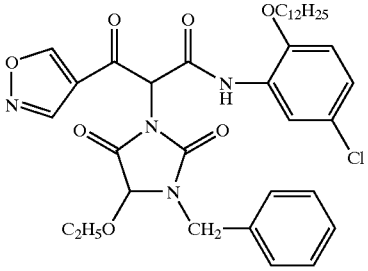
YB-35
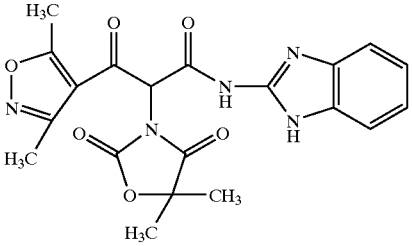
YB-36
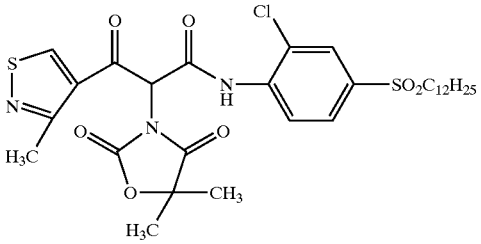
YB-37
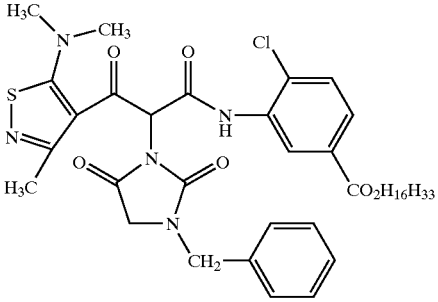
YB-38
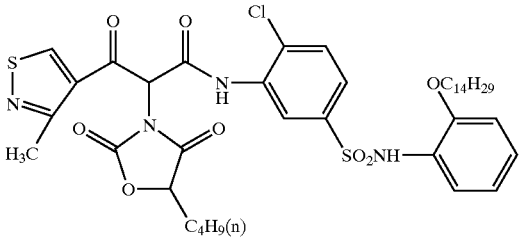
YB-39
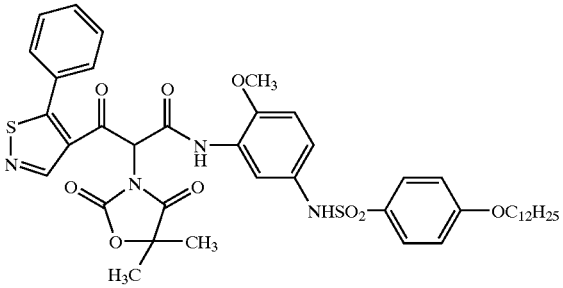

-continued
YB-40
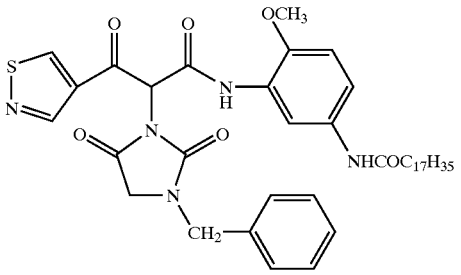
YB-41
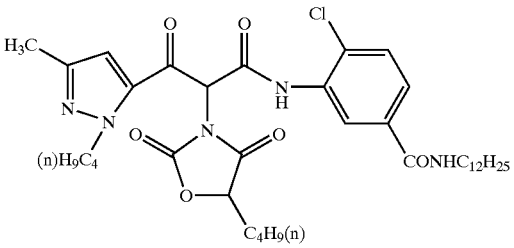
YB-42
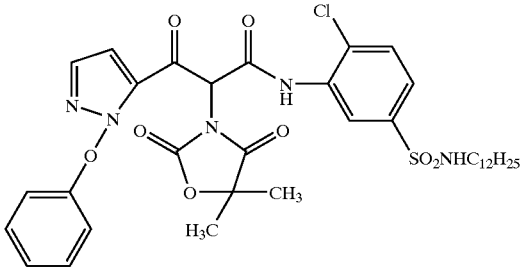
YB-43
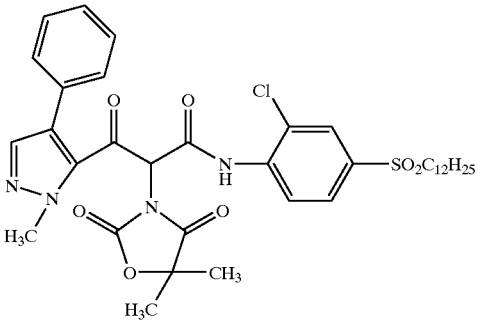
YB-44
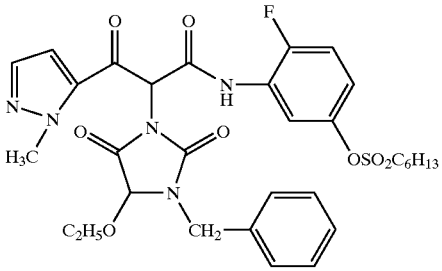
YB-45
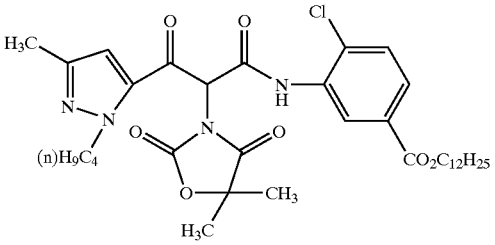
YB-46
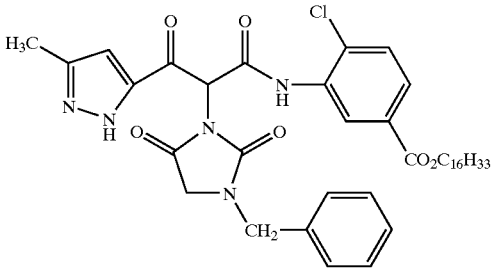
YB-47
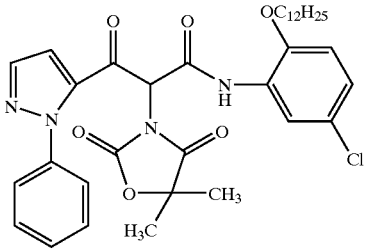
YB-48
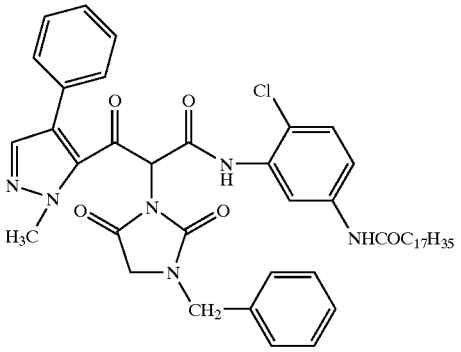
YB-49
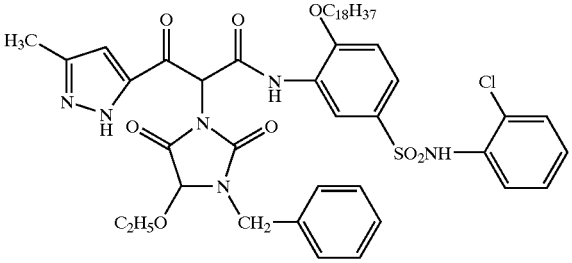

-continued
YB-50
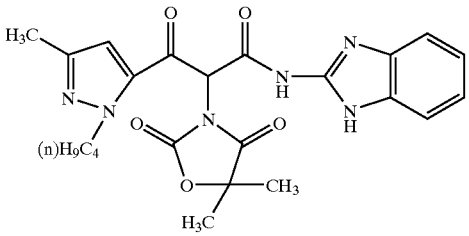
YB-51
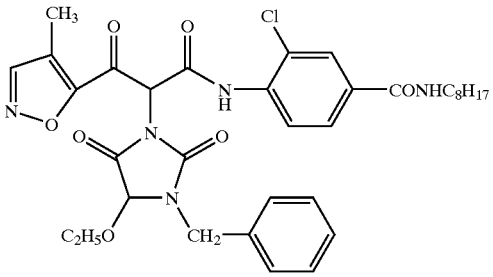
YB-52
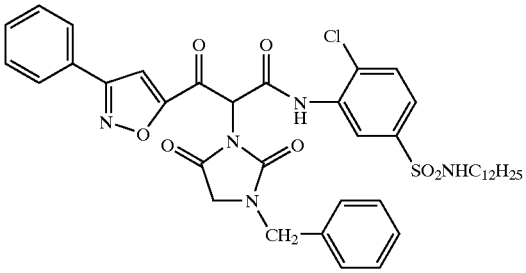
YB-53
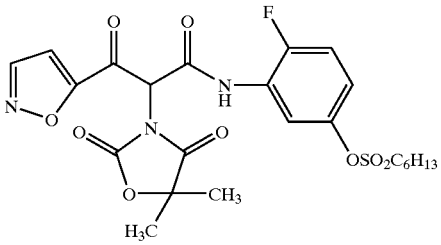
YB-54
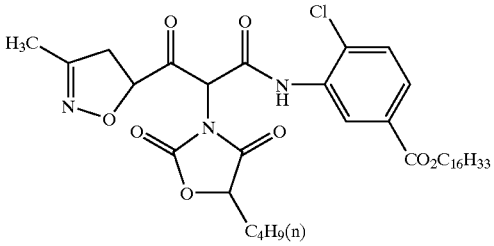
YB-55
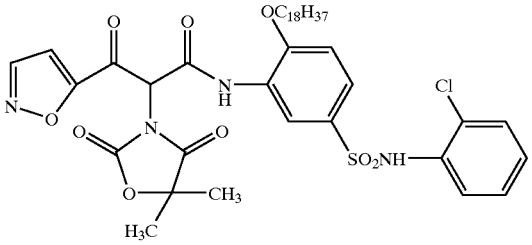
YB-56
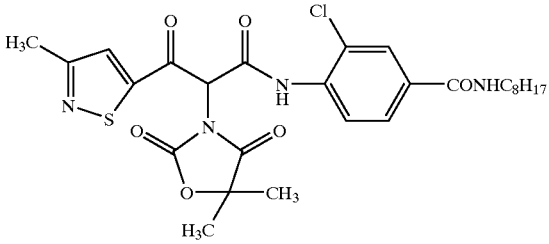
YB-57
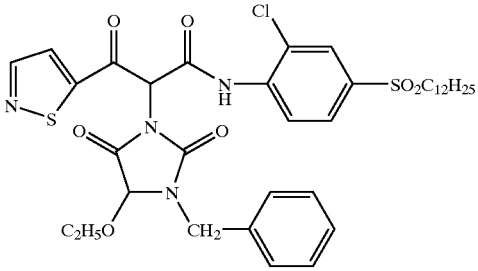
YB-58
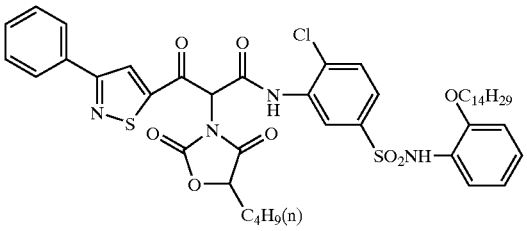
YB-59
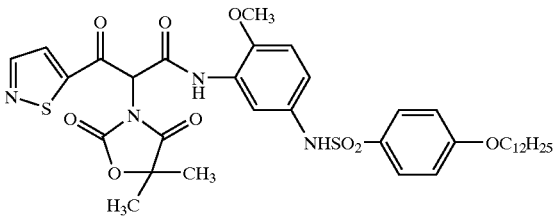

-continued
YB-60
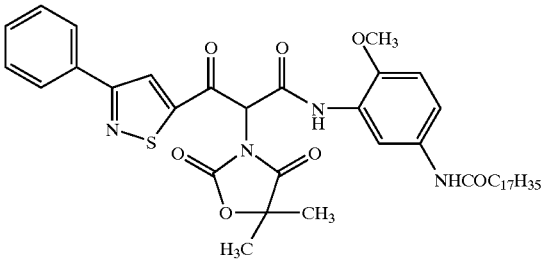
YB-61
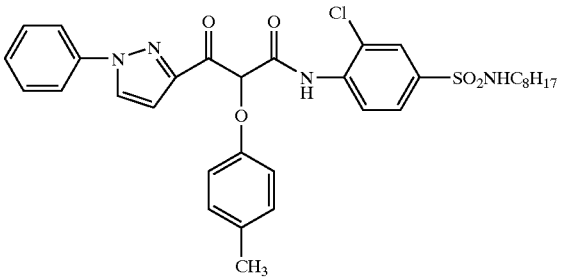
YB-62
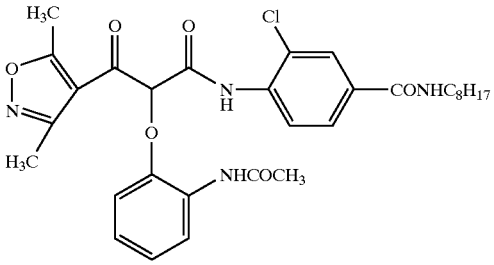
YB-63
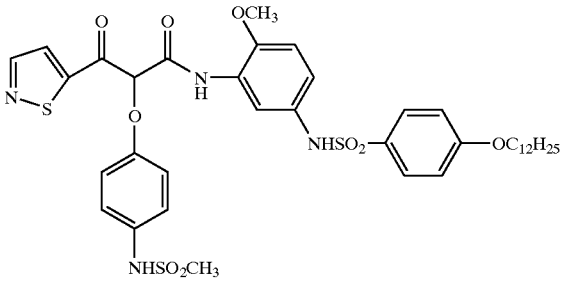
YC-1
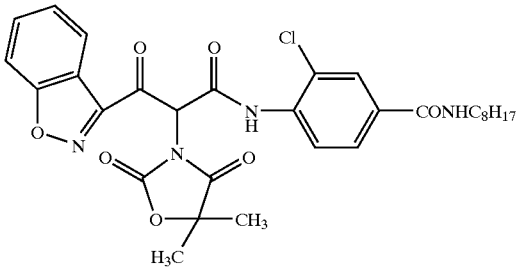
YC-2
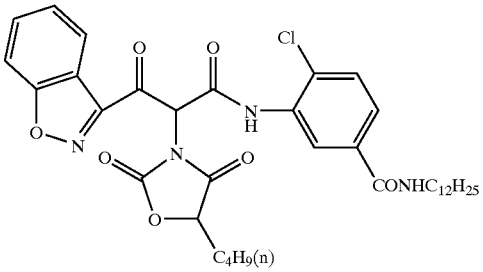
YC-3
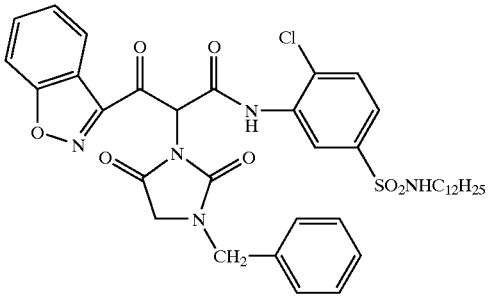
YC-4
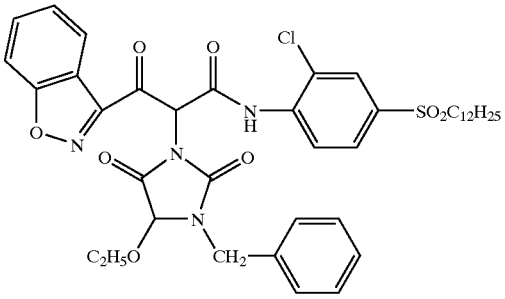
YC-5
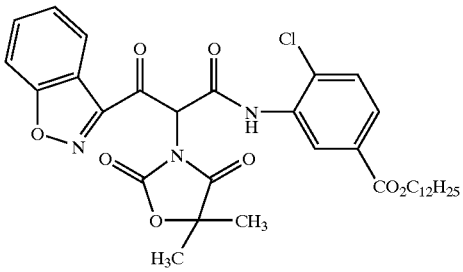
YC-6
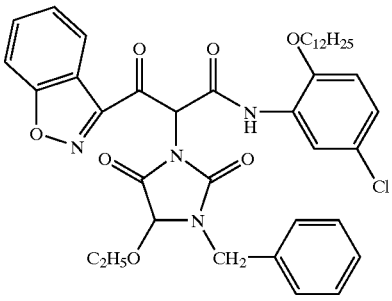

-continued
YC-7
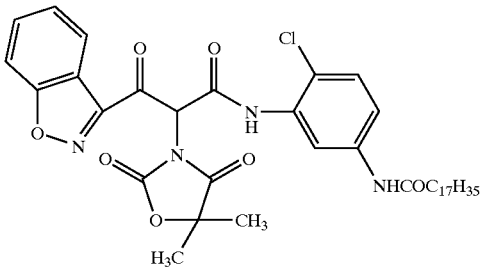
YC-8
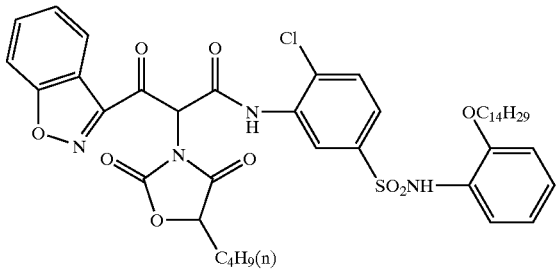
YC-9
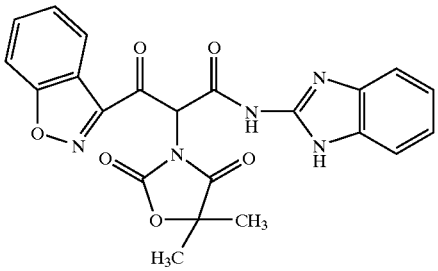
YC-10
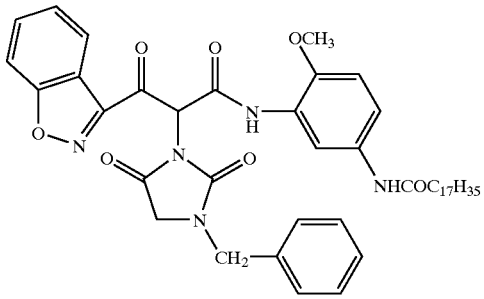
YC-11
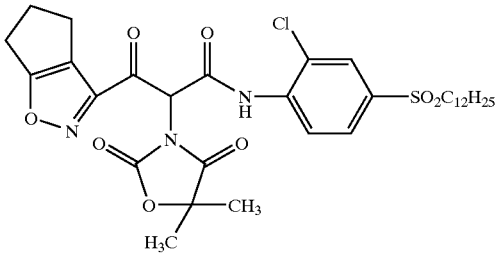
YC-12
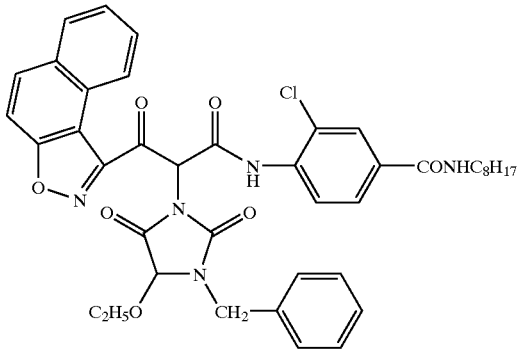
YC-13
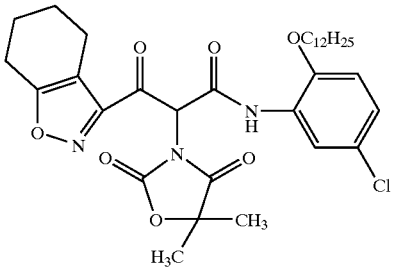
YC-14
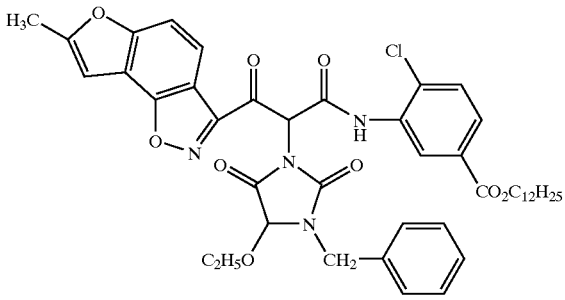
YC-15
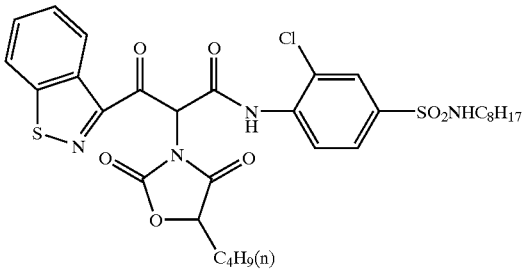
YC-16
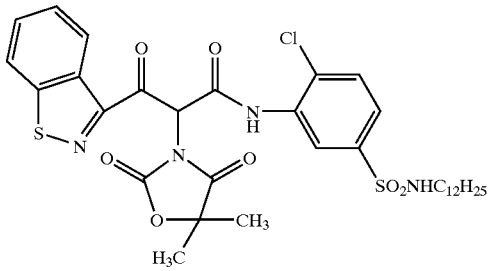

-continued
YC-17
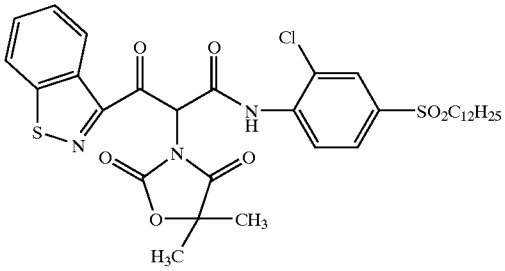
YC-18
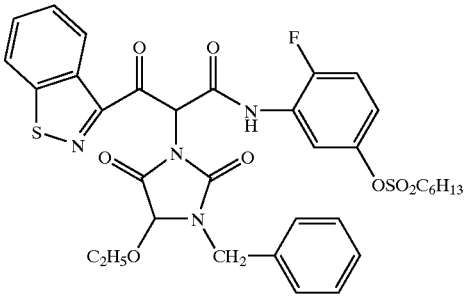
YC-19
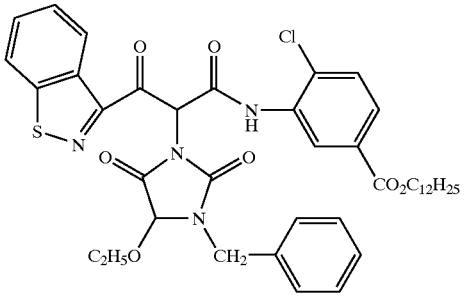
YC-20
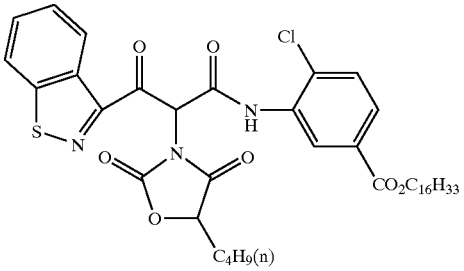
YC-21
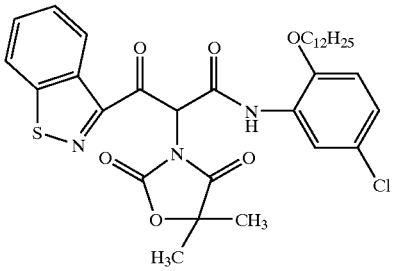
YC-22
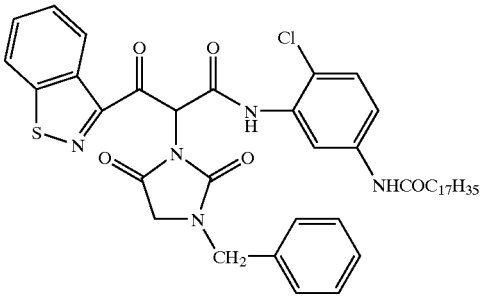
YC-23
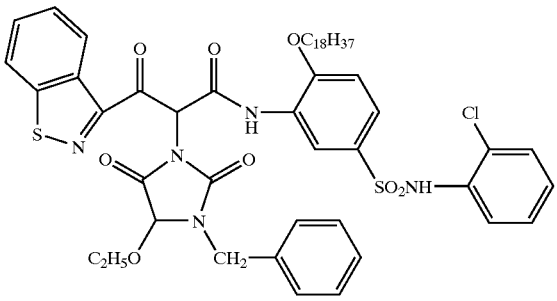
YC-24
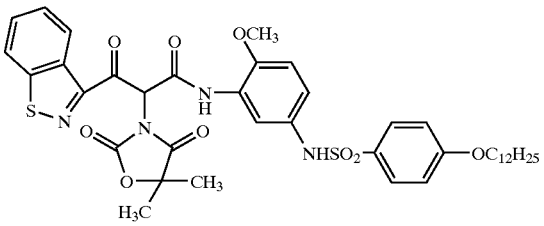
YC-25
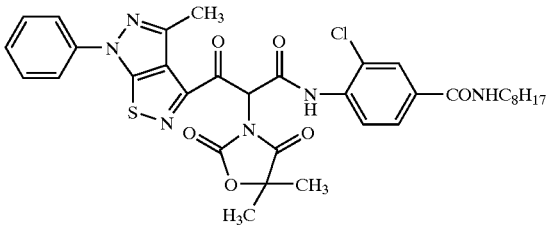
YC-26
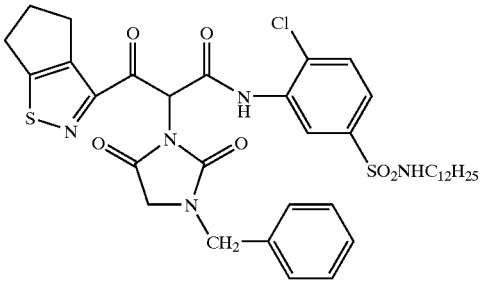

-continued
YC-27
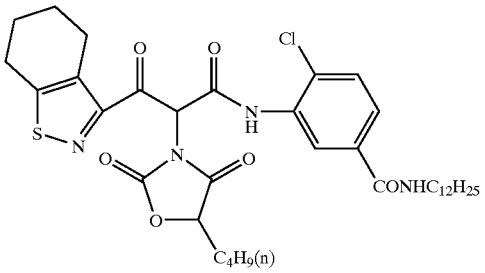
YC-28
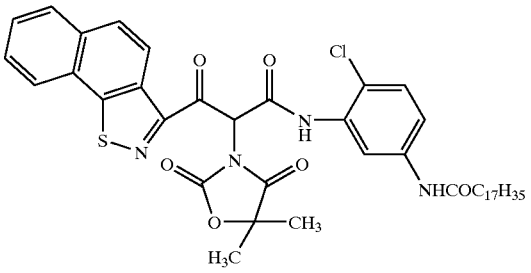
YC-29
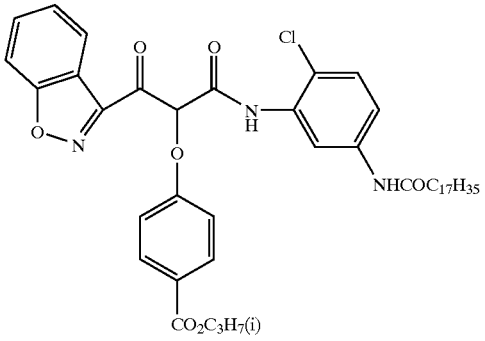
YC-30
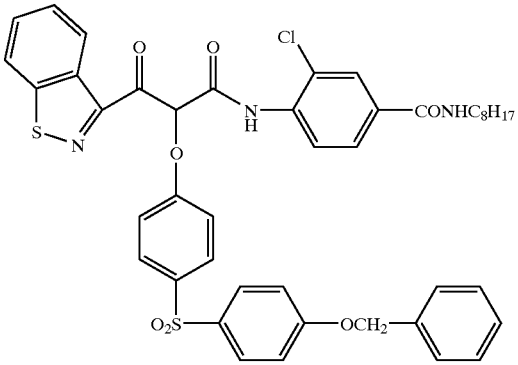
YD-1
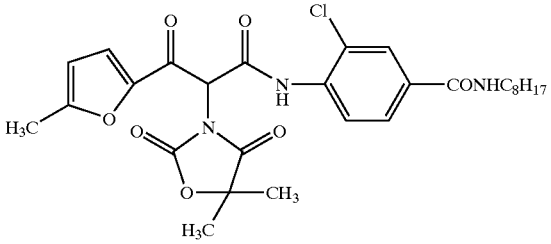
YD-2
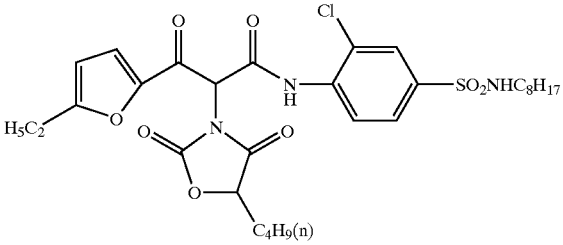
YD-3
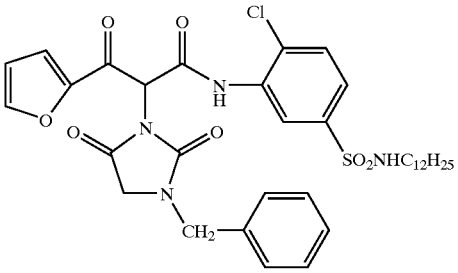
YD-4
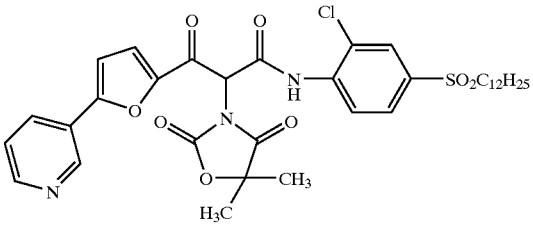
YD-5
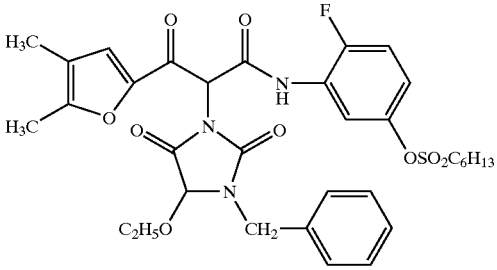
YD-6
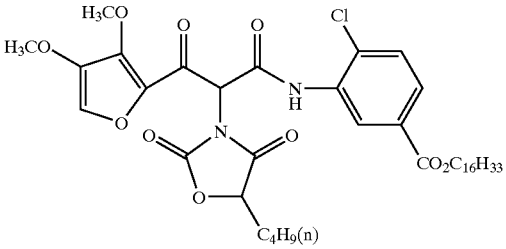

-continued
YD-7
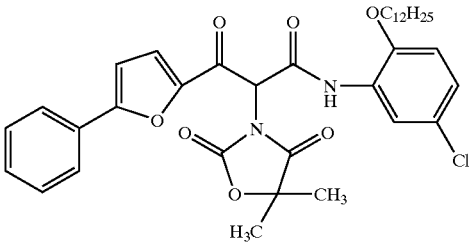
YD-8
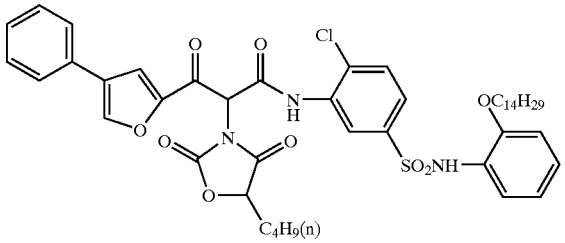
YD-9
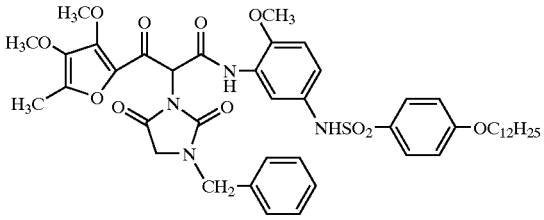
YD-10
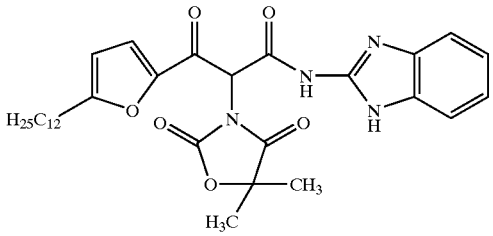
YD-11
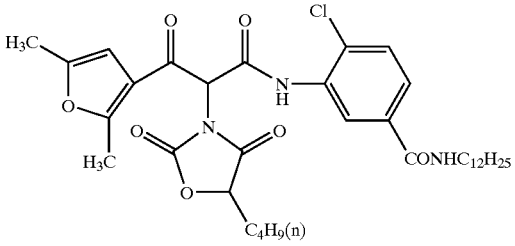
YD-12
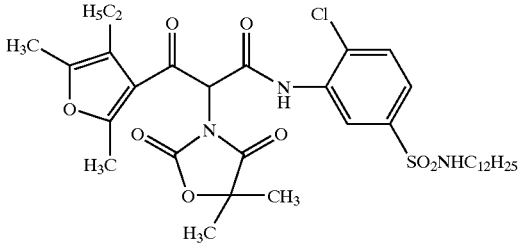
YD-13
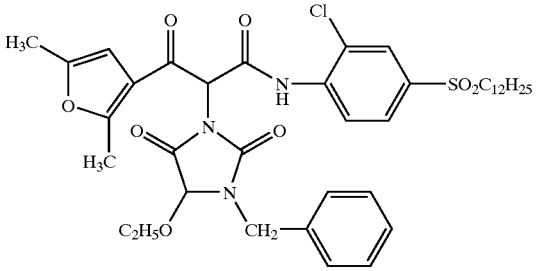
YD-14
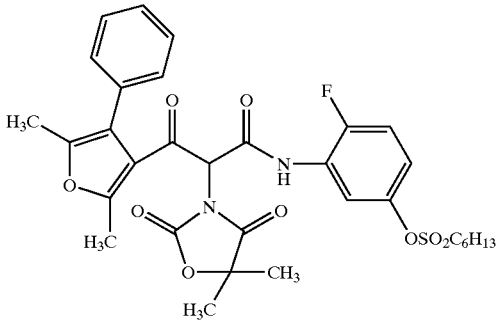
YD-15
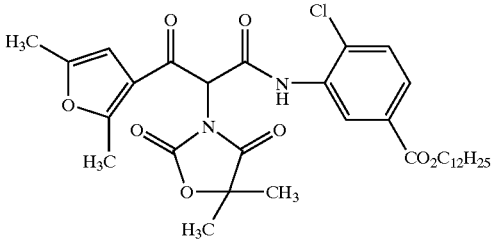
YD-16
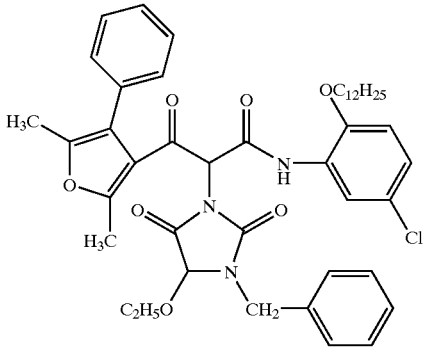

-continued
YD-17
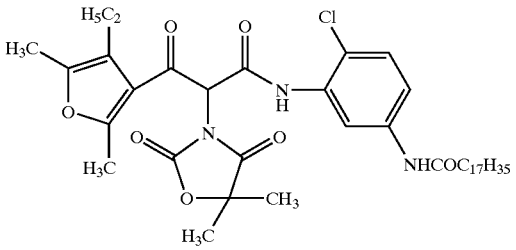
YD-18
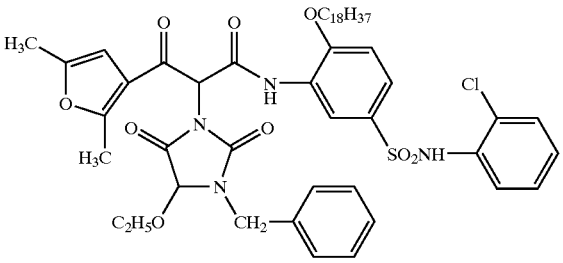
YD-19
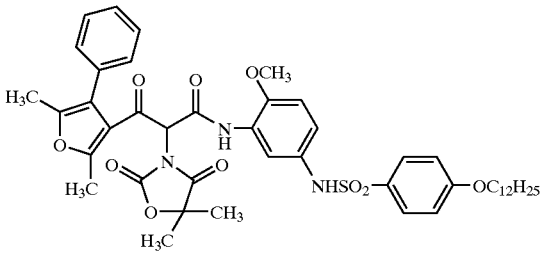
YD-20
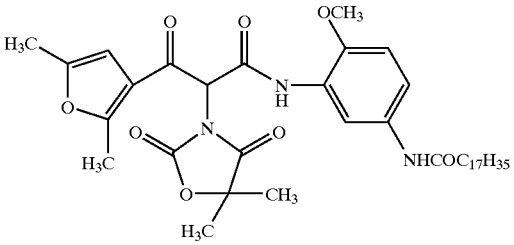
YD-21
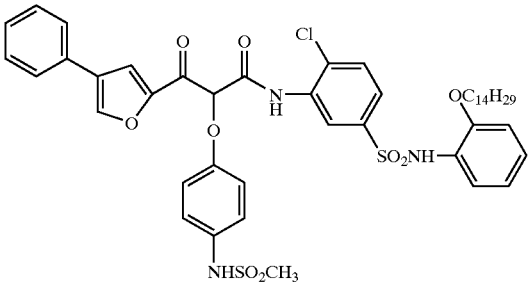
YD-22
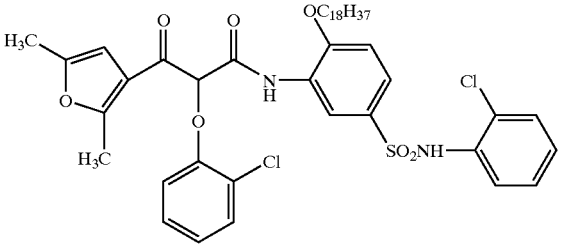
YE-1
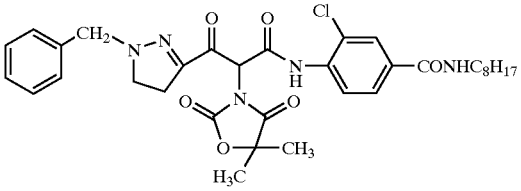
YE-2
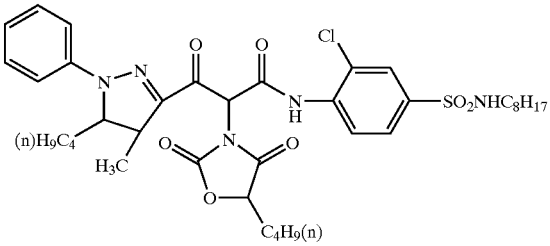
YE-3
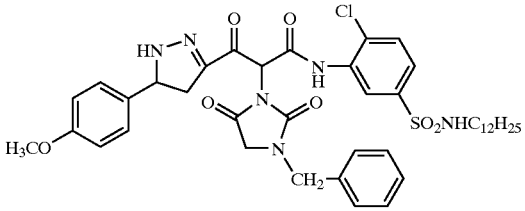
YE-4
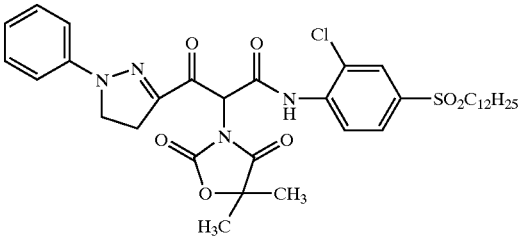

-continued
YE-5
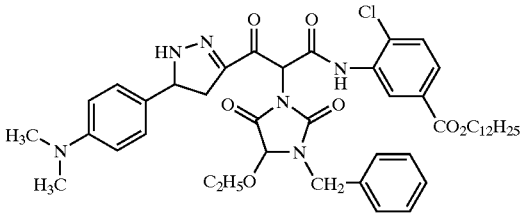
YE-6
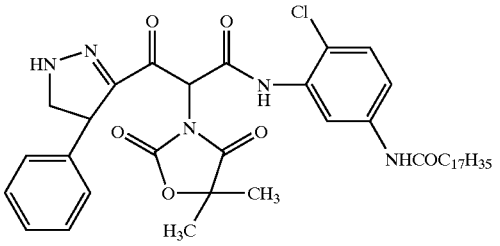
YE-7
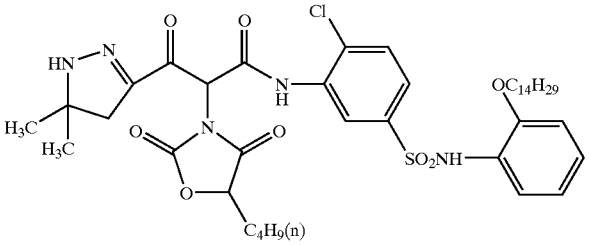
YE-8
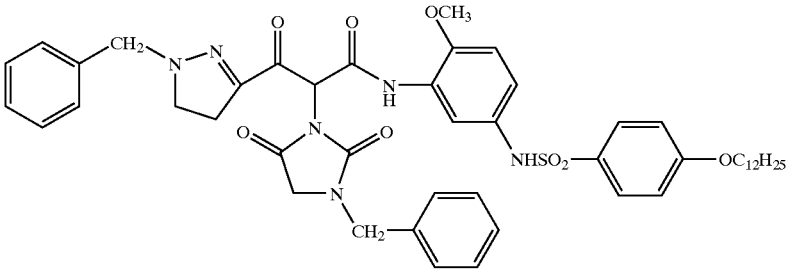
YE-9
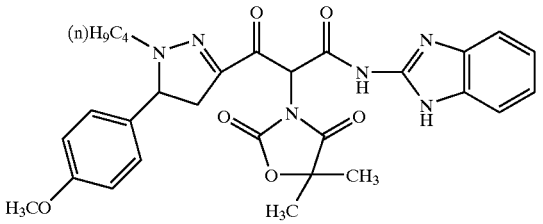
YE-10
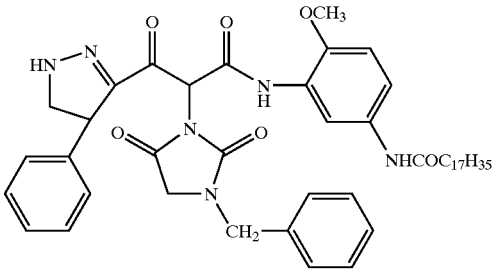
YE-11
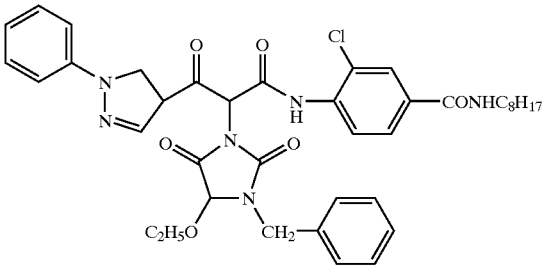
YE-12
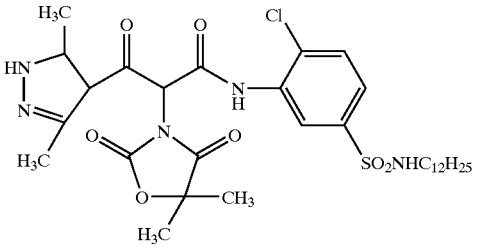

-continued
YE-13
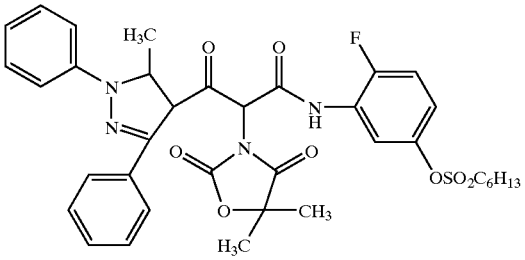
YE-14
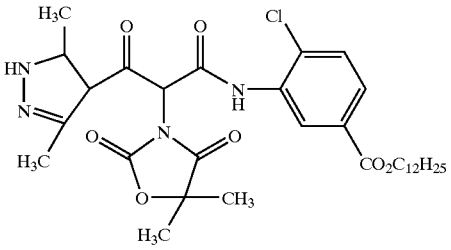
YE-15
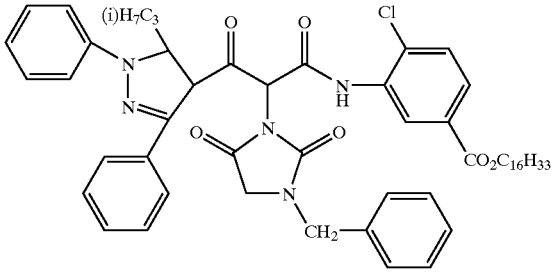
YE-16
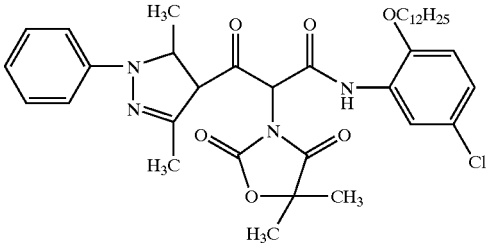
YE-17
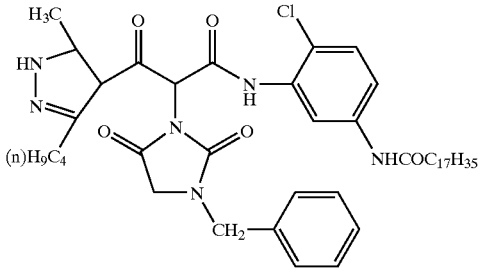
YE-18
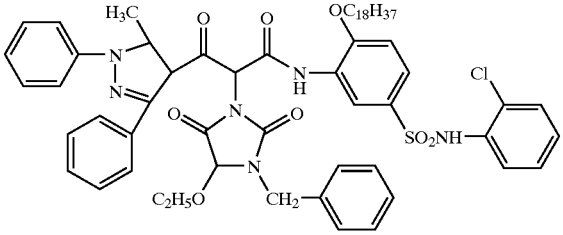
YE-19
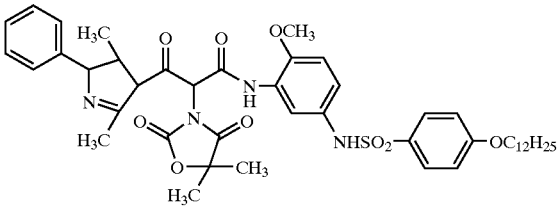
YE-20
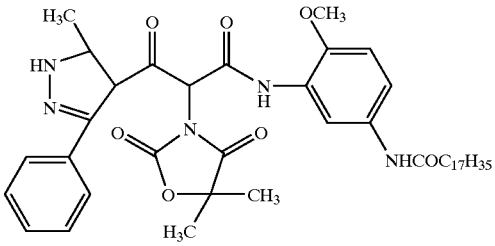
YE-21
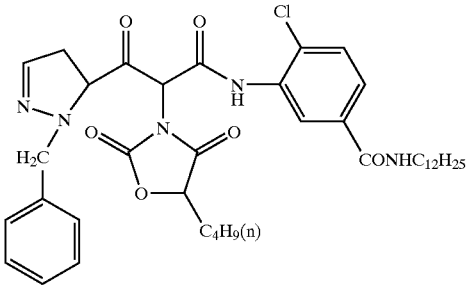
YE-22
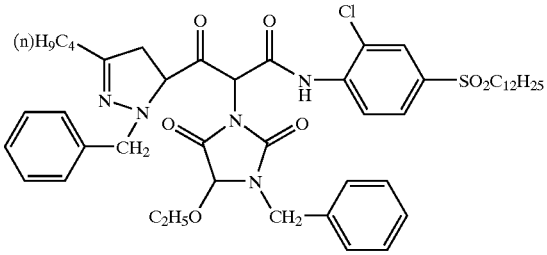

-continued
YE-23
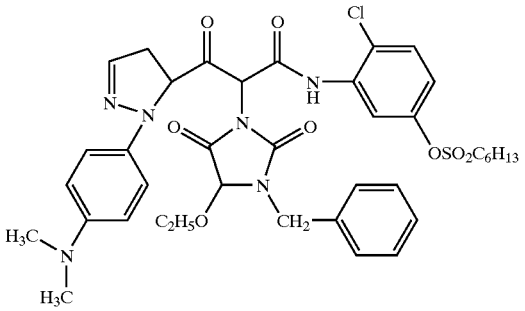
YE-24
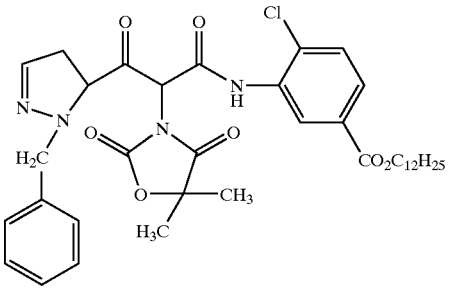
YE-25
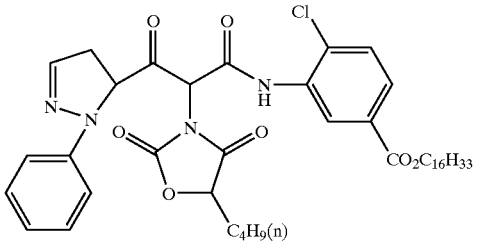
YE-26
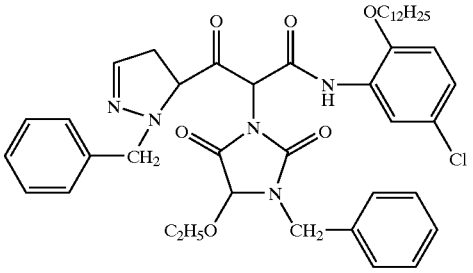
YE-27
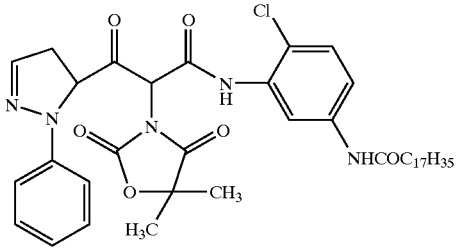
YE-28
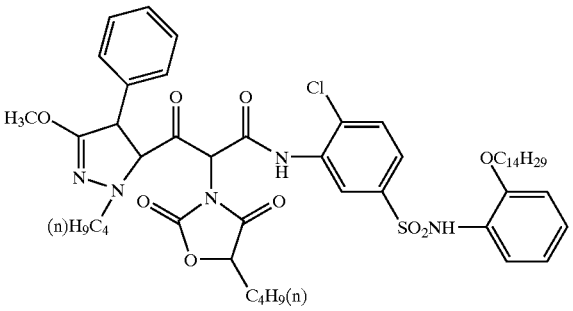
YE-29
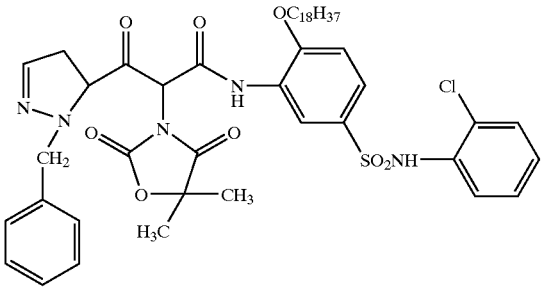
YE-30
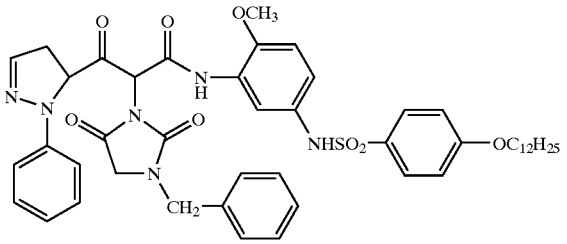
YE-31
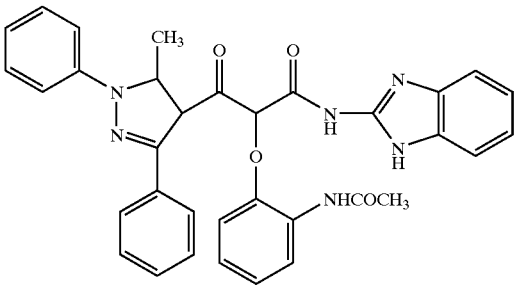
YE-32
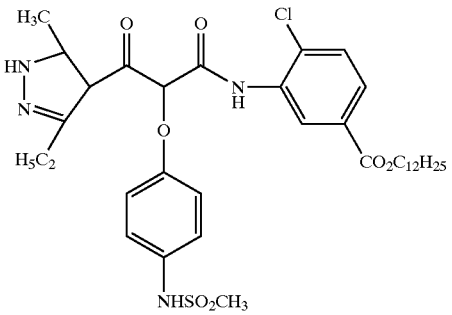

-continued
YE-33
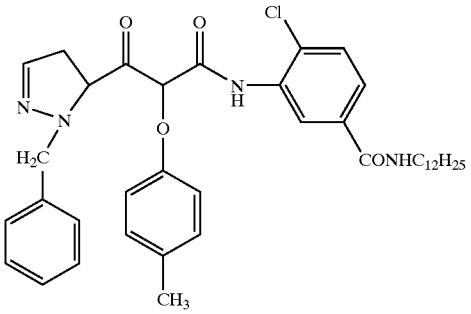
YF-1
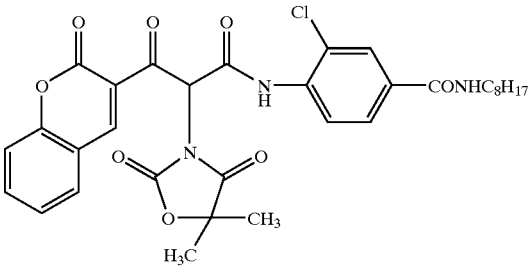
YF-2
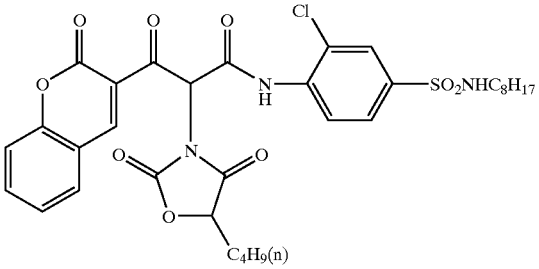
YF-3
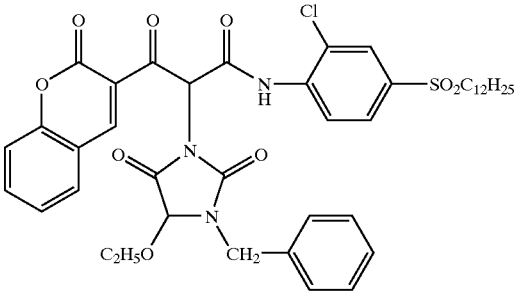
YF-4
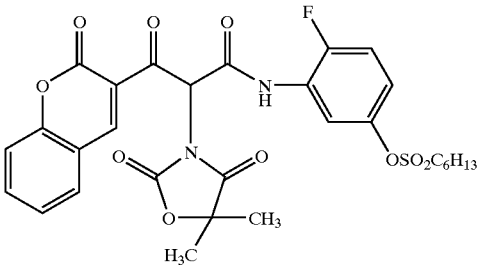
YF-5
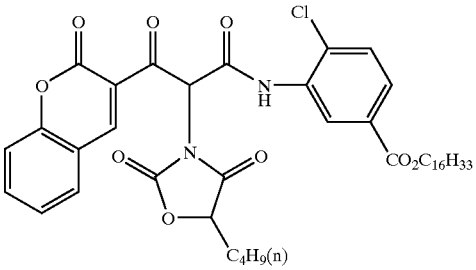
YF-6
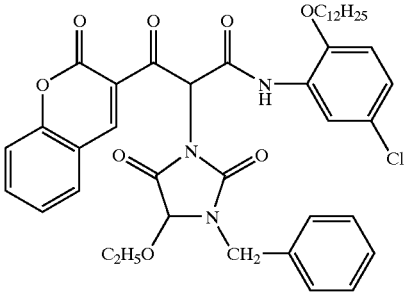
YF-7
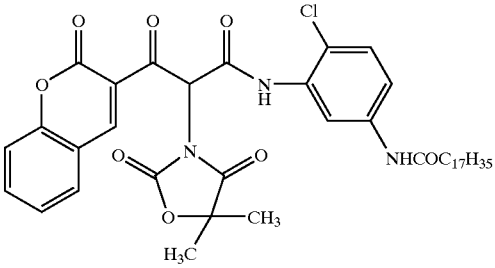
YF-8
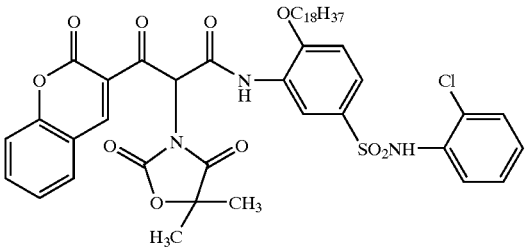
YF-9
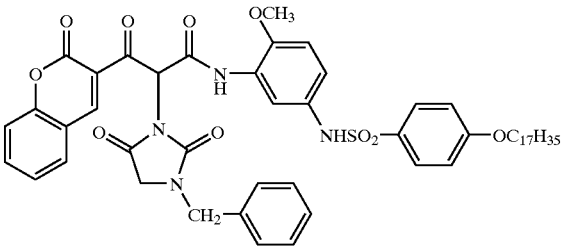

-continued
YF-10
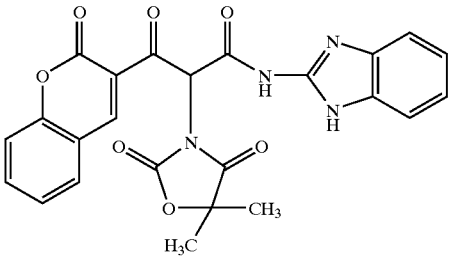
YF-11
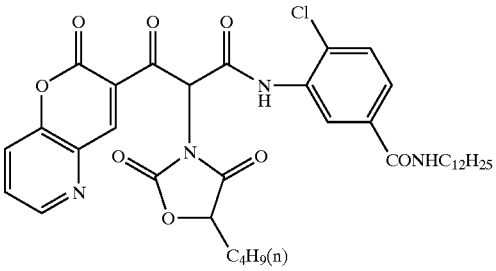
YF-12
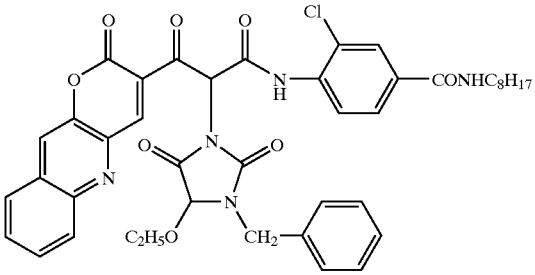
YF-13
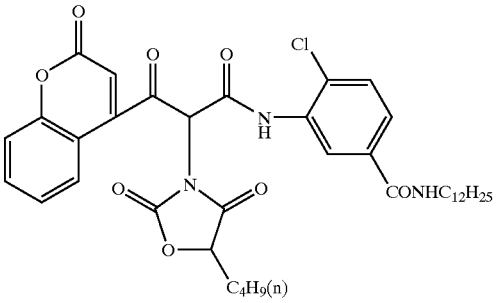
YF-14
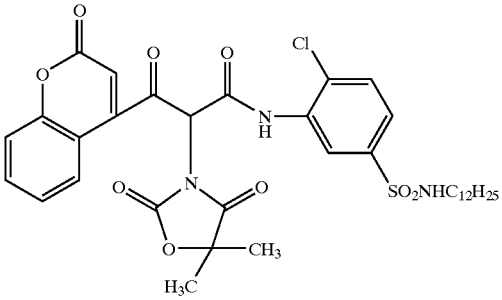
YF-15
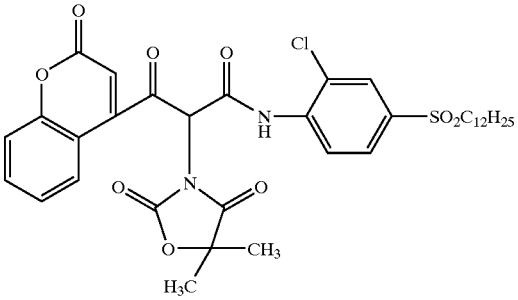
YF-16
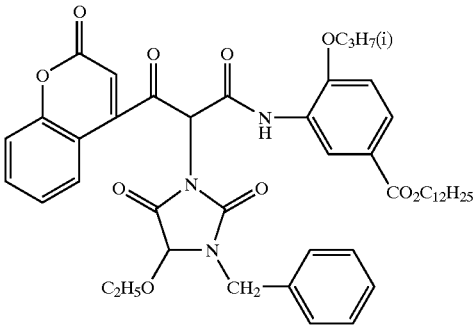
YF-17
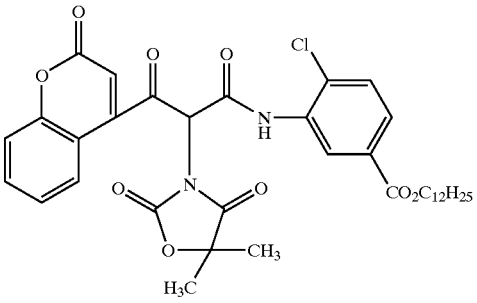
YF-18
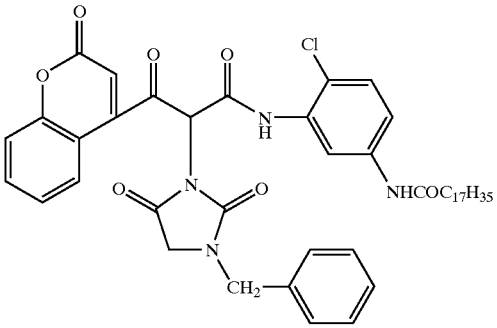
YF-19
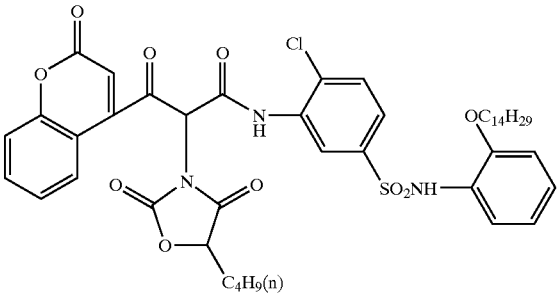

-continued
YF-20
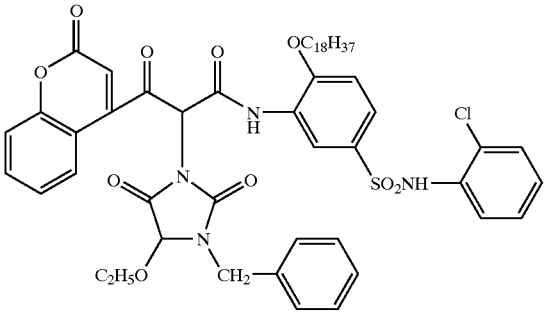
YF-21
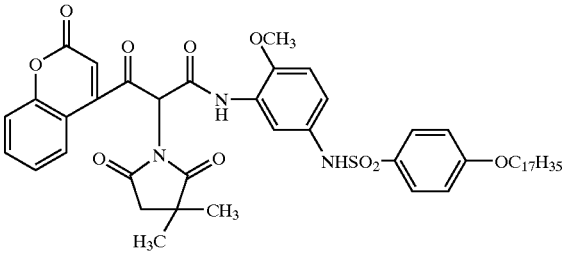
YF-22
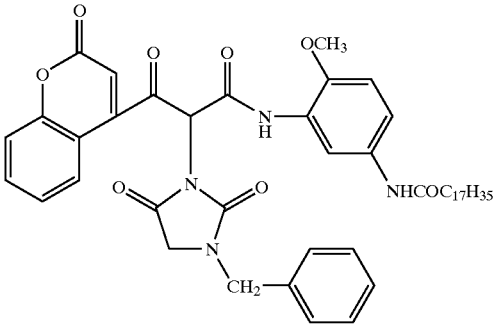
YF-23
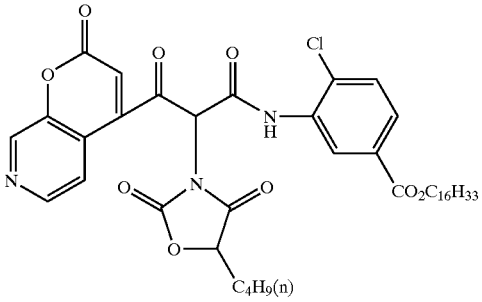
YF-24
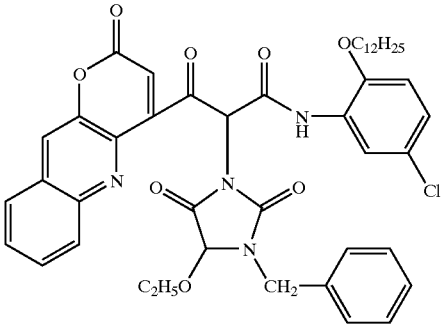
YF-25
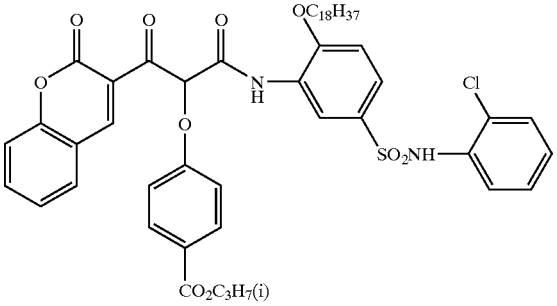
YF-26
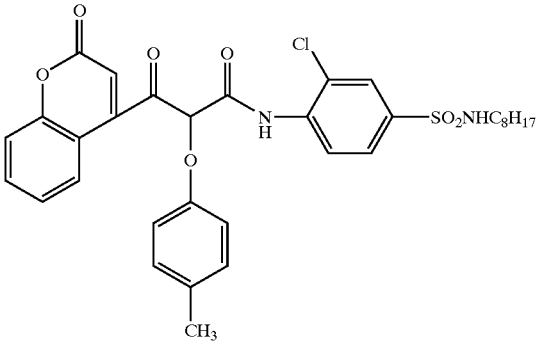
Representative synthesis examples of the yellow couplers represented by formula (I) are shown below.

SYNTHESIS EXAMPLE 1

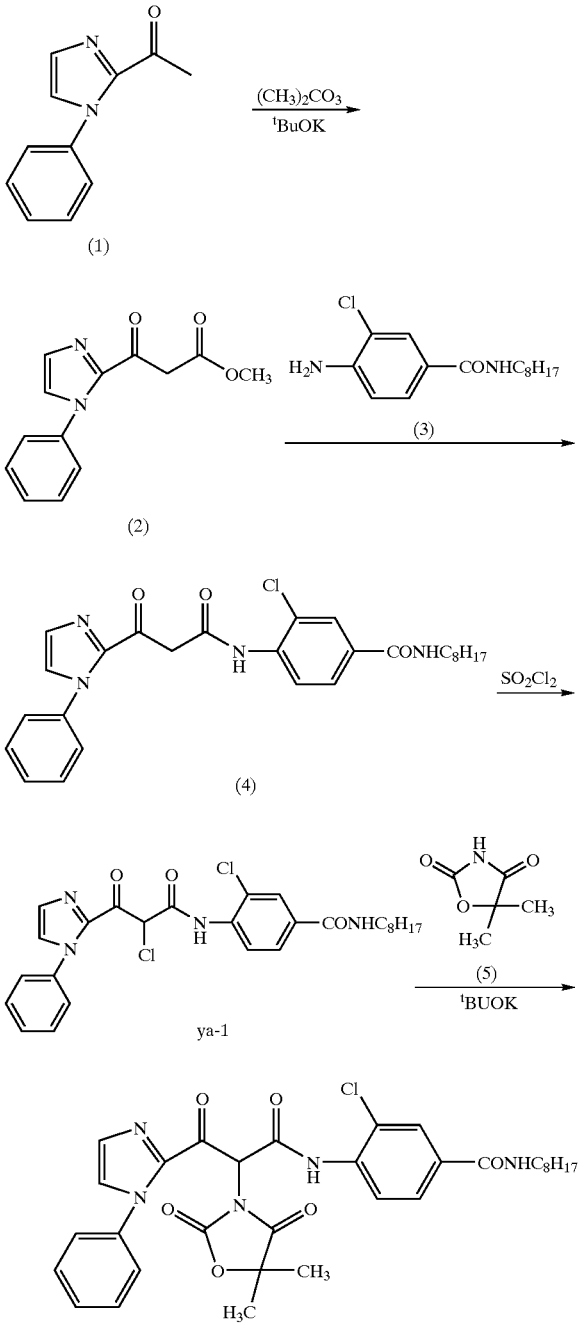

Synthesis of (2)

2-Acetyl-1-phenylimidazole (1) of 18.6 g (0.10 mol) and dimethyl carbonate of 9.0 g (0.10 mol) were added to 100 ml of acetonitrile and stirred. To this solution, 12.3 g (0.11 mol) of potassium t-butoxide was added in small amounts. The reaction mixture was stirred for 3 hr. at room temperature. After starting material (1) disappeared, 20 ml of 1 mol/l dilute hydrochloric acid was added to the reaction solution and 200 ml of water was further added thereto. Solids precipitated from the reaction solution were filtered and recrystalized in methanol to obtain (2) of 21.2 g (yield: 87.0%).

Synthesis of (4)

To 300 ml of toluene were added 21.2 g (0.087 mol) of (2) and 24.6 g (0.087 mol) of 4-amio-3-chlorooctylbenzamide (3), and the reaction solution was refluxed for 5 hr with heating, while distilling away in small amounts (ca. 30 ml). The reaction solution was cooled and allowed to stand for one night. Precipitated crystals were filtered and the obtained crystals were washed by pouring hexane to obtain (4) of 35.3 g (yield: 82%).

Synthesis of ya-1

In 300 ml of toluene was dissolved 35.3 g (0.071 mol) of (4) and 10.8 g (0.080 mol) of sulfuryl chloride was dropwise added with ice-cooling. After completion of the dropwise addition, stirring was continued further for 2 hr., then, solvents were distilled off under reduced pressure and the objective ya-1 was obtained.

Synthesis of Exemplified Coupler (YA-1)

The thus synthesized ya-1, 9.2 g (0.071 mol) of 5,5-dimethyloxazolidine-2,4-dione (5) and 12.0 g (0.087 mol) of potassium carbonate were added to 400 ml of acetonitrile and refluxed with heating for 6 hr. After completion of reaction, dilute hydrochloric acid and ethyl acetate were added to the reaction mixture. The product was extracted into an organic phase, dried by magnesium sulfate and solvents were distilled off under reduced pressure. The residue was purified by column chromatography (silica gel, developing solvent: ethyl acetate/hexane) to obtain the objective coupler (YA-1) of 38.0 g (yield: 86%). The structure was identified By NMR and mass spectrometry.

SYNTHESIS EXAMPLE 2

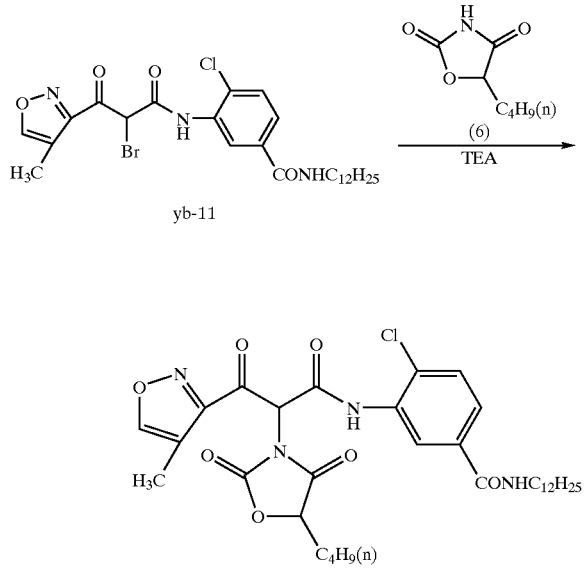

Synthesis of Exemplified Coupler (YB-11)

Compound yb-11 of 28.4 g (0.050 mol), 7.1 g (0.071 mol) of 5-butyloxazolidine-2,4-dione (6) and 8.8 g (0.087 mol) of triethylamine were added to 400 ml of acetonitrile and refluxed with heating for 6 hr. After completion of reaction, dilute hydrochloric acid and ethyl acetate were added to the reaction mixture. The product was extracted into an organic phase, dried by magnesium sulfate and solvents were distilled off under reduced pressure. The residue was purified by column chromatography (silica gel, developing solvent: ethyl acetate/hexane) to obtain the objective coupler (YB-11) of 25.9 g (yield: 88%). The structure was identified By NMR and mass spectrometry.

SYNTHESIS EXAMPLE 3

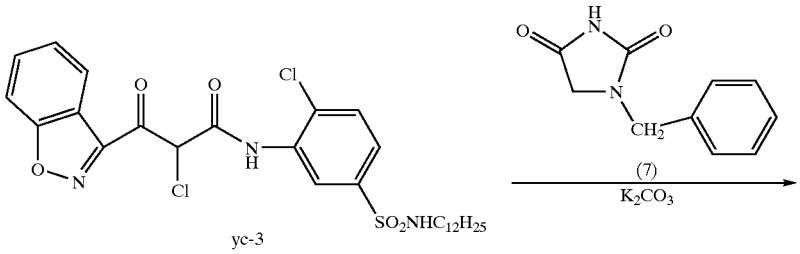

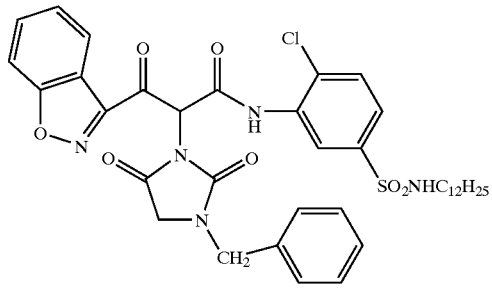

Synthesis of Exemplified Coupler (YC-3)Into 50 ml of acetone was put 19.0 g (0.100 mol) of 1-benzylhydantoin (7), then, 20.7 g (0.150 mol) of potassium carbonate was added thereto at room temperature and after stirred for 10 min., the mixture was heated to 90° C. Further thereto, 29.3 g (0.050 mol) of compound yc-3, which was dissolved in 50 ml of acetone, was fractionally added over a period of 20 min. After completion of reaction, water and ethyl acetate were added to the reaction mixture. The product was extracted into an organic phase, dried by magnesium sulfate and concentrated under reduced pressure. The residue was purified by column chromatography (silica gel, developing solvent: ethyl acetate/hexane) to obtain the objective coupler (YC-3) of 34.9 g (yield: 93%). Identification was made in mass spectrometry and NMR spectrometry, and compound YC-3 was confirmed.

SYNTHESIS EXAMPLE 4

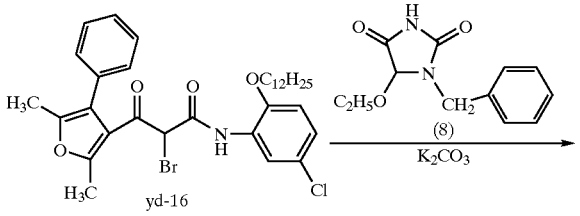

-continued

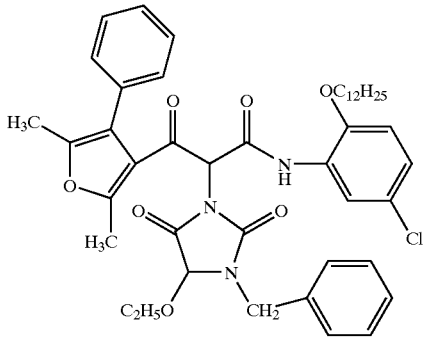

Synthesis of Exemplified Coupler (YD-16)Into 50 ml of ethyl acetate was put 23.4 g (0.100 mol) of 5-ethoxy-1-benzylhydantoin (8), then, 20.7 g (0.150 mol) of potassium carbonate was added thereto at room temperature and after stirred for 10 min., the mixture was heated to 90° C. Further thereto, 31.6 g (0.050 mol) of compound yd-16, which was previously dissolved in 50 ml of acetone, was fractionally added over a period of 20 min. After completion of reaction, water and ethyl acetate were added to the reaction mixture. The product was extracted into an organic phase, dried by magnesium sulfate and concentrated under reduced pressure. The residue was purified by column chromatography (silica gel, developing solvent: ethyl acetate/hexane) to obtain the objective coupler (YD-16) of 35.3 g (yield: 90%). Identification was made in mass spectrometry and NMR spectrometry, and compound YC-3 was confirmed.

SYNTHESIS EXAMPLE 5

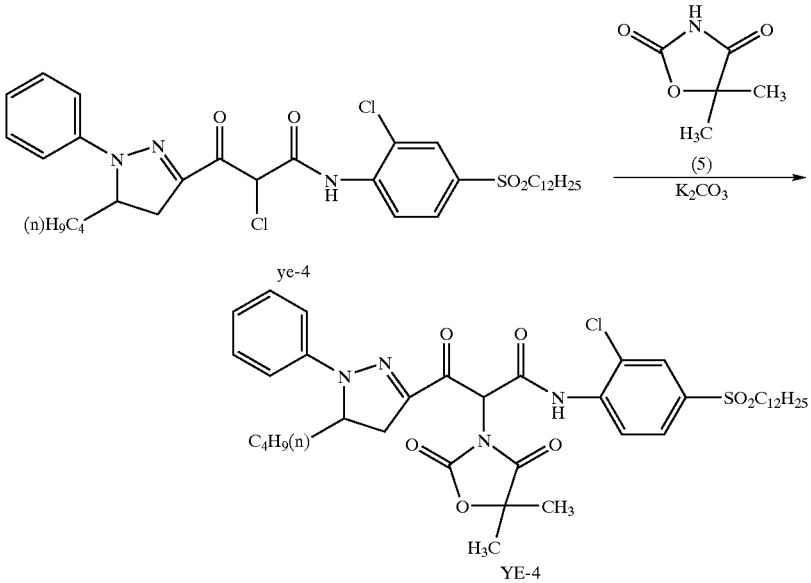

Synthesis of Exemplified Coupler (YE-4)

Compound ye-4 of 30.3 g (0.050 mol), 9.2 g (0.071 mol) of 5,5-dimethyloxazolidine-2,4-dione (5) and 12.0 g (0.087 mol) of potassium carbonate were added to 400 ml of acetonitrile and refluxed with heating for 6 hr. After completion of reaction, dilute hydrochloric acid and ethyl acetate were added to the reaction mixture. The product was extracted into an organic phase, dried on magnesium sulfate and solvents were distilled off under reduced pressure. The residue was purified by column chromatography (silica gel, developing solvent: ethyl acetate/hexane) to obtain the objective coupler (YE-4) of 28.4 g (yield: 81%). The structure was identified in NMR and mass spectrometry.

SYNTHESIS EXAMPLE 6

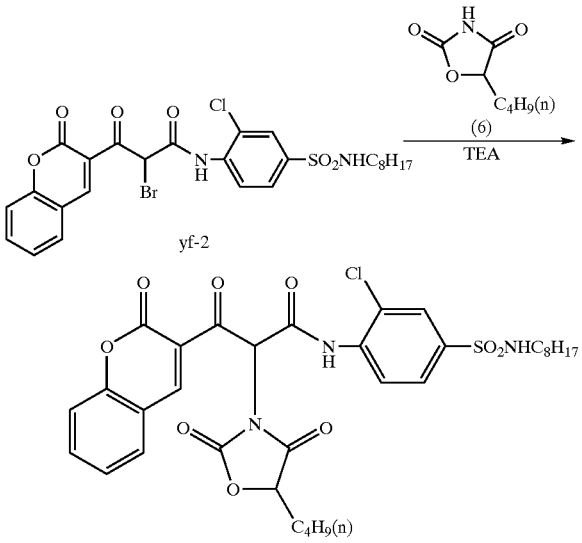

Synthesis of Exemplified Coupler (YF-2)

Compound yf-2 of 30.6 g (0.050 mol), 7.1 g (0.071 mol) of 5-butyloxazolidine-2,4-dione (6) and 8.8 g (0.087 mol) of triethylamine were added to 400 ml of acetonitrile and refluxed with heating for 6 hr. After completion of reaction, dilute hydrochloric acid and ethyl acetate were added to the reaction mixture. The product was extracted into an organic phase, dried by magnesium sulfate and solvents were distilled off under reduced pressure. The residue was purified by column chromatography (silica gel, developing solvent: ethyl acetate/hexane) to obtain the objective coupler (YB-11) of 26.8 g (yield: 88%). The structure was identified By NMR and mass spectrometry.

The yellow coupler represented by formula (I) was contained in a silver halide emulsion constituting the light-sensitive layer, preferably in an amount of 0.002 to 1 mol, and more preferably 0.005 to 0.3 mol per mol of silver halide.

There are applicable commonly known methods to incorporate the yellow coupler represented by formula (I). For example, the coupler is dissolved in a mixture of conventionally known high boiling solvent such as dibutyl phthalate or tricresyl phosphate and a low boiling solvent such as butyl acetate or ethyl acetate or in a low boiling solvent alone. The thus prepared coupler solution is mixed with an aqueous gelatin solution containing a surfactant and dispersed by using a high-speed rotating mixer, a colloid mill or a ultrasonic homogenizer. The thus emulsified dispersion is directly added to the emulsion. Alternatively, the emulsified dispersion is set, then shredded, washed and added to the emulsion.

There is usable any one of conventional silver halide emulsions conventionally in the silver halide color photographic material relating to this invention (also denoted simply as photographic material). The emulsion can be chemically sensitized in accordance with the conventional manner and can also be spectrally sensitized using sensitizing dyes to the intended wavelength region.

The silver halide emulsion may be added with an antifoggant or stabilizer. Gelatin is advantageously usable as a binder of the emulsion. The emulsion layer or other hydrophilic colloid layers can be hardened, and a plasticizer or water-insoluble or sparingly water-soluble synthetic polymer dispersion (latex) may be incorporated.

Couplers are used in the emulsion layer of the silver halide color photographic material. There are also usable a colored coupler having a color correction effect, a competing coupler and compounds capable of releasing, upon coupling with an oxidation product of a color developing agent, a photographic useful fragment such as a developing accelerator, bleach accelerator, developer, silver halide solvent, color toning agent, hardening agent, fogging agent, antifoggant, chemical sensitizer, spectral sensitizer or desensitizer.

The photographic material may be provided with auxiliary layers such as a filter layer, anti-halation layer and anti-irradiation layer. These layers and/or the emulsion layer may contain dyes which are capable of being leached out of photographic material or being bleached during processing. The photographic material may further contain a formalin scavenger, brightener, matting agent, lubricant, image stabilizer, surfactant, anti-staining agent, development accelerator or development retarder.

There can be used supports such as polyethylene-laminated paper, polyethylene terephthalate film, baryta paper and cellulose triacetate.

The silver halide color photographic material relating to this invention is exposed and then processed to form color images in a conventional manner, as described in Research Disclosure 17643, page 28–29, ibid 18716, page 615 and ibid 308119, XIX, using commonly known p-phenylenediamine type color developing agents, as described in T. H. James, The Theory of Photographic Process For the Edition, page 291–334 and Journal of the American Chemical Society, vol. 73 [3], 100 (1951).

EXAMPLES

The present invention will be described based on examples but embodiments of the invention are by no means limited to these.

Example 1

On a paper support in which one side of the support was laminated with polyethylene and the other side was laminated with polyethylene containing titanium oxide, the following layers were coated on the titanium oxide containing polyethylene layer side to prepare silver halide color photographic material sample 101. Coating solutions were prepared in the following manner.

1st Layer Coating Solution

To 23.3 g of yellow coupler (Y-1), 10.0 g of dye image stabilizer (ST-1), 6,67 g of dye-image stabilizer (ST-2), 0. 67 g of additive (HQ-1), an anti-irradiation dye and 5.82 g of a high boiling solvent (DNP) was added 60 ml of ethyl acetate. Using an ultrasonic homogenizer, the resulting solution was dispersed in 220 ml of an aqueous 10% gelatin solution containing 7 ml of an aqueous 20% surfactant (SU-1) solution to obtain a yellow coupler emulsified dispersion. The obtained dispersion was mixed with the blue-sensitive silver halide emulsion (Em-B, silver content: 8.68 g)) to prepare a 1st layer coating solution.

Coating solutions for the 2nd layer to 7th layer were each prepared similarly to the 1st layer coating solution, and the respective coating solutions were coated so as to have a coating amount as shown below.

Hardeners (H-1) and (H-2) were incorporated into the 2nd and 4th layers (H-1) and the 7th layer (H-2). There were also incorporated surfactants, (SU-2) and (SU-3) as a coating aid to adjust surface tension. Unless otherwise noted, the amount in the photographic material represents grams per $m^2$. The amount of silver halide contained in the respective layers was represented by equivalent converted to silver.

| Layer | Constitution | Amount ($g/m^2$) |
|---|---|---|
| 7th Layer | Gelatin | 1.00 |
| (Protective layer) | DIDP | 0.005 |
| | Additive (HQ-2) | 0.002 |
| | Additive (HQ-3) | 0.002 |
| | Additive (HQ-4) | 0.004 |
| | Additive (HQ-5) | 0.02 |
| | Compound (F-1) | 0.002 |
| 6th Layer | Gelatin | 0.40 |
| (UV absorbing layer) | UV absorbent (UV-1) | 0.10 |
| | UV absorbent (UV-2) | 0.04 |
| | UV absorbent (UV-3) | 0.16 |
| | Additive (HQ-5) | 0.04 |
| | DNP | 0.20 |
| | PVP | 0.03 |
| | Anti-irradiation dye (AI-2) | 0.02 |
| | Anti-irradiation dye (AI-4) | 0.01 |
| 5th Layer | Gelatin | 1.30 |
| (Red-sensitive layer) | Red-sensitive emulsion (Em-R) | 0.21 |
| | Cyan coupler (C-1) | 0.17 |
| | Cyan coupler (C-2) | 0.25 |
| | Dye image stabilizer (ST-1) | 0.20 |
| | Antistaining agent (HQ-1) | 0.01 |
| | HBS-1 | 0.20 |
| | DOP | 0.20 |
| 4th Layer | Gelatin | 0.94 |
| (UV absorbing layer) | UV absorbent (UV-1) | 0.28 |
| | UV absorbent (UV-2) | 0.09 |
| | UV absorbent (UV-3) | 0.38 |
| | Additive (HQ-5) | 0.10 |
| | DNP | 0.40 |
| 3rd Layer | Gelatin | 1.40 |
| (Green-sensitive layer) | Green-sensitive Emulsion (Em-G) | 0.17 |
| | Magenta coupler (M-2) | 0.33 |
| | Dye image stabilizer (ST-3) | 0.20 |
| | Dye image stabilizer (ST-4) | 0.17 |
| | DIDP | 0.13 |
| | DBP | 0.13 |
| | Anti-irradiation dye (AI-1) | 0.01 |
| 2nd layer | Gelatin | 1.20 |
| (Interlayer) | Antistaining agent (HQ-2) | 0.03 |
| | Antistaining agent (HQ-3) | 0.03 |
| | Antistaining agent (HQ-4) | 0.05 |
| | Antistaining agent (HQ-5) | 0.23 |
| | DIDP | 0.06 |
| | Compound (F-1) | 0.002 |
| 1st layer | Gelatin | 1.20 |
| (Blue-sensitive layer) | Blue-sensitive Emulsion (Em-B) | 0.26 |
| | Yellow coupler (Y-1) | 0.70 |
| | Dye image stabilizer (ST-1) | 0.30 |
| | Dye image stabilizer (ST-2) | 0.10 |
| | Additive (HQ-1) | 0.02 |
| | Anti-irradiation dye (AI-3) | 0.01 |
| | DNP | 0.18 |
| Support | Polyethylene-laminated paper | |

Y-1 (Comparative coupler)
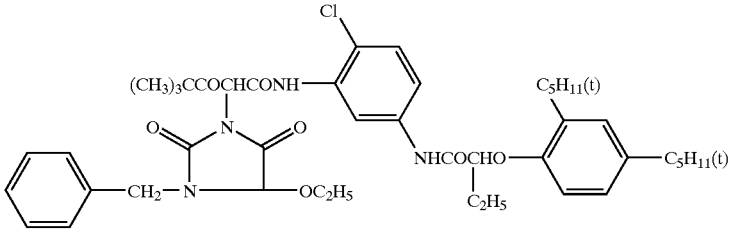
M-1
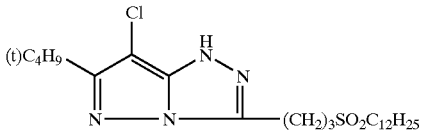
C-1
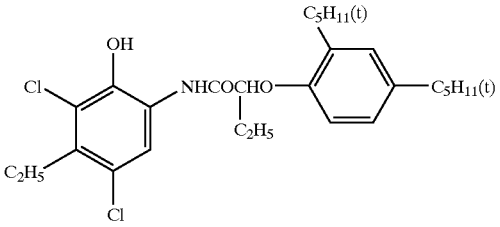
C-2
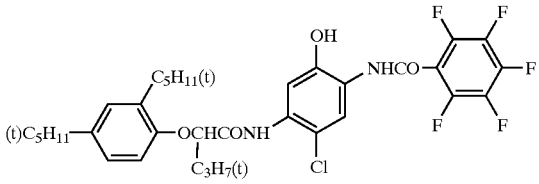
ST-1
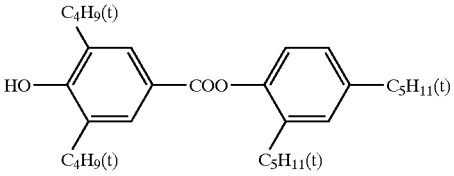
ST-2
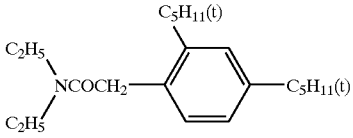
ST-3
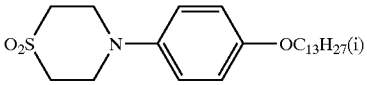
ST-4
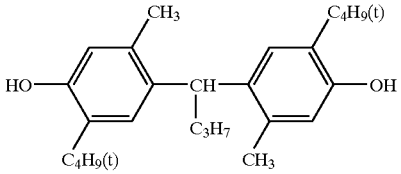
UV-1
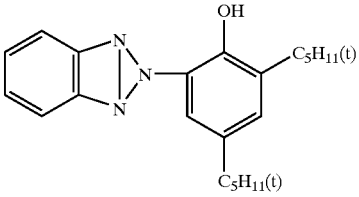
UV-2
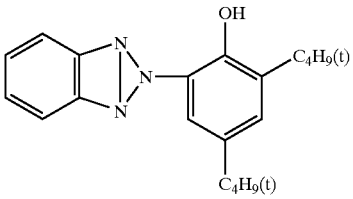
UV-3
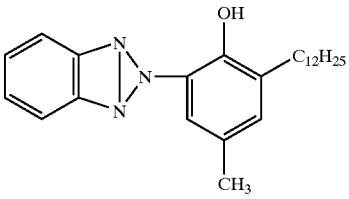
HQ-1
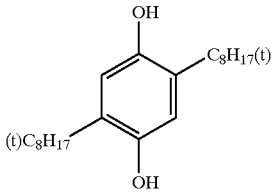
HQ-2
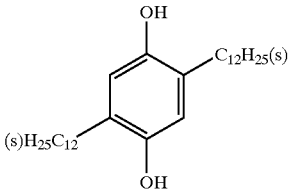

-continued
HQ-3
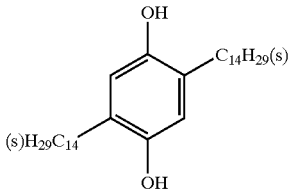
HQ-4
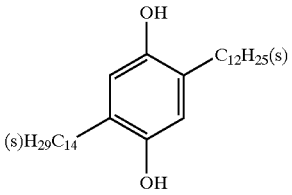
HQ-5
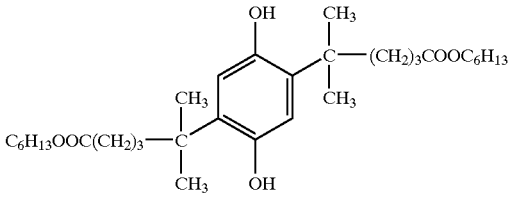
HBS-1
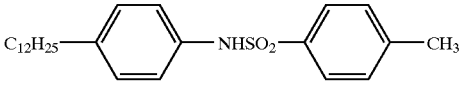
SU-1
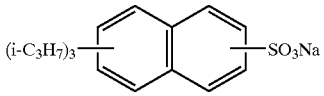
SU-2
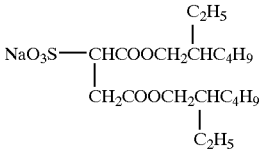
SU-3
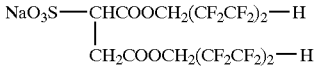
AI-1
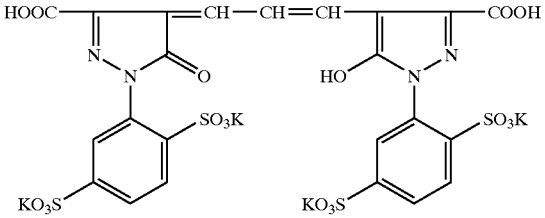
AI-2
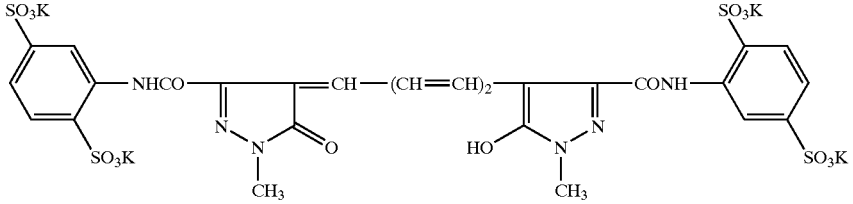
AI-3
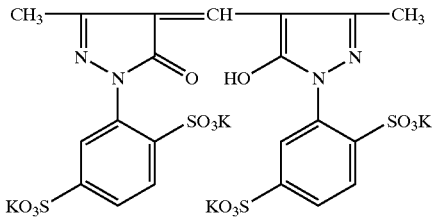
AI-4
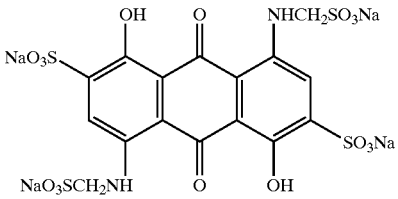
H-1
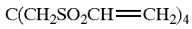
H-2
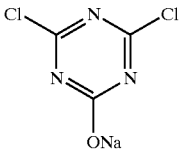
F-1
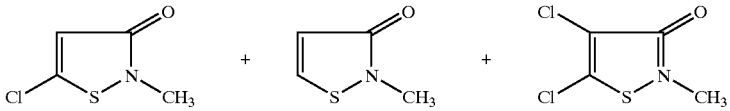
50% 46% (4%) molar ratio
DBP: Dibutyl phthalate DOP: Dioctyl phthalate DNP: Dinonyl phthalate
DIDP: Diisodecyl phthalate
PVP: Polyvinyl pyrrolidone Preparation of Blue-Sensitive Silver Halide Emulsion To 1000 ml of aqueous 2% gelatin solution kept at 40° C. were simultaneously added the following solutions (A) and (B) for a period of 30 min., while being maintained at a pAg of 6.5 and pH of 3.0, and further thereto were added solutions (C) and (D) for a period of 180 min., while being maintained at a pAg of 7.3 and pH of 5.5. The pAg was controlled using the following controlling solution. The controlling solution was a mixed halide salt solution comprising sodium chloride and potassium bromide, in which the ratio of chloride ion to bromide ion was 99.8:0.2 and concentrations of the controlling solutions were 0.1 mol/l and 1 mol/l when solutions (A) and (B) were mixed and when solutions (C) and (D) were mixed, respectively.

| | |
|---|---|
| Solution A | |
| Sodium chloride | 3.42 g |
| Potassium bromide | 0.03 g |
| Water to make | 200 ml |
| Solution B | |
| Silver nitrate | 10 g |
| Water to make | 200 ml |
| Solution C | |
| Sodium chloride | 102.7 g |
| Potassium bromide | 1.0 g |
| Water to make | 600 ml |
| Solution D | |
| Silver nitrate | 300 g |
| Water to make | 600 ml |

After completing the addition, the resulting emulsion was desalted using a 5% aqueous solution of Demol N (produced by Kao-Atlas) and aqueous 20% magnesium sulfate solution, and re-dispersed in a gelatin aqueous solution to obtain a monodisperse cubic grain emulsion (EMP-1) having an average grain size of 0.85 μm, a coefficient of variation of grain size of 0.07 and a chloride content of 99.5 mol %.

The thus obtained emulsion, EMP-1 was chemically sensitized at 50° C. for 90 min. using the following compounds to obtain a blue-sensitive silver halide emulsion (Em-B).

| | |
|---|---|
| Sodium thiosulfate | 0.8 mg/mol AgX |
| Chloroauric acid | 0.5 mg/mol AgX |
| Stabilizer STAB-1 | $6 \times 10^{-4}$ mol/mol AgX |
| Sensitizing dye BS-1 | $4 \times 10^{-4}$ mol/mol AgX |
| Sensitizing dye BS-2 | $1 \times 10^{-4}$ mol/mol AgX |

Preparation of Green-sensitive Silver Halide Emulsion

Monodisperse cubic grain emulsions, EMP-2 having an average grain size of 0.43 μm, a coefficient of variation of grain size of 0.08 and a chloride content of 99.5 mol % was prepared similarly to EMP-1, provided that the addition time of Solutions A and B and the addition time of Solutions C and D were respectively varied.

The thus obtained emulsion, EMP-2 was chemically sensitized at 55° C. for a period of 120 min., using the following compounds to obtain green-sensitive silver halide emulsion (Em-G).

| | |
|---|---|
| Sodium thiosulfate | 1.5 mg/mol AgX |
| Chloroauric acid | 1.0 mg/mol AgX |
| Stabilizer STAB-1 | $6 \times 10^{-4}$ mol/mol AgX |
| Sensitizing dye GS-1 | $4 \times 10^{-4}$ mol/mol AgX |

Preparation of Red-Sensitive Silver Halide Emulsion

Monodisperse cubic grain emulsions, EMP-3 having an average grain size of 0.50 μm, a coefficient of variation of grain size of 0.08 and a chloride content of 99.5 mol % was prepared similarly to EMP-1, provided that the addition time of Solutions A and B and the addition time of Solutions C and D were respectively varied.

The thus obtained emulsion, EMP-3 was chemically sensitized at 60° C. for a period of 90 min., using the following compounds to obtain red-sensitive silver halide emulsion (Em-R).

| | |
|---|---|
| Sodium thiosulfate | 1.8 mg/mol AgX |
| Chloroauric acid | 2.0 mg/mol AgX |
| Stabilizer STAB-1 | $6 \times 10^{-4}$ mol/mol AgX |
| Sensitizing dye RS-1 | $1 \times 10^{-4}$ mol/mol AgX |

BS-1

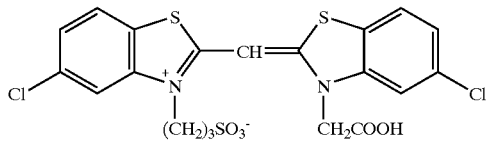

BS-2

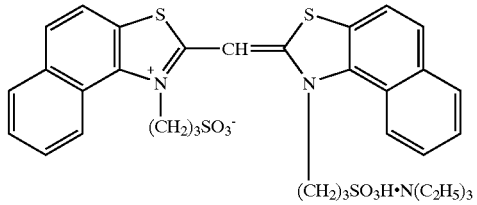

GS-1

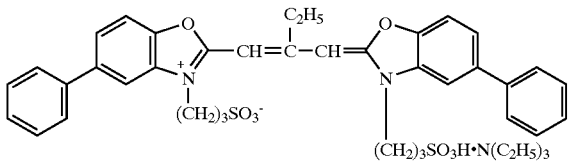

RS-1

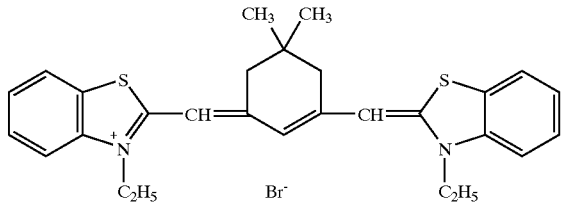

-continued

STB-1

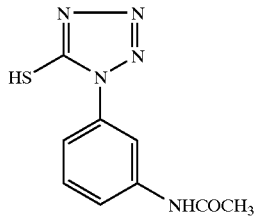

Samples 102 to 105 were prepared similarly to sample 101, provided that the yellow coupler used in the 1st layer was replaced by an equimolar amount of a yellow coupler shown in Table 1 and the amount of high boiling solvent (DNP) was varied so that the ratio of yellow coupler to high boiling solvent (DNP) was constant.

Y-3 (comparative coupler)

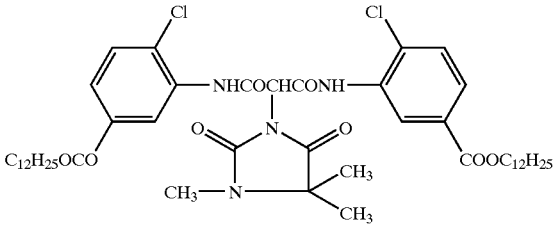

(coupler described in U.S. Pat. No. 4,149,886)

Y-4 (comparative coupler)

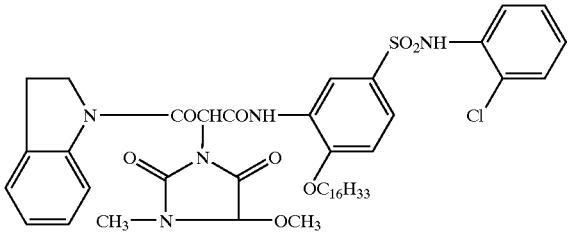

(coupler described in JP-A No. 5-11416)

Y-5 (comparative coupler)

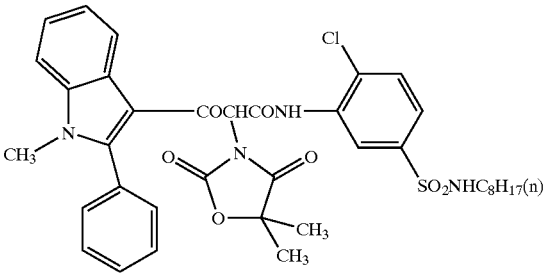

(coupler described in JP-A No. 2000-2976)

Y-6 (comparative coupler)

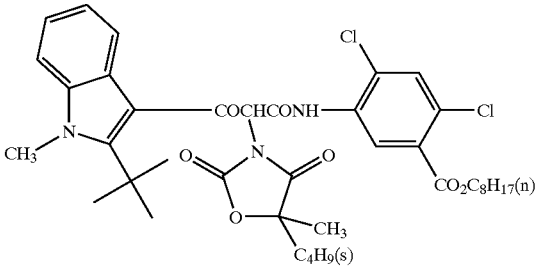

(coupler described in JP-A No. 2000-2976)

Evaluation

The thus prepared samples were exposed to white light through an optical wedge for 2 sec. and processed by the following process. The processed samples were subjected to densitometry using an optical densitometer (PDA-65, produced by Konica Corp.) to determine maximum color density (Dmax) and minimum color density (Dmin). Samples were each exposed for 14 days under irradiation of 70,000 lux Xe lamp and evaluated with respect to light stability (dye remaining ratio) at an initial density of 1.0.

Process

| Step | Temperature | Time |
|---|---|---|
| Color developing | 35.0° C. | 45 sec. |
| Bleach-fixing | 35.0° C. | 45 sec. |
| Stabilizing | 32° C. | 90 sec. |
| Drying | 70° C. | 60 sec. |

| Color developer | |
|---|---|
| Water | 800 ml |
| Triethanolamine | 10 g |
| N,N-diethylhydroxylamine | 5 g |
| Potassium bromide | 0.02 g |
| Potassium chloride | 2 g |
| Potassium sulfite | 0.3 g |
| 1-Hydroxyethylidene-1,1-diphosphonic acid | 1.0 g |
| Ethylenediaminetetraacetic acid | 1.0 g |
| Disodium catechol-3,5-disulfonate | 1.0 g |
| Diethylene glycol | 10 g |
| N-ethyl-N (β-methanesulfonamidoethyl)-3-methyl-4-aminoaniline sulfate | 4.5 g |
| Brightener (4,4'-diaminostilbene sulfonic acid derivative) | 1.0 g |
| Potassium carbonate | 27 g |

Water is added to make 1 liter, and the pH is adjusted to 10.10.

Bleach-Fixer

| | |
|---|---|
| Ammonium diethyltriaminepentaacetate dihydrate | 60 g |
| Ethylenediaminetetraacetic acid | 3 g |
| Ammonium thiosulfate (70% aqueous solution) | 100 ml |
| Ammonium sulfite (40% aqueous solution) | 27.5 ml |

Water is added to make 1 liter, and the pH is adjusted to 5.0 with potassium carbonate or glacial acetic acid.

Stabilizer

| | |
|---|---|
| 5-Chloro-2-methyl-4-isothiazoline-3-one | 0.2 g |
| 1,2-benzoisothiazoline-3-one | 0.3 g |
| Ethylene glycol | 1.0 g |
| 1-Hydroxyethylidene-1,1-diphosphonic acid | 2.0 g |
| o-Phenylphenol sodium salt | 1.0 g |
| Ethylenediamine tetraacetic acid | 1.0 g |
| Ammonium hydroxide (20% aqueous solution) | 3.0 g |
| Brightener (4,4'-diaminostilbenesulfonic acid derivative) | 1.5 g |

Water is added to make 1 liter, and the pH is adjusted to 7.0 with sulfuric acid or potassium hydroxide.

Results are shown in Table 1.

TABLE 1

| Sample No. | Coupler | Dmax | Dmin | Light Stability | Remark |
|---|---|---|---|---|---|
| 101 | Y-1 | 2.21 | 0.13 | 72 | Comp. |
| 102 | Y-3 | 2.27 | 0.14 | 65 | Comp. |
| 103 | Y-4 | 2.26 | 0.13 | 66 | Comp. |
| 104 | Y-5 | 2.28 | 0.15 | 68 | Comp. |
| 105 | Y-6 | 2.25 | 0.14 | 69 | Comp. |
| 106 | YA-1 | 2.50 | 0.12 | 80 | Inv. |
| 107 | YB-1 | 2.49 | 0.13 | 79 | Inv. |
| 108 | YC-1 | 2.47 | 0.12 | 80 | Inv. |
| 109 | YD-4 | 2.46 | 0.13 | 78 | Inv. |
| 110 | YE-4 | 2.49 | 0.12 | 78 | Inv. |
| 111 | YF-1 | 2.50 | 0.12 | 80 | Inv. |

As apparent from Table 1, it was proved that samples 101, 101, 102, 104 and 105 each using comparative yellow couplers Y-1, Y-2, Y-3, Y-4 and Y-5 resulted in insufficient color densities, relatively high fog densities and insufficient light stabilities. On the contrary, it was proved that samples 106 to 111 each using couplers according to this invention resulted in improved light stability as well as high maximum densities and low fog densities.

Example 2

On a 120 $\mu$m thick, subbed triacetyl cellulose film support, the following layers having composition as shown below were formed to prepare a multi-layered color photographic material sample 201. The addition amount of each compound was represented in term of g/m$^2$, unless otherwise noted. The amount of silver halide or colloidal silver was converted to the silver amount and the amount of a sensitizing dye (denoted as "SD") was represented in mol/Ag mol.

| | |
|---|---|
| 1st Layer (Anti-Halation Layer) | |
| Black colloidal silver | 0.16 |
| UV-3 | 0.3 |
| CM-1 | 0.123 |
| CC-1 | 0.044 |
| OIL-1 | 0.167 |
| Gelatin | 1.33 |
| 2nd Layer (Interlayer) | |
| AS-1 | 0.160 |
| OIL-1 | 0.20 |
| Gelatin | 0.69 |
| 3rd Layer (Low-speed Red-Sensitive Layer) | |
| Silver iodobromide emulsion a | 0.20 |

-continued

| | |
|---|---|
| Silver iodobromide emulsion b | 0.29 |
| SD-1 | $2.37 \times 10^{-5}$ |
| SD-2 | $1.2 \times 10^{-4}$ |
| SD-3 | $2.4 \times 10^{-4}$ |
| SD-4 | $2.4 \times 10^{-6}$ |
| C-3 | 0.32 |
| CC-1 | 0.038 |
| OIL-2 | 0.28 |
| AS-2 | 0.002 |
| Gelatin | 0.73 |
| 4th Layer (Medium-speed Red-sensitive Layer) | |
| Silver iodobromide emulsion c | 0.10 |
| Silver iodobromide emulsion d | 0.86 |
| SD-1 | $4.5 \times 10^{-5}$ |
| SD-2 | $2.3 \times 10^{-4}$ |
| SD-3 | $4.5 \times 10^{-4}$ |
| C-4 | 0.52 |
| CC-1 | 0.06 |
| DI-1 | 0.047 |
| OIL-2 | 0.46 |
| AS-2 | 0.004 |
| Gelatin | 1.30 |
| 5th Layer (High-speed Red-Sensitive Layer) | |
| Silver iodobromide emulsion c | 0.13 |
| Silver iodobromide emulsion d | 1.18 |
| SD-1 | $3.0 \times 10^{-5}$ |
| SD-2 | $1.5 \times 10^{-4}$ |
| SD-3 | $3.0 \times 10^{-4}$ |
| C-4 | 0.047 |
| C-5 | 0.09 |
| CC-1 | 0.036 |
| DI-4 | 0.024 |
| OIL-2 | 0.27 |
| AS-2 | 0.006 |
| Gelatin | 1.28 |
| 6th Layer (Interlayer) | |
| OIL-1 | 0.29 |
| AS-1 | 0.23 |
| Gelatin | 1.00 |
| 7th Layer (Low-speed Green-Sensitive Layer) | |
| Silver iodobromide emulsion a | 0.19 |
| Silver iodobromide emulsion b | 0.062 |
| SD-4 | $3.6 \times 10^{-4}$ |
| SD-5 | $3.6 \times 10^{-4}$ |
| M-1 | 0.18 |
| CM-1 | 0.033 |
| OIL-1 | 0.22 |
| AS-2 | 0.002 |
| AS-3 | 0.05 |
| Gelatin | 0.61 |
| 8th Layer (Interlayer) | |
| OIL-1 | 0.26 |
| AS-1 | 0.054 |
| Gelatin | 0.80 |
| 9th Layer (Medium-speed Green-Sensitive Layer) | |
| Silver iodobromide emulsion e | 0.54 |
| Silver iodobromide emulsion f | 0.54 |
| SD-6 | $3.7 \times 10^{-4}$ |
| SD-7 | $7.4 \times 10^{-5}$ |
| SD-8 | $5.0 \times 10^{-5}$ |
| M-2 | 0.17 |
| M-3 | 0.33 |
| CM-1 | 0.024 |
| CM-2 | 0.029 |
| DI-2 | 0.024 |
| DI-3 | 0.005 |
| OIL-1 | 0.73 |
| AS-3 | 0.035 |
| AS-2 | 0.003 |
| Gelatin | 1.80 |
| 10th Layer (High-speed Green-Sensitive Layer) | |
| Silver iodobromide emulsion f | 1.19 |

-continued

| | |
|---|---|
| SD-6 | $4.0 \times 10^{-4}$ |
| SD-7 | $8.0 \times 10^{-5}$ |
| SD-8 | $5.0 \times 10^{-5}$ |
| M-1 | 0.065 |
| CM-2 | 0.026 |
| CM-1 | 0.022 |
| DI-3 | 0.003 |
| DI-2 | 0.003 |
| OIL-1 | 0.19 |
| OIL-2 | 0.43 |
| AS-3 | 0.017 |
| AS-2 | 0.014 |
| Gelatin | 1.23 |
| 11th Layer (Yellow Filter Layer) | |
| Yellow colloidal sliver | 0.05 |
| OIL-1 | 0.18 |
| AS-1 | 0.16 |
| Gelatin | 1.00 |
| 12th Layer (Low-speed Blue-sensitive Layer) | |
| Silver iodobromide emulsion b | 0.22 |
| Silver iodobromide emulsion a | 0.08 |
| Silver iodobromide emulsion h | 0.09 |
| SD-9 | $6.5 \times 10^{-4}$ |
| SD-10 | $2.5 \times 10^{-4}$ |
| Y-2 | 0.77 |
| DI-4 | 0.017 |
| OIL-1 | 0.31 |
| AS-2 | 0.002 |
| Gelatin | 1.29 |
| 13th Layer (High-sped Blue-sensitive Layer) | |
| Silver iodobromide emulsion h | 0.41 |
| Silver iodobromide emulsion i | 0.61 |
| SD-9 | $4.4 \times 10^{-4}$ |
| SD-10 | $1.5 \times 10^{-4}$ |
| Y-2 | 0.23 |
| OIL-1 | 0.10 |
| AS-2 | 0.004 |
| Gelatin | 1.20 |
| 14th Layer (First Protective Layer) | |
| Silver iodobromide emulsion j | 0.30 |
| UV-3 | 0.055 |
| UV-4 | 0.110 |
| OIL-2 | 0.30 |
| Gelatin | 1.32 |
| 15th Layer (Second protective Layer) | |
| PM-1 | 0.15 |
| PM-2 | 0.04 |
| WAX-1 | 0.02 |
| D-1 | 0.001 |
| Gelatin | 0.55 |

Characteristics of the foregoing silver iodobromide emulsions are shown below, wherein the average grain size refers to an edge length of a cube having the same volume as that of the grain.

| Emulsion | Av. Grain Size ($\mu$m) | Av. Iodide Content (mol %) | Diameter/thickness Ratio |
|---|---|---|---|
| a | 0.30 | 2.0 | 1.0 |
| b | 0.40 | 8.0 | 1.4 |
| c | 0.60 | 7.0 | 3.1 |
| d | 0.74 | 7.0 | 5.0 |
| e | 0.60 | 7.0 | 4.1 |
| f | 0.65 | 8.7 | 6.5 |
| h | 0.65 | 8.0 | 1.4 |
| i | 1.00 | 8.0 | 2.0 |
| j | 0.05 | 2.0 | 1.0 |

Typical examples of preparation of silver halide grain emulsions will be described with respect to silver iodobromide d and f. Silver iodobromide j was prepared with reference to the disclosure of JP-A No. 1-183417. In the course of preparing silver halide emulsions relating to this invention, seed crystal grain emulsion 1 was first prepared.

Preparation of seed emulsion-1

Using a mixing stirrer described in JP-B Nos. 58-58288 and 58-58289, an aqueous silver nitrate solution (1.161 mol) and an aqueous solution of potassium bromide and potassium iodide (containing 2 mol % potassium iodide) were simultaneously added to solution (A1) maintained at 35° C. for 2 min. to perform nucleation, while keeping the silver potential at 0 mV using a silver ion selection electrode and a saturated silver-silver chloride reference electrode. Subsequently, the temperature was raised to 60° C. for 60 min. and after the pH was adjusted to 5.0 with an aqueous sodium carbonate solution, an aqueous silver nitrate solution (5.90 mol) and an aqueous solution of potassium bromide and potassium iodide (containing 2 mol % potassium iodide) were added by double-jet addition over a period of 42 min. After completion of the addition, the temperature was lowered to 40° C. and desalting was conducted by the conventional flocculation washing method. The thus prepared seed emulsion was comprised of silver halide grains having a mean sphere equivalent diameter of 0.24 $\mu$m and a mean aspect ratio of 4.8, in which at least 90% of the total grain projected area was accounted for by hexagonal tabular grains having a maximum edge length ratio (i.e., ratio of maximum edge length to minimum edge length) of 1.0 to 2.0. The obtained emulsion was designated as seed emulsion-1.

Solution A1

| | |
|---|---|
| Ossein gelatin | 24.2 g |
| Potassium bromide | 10.8 g |
| $HO(CH_2CH_2O)_m(CH(CH_3)CH_2O)_{19.8}(CH_2CH^2O)_nH$ (m + n = 9.77, 10% ethanol solution) | 6.78 ml |
| 10% Nitric acid | 114 ml |
| $H_2O$ | 9657 ml |

Preparation of Fine Silver Iodide Grain Emulsion (SMC-1)

To 5 liter of an aqueous 6.0 wt % gelatin solution containing 0.06 mol potassium iodide were added with stirring an aqueous 7.06 mol silver nitrate solution and an aqueous 7.06 mol potassium iodide solution, each 2 liter over a period of 10 min., while the pH was controlled at 2.0 with nitric acid and the temperature was maintained at 40° C. After completing the grain formation, the pH was adjusted to 5.0 using an aqueous sodium carbonate solution. The thus obtained fine silver iodide grains exhibited a mean grain size of 0.05 $\mu$m. The emulsion was designated as SMC-1.

Preparation of Silver Iodobromide d

An aqueous 700 ml inert gelatin solution (4.5 wt % gelatin) containing 0.178 mol equivalent of seed emulsion-1 and 0.5 ml of a 10% ethanol solution of $HO(CH_2CH_2O)_m(CH(CH_3)CH_2O)_{19.8}(CH_2CH^2O)_nH$ was maintained at 75° C. and after adjusting the pAg and pH at 8.4 and 5.0, respectively, grain formation was carried out by double-jet addition with vigorously stirring, according to the following procedure.

(1) An aqueous 3.093 mol silver nitrate solution, 0.287 mol of SMC-1 and an aqueous potassium bromide solution were added with maintaining the pAg and pH at 8.4 and 5.0, respectively.

(2) Subsequently, the solution was cooled to 60° C. and the pAg was adjusted to 9.8. Thereafter, 0.071 mol of SMC-1 was added and ripening was carried out for 2 min. (introduction of dislocation lines).

(3) An aqueous 0.959 mol silver nitrate solution, 0.03 mol of SMC-1 and an aqueous potassium bromide solution were added with maintaining the pAg and pH at 9.8 and 5.0, respectively.

Throughout the grain formation, the respective solutions were added at an optimal rate so that neither formation of new nucleus grains nor Ostwald ripening among grains did occurred. After completing the addition, washing was conducted at 40° C. by the conventional flocculation method, the emulsion was re-dispersed by adding gelatin and adjusted at a pAg of 8.1 and a pH of 5.8. The obtained emulsion was comprised of tabular grains having a mean grain size (cube equivalent edge length) of 0.74 μm. a mean aspect ratio of 5.0 and a halide composition of internal iodide contents of 2/8.5/X/3 mol % in the order from the interior (X: the position of introducing dislocation lines). Electron microscopic observation revealed that at least 60% of the total grain projected area was accounted for by grains containing at least 5 dislocation lines in both of the fringe portion and the interior of the grains. The surface iodide content was 6.7 mol %.

Silver iodobromide f was prepared similarly to the foregoing silver iodobromide d, except that in the step (1), the pAg was changed to 8.8 and amounts of silver nitrate and SMC-1 were changed to 2.077 mol and 0.218 mol, respectively, and in the step (3), amounts of silver nitrate and SMC-1 were changed to 0.91 mol and 0.079 mol, respectively. The obtained emulsion was comprised of tabular grains having a mean grain size (cube equivalent edge length) of 0.65 μm. a mean aspect ratio of 6.5 and a halide composition of internal iodide contents of 2/9.5/X/8.0 mol % in the order from the interior (X: the position of introducing dislocation lines). Electron microscopic observation revealed that at least 60% of the total grain projected area was accounted for by grains containing at least 5 dislocation lines in both of the fringe portion and the interior of the grains. The surface iodide content was 11.9 mol %.

To the foregoing respective emulsions, the sensitizing dyes described earlier were added and ripening was carried out. Thereafter, triphenylphosphine selenide, sodium thiosulfate, chloroauric acid and potassium thiocyanate were added and chemical ripening was conducted in the conventional manner so as to achieve the optimal fog-sensitivity relationship. Similarly to the foregoing silver iodobromide d and f, silver iodobromide a, b, c, e, h and i were each subjected to spectral sensitization and chemical sensitization.

In addition to the additives described earlier were added coating aids SU-2, SU-3 and SU-4, dispersing aid SU-1, thickener V-1, stabilizers ST-5 and ST-6, antifoggant AF-1 (polyvinyl pyrrolidone, weight-average molecular weight: 10,000) and AF-2 (polyvinyl pyrrolidone, weight-average molecular weight: 100,000), inhibitors AF-3, AF-4 and AF-5, hardeners H-1 and H-3, and antiseptic F-1.

The structure of the foregoing respective compounds is shown below.

SU-4: $C_8F_{17}SO_2N(C_3H_7)CH_2COOK$

SU-5: $C_8F_{17}SO_2NH(CH_2)_3N^+(CH_3)_3Br^-$

ST-5: 4-hydroxy-6-methyl-1,3,3a,7-tetrazaindene

ST-6: adenine

AF-3: 1-phenyl-5-mercaptotetrazole

AF-4: 1-(4-carboxyphenyl)-5-mercaptotetrazole

AF-5: 1-(3-acetoamidophenyl)-5-mercaptotetrazole

H-3: $[(CH_2{=}CHSO_2CH_2)_3CCH_2SO_2CH_2CH_2]_2NCH_2CH_2SO_3K$

OIL-1: tricresyl phosphate

OIL-2: di(2-ethylhexyl)phthalate

AS-1: 2,5-bis(1,1-dimethyl-4-hexyloxycarbonylbutyl)-hydroquinone

AS-2: dodecyl gallate

AS-3: 1,4-bis(2-tetradecyloxycarbonylethyl)piperazine

Y-2 (Comparative coupler

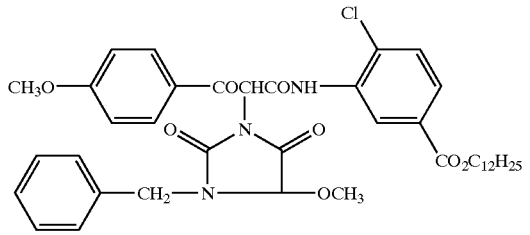

(Coupler Described in Research Disclosure 18053)

C-3

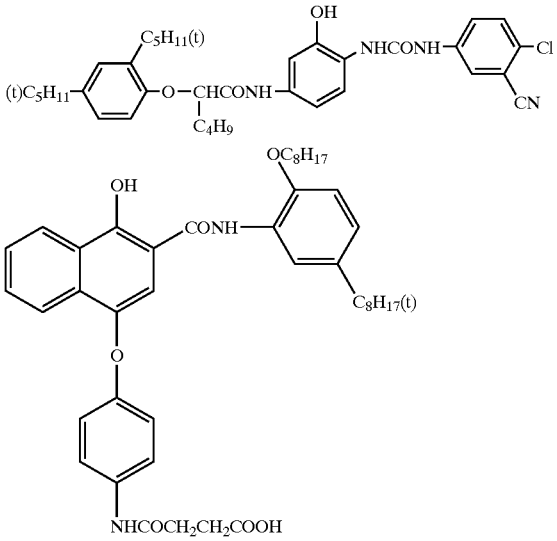

C-4

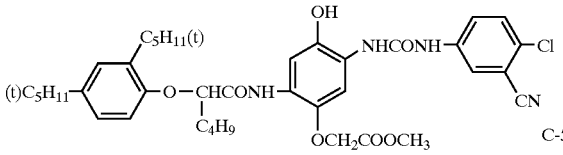

C-5

-continued
M-2
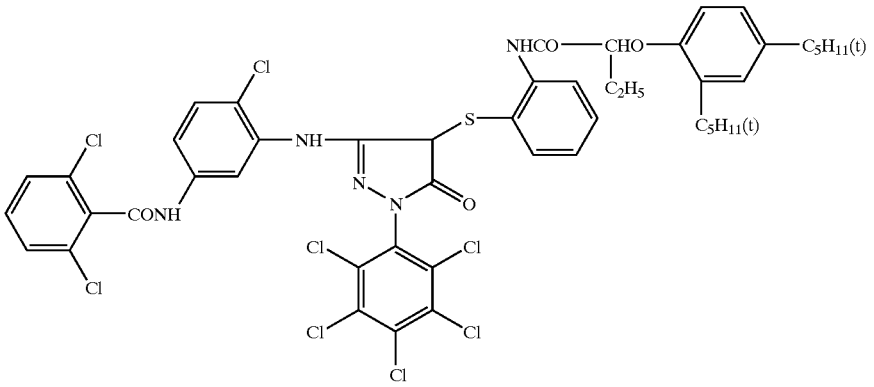
M-3
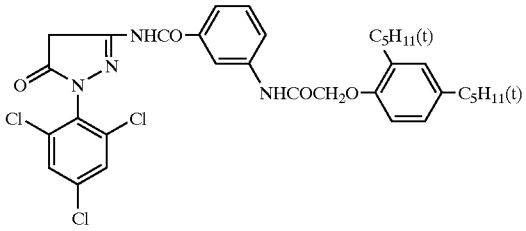
CC-1
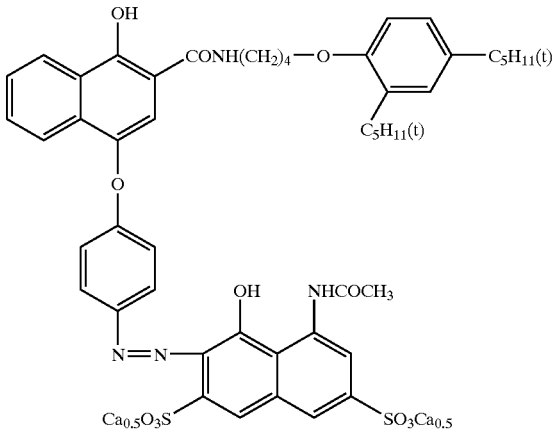
CM-1
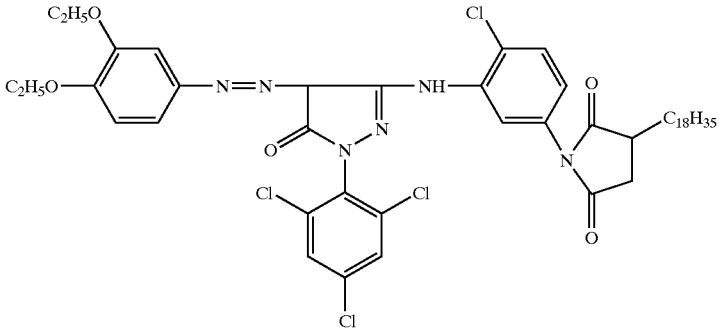
CM-2
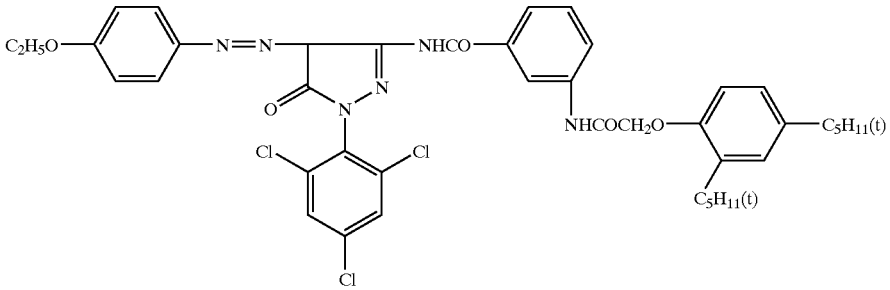

-continued
DI-1
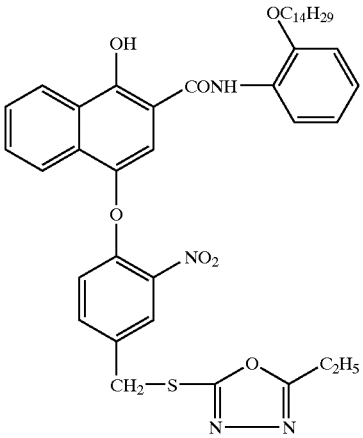
DI-2
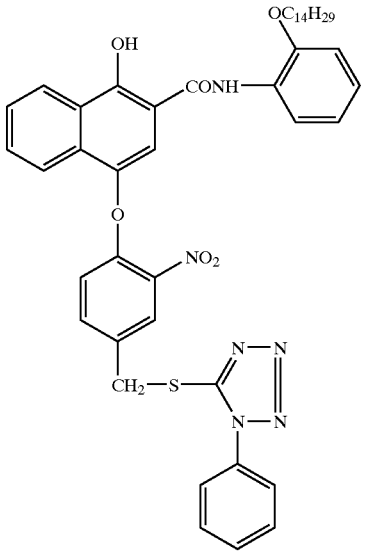
DI-3
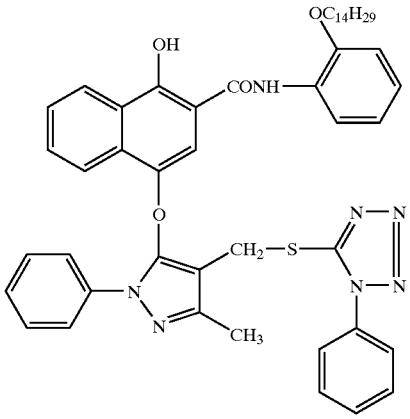
DI-4
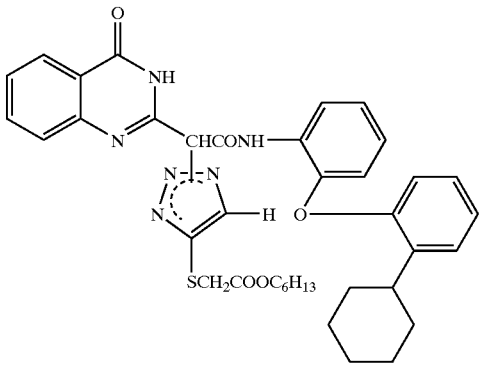
SD-1
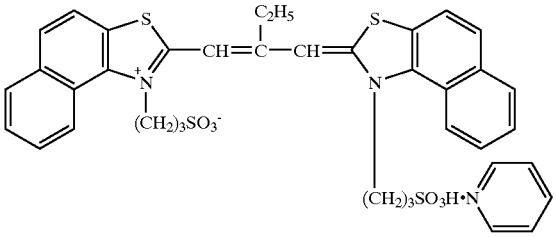
SD-2
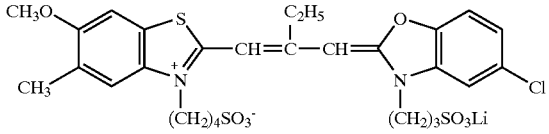
SD-3
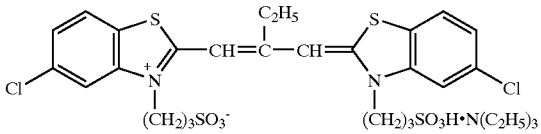
SD-4
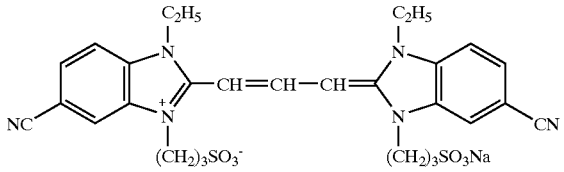
SD-5
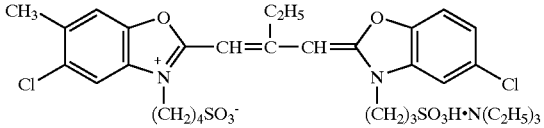
SD-6
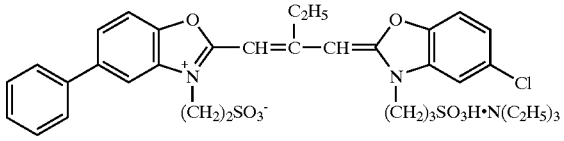

-continued

SD-7

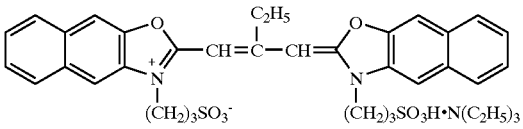

SD-8

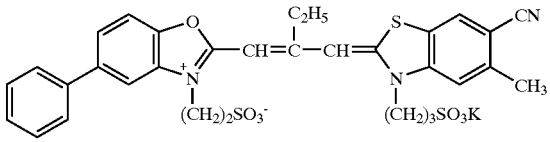

SD-9

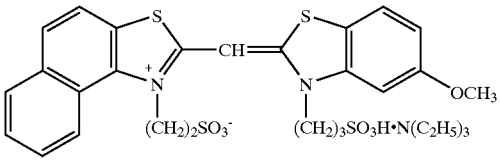

SD-10

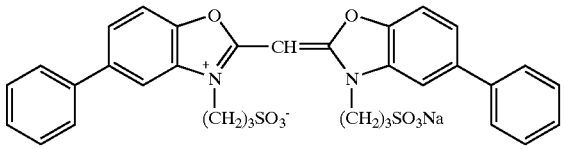

WAX-1

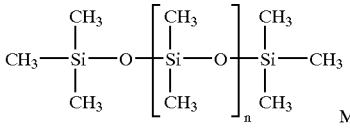

Mw = 3,000

D-1

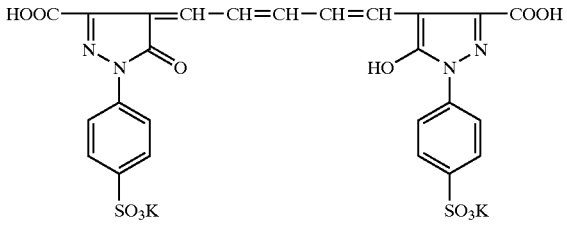

PM-1

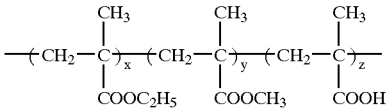

x:y:z = 3:3:4

PM-2

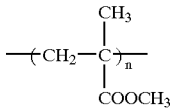

n: degree of polymerization

UV-4

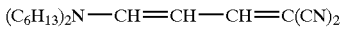

V-1

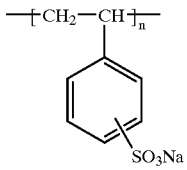

n: degree of polymerization

The thus prepared sample 201 was exposed to white light through a step wedge for sensitometry and processed according to the following process [I].

Process [I]:

| Processing step | Time | Temperature | Replenishing rate* |
|---|---|---|---|
| Color developing | 3 min. 15 sec. | 38° C. | 780 ml |
| Bleaching | 45 sec. | 38° C. | 150 ml |
| Fixing | 1 min. 30 sec. | 38° C. | 830 ml |
| Stabilizing | 1 min. | 38° C. | 830 ml |
| Drying | 1 min. | 55° C. | — |

*Amounts per $m^2$ of photographic material.

A color developer, bleach, fixer and stabilizer each were prepared according to the following formulas.

Color Developer Solution

| | Worker | Replenisher |
|---|---|---|
| Water | 800 ml | 800 ml |
| Potassium carbonate | 30 g | 35 g |
| Sodium hydrogencarbonate | 2.5 g | 3.0 g |
| Potassium sulfite | 3.0 g | 5.0 g |
| Sodium bromide | 1.3 g | 0.4 g |
| Potassium iodide | 1.2 mg | — |
| Hydroxylamine sulfate | 2.5 g | 3.1 g |
| Sodium chloride | 0.6 g | — |
| 4-Amino-3-methyl-N-(β-hydroxyethyl)-aniline sulfate | 4.5 g | 6.3 g |
| Diethylenetriaminepentaacetic acid | 3.0 g | 3.0 g |
| Potassium hydroxide | 1.2 g | 2.0 g |

Water was added to make 1 liter in total, and the pH of the developer and replenisher were adjusted to 10.06 and 10.18, respectively, using potassium hydroxide and 20% sulfuric acid.

Bleaching Solution

| | Worker | Replenisher |
|---|---|---|
| Water | 700 ml | 700 ml |
| Ammonium iron (III) 1,3-diamino-propanetetraacetic acid | 125 g | 175 g |
| Ethylenediaminetetraacetic acid | 2 g | 2 g |
| Sodium nitrate | 40 g | 50 g |
| Ammonium bromide | 150 g | 200 g |
| Glacial acetic acid | 40 g | 56 g |

Water was added to make 1 liter in total and the pH of the bleach and replenisher was adjusted to 4.4 and 4.0, respectively, using ammoniacal water or glacial acetic acid.

Fixer Solution

| | Worker | Replenisher |
|---|---|---|
| Water | 800 ml | 800 ml |
| Ammonium thiocyanate | 120 g | 150 g |
| Ammonium thiosulfate | 150 g | 180 g |
| Sodium sulfite | 15 g | 20 g |
| Ethylenediaminetetraacetic acid | 2 g | 2 g |

Water was added to make 1 liter in total and the pH of fixer and replenisher was adjusted to 6.2 and 6.5, respectively, using ammoniacal water or glacial acetic acid.

Stabilizer Solution (Worker and Replenisher):

| | |
|---|---|
| Water | 900 ml |
| p-Octylphenol/ethyleneoxide (10 mol) adduct | 2.0 g |
| Dimethylolurea | 0.5 g |
| Hexamethylenetetramine | 0.2 g |
| 1,2-benzoisothiazoline-3-one | 0.1 g |
| Siloxane (L-77, product by UCC) | 0.1 g |
| Ammoniacal water | 0.5 ml |

Water was added to make 1 liter in total and the pH thereof was adjusted to 8.5 with ammoniacal water or sulfuric acid (50%).

Comparative samples 202 and 203, and inventive samples 204 to 215 were prepared similarly to sample 201, except that yellow coupler (Y-2) used in the 12th and 13th layers was replaced by an equimolar amount of a yellow coupler shown in Table 2 and the amount of high boiling solvent (OIL-1) was varied so that the ratio of yellow coupler to high boiling solvent (OIL-1) was constant. The thus prepared samples were exposed to white light for 1/100 sec. and processed according to the foregoing process [I]. Processed samples were each measured with respect to maximum color density (Dmax) and fog (minimum color density Dmin) using an optical densitometer (PDA-65, produced by Konica Corp.). The maximum density (Dmax) and fog (minimum density, Dmin) were respectively represented by values subtracting densities obtained in processing without the color developing step.

To evaluate fogging after raw stock keeping, samples were allowed to stand at 23° C. and 65% RH for 24 hr., then, sealed in a resin can and aged at 55° C. for 7 days. The thus aged samples and samples which were subjected to refrigerated storage were similarly exposed and processed. From characteristic curves obtained, the difference in minimum density between aged and refrigerated samples was evaluated as an increase of fog density after storage. Results are shown in Table 2.

TABLE 2

| Sample No. | Coupler | Dmax | Fog | Fog Increase | Remark |
|---|---|---|---|---|---|
| 201 | Y-2 | 2.19 | 0.18 | 0.02 | Comp. |
| 202 | Y-3 | 2.30 | 0.21 | 0.03 | Comp. |
| 203 | Y-6 | 2.28 | 0.21 | 0.04 | Comp. |
| 204 | YA-1 | 2.50 | 0.13 | 0.01 | Inv. |
| 205 | YA-15 | 2.49 | 0.14 | 0.02 | Inv. |
| 206 | YB-1 | 2.50 | 0.13 | 0.01 | Inv. |
| 207 | YB-16 | 2.48 | 0.14 | 0.02 | Inv. |
| 208 | YC-1 | 2.49 | 0.15 | 0.02 | Inv. |
| 209 | YC-13 | 2.50 | 0.16 | 0.02 | Inv. |
| 210 | YD-4 | 2.48 | 0.15 | 0.02 | Inv. |
| 211 | YD-19 | 2.49 | 0.15 | 0.02 | Inv. |
| 212 | YE-4 | 2.50 | 0.14 | 0.02 | Inv. |
| 213 | YE-24 | 2.48 | 0.14 | 0.02 | Inv. |
| 214 | YF-1 | 2.50 | 0.13 | 0.02 | Inv. |
| 215 | YF-8 | 2.49 | 0.14 | 0.02 | Inv. |

As is apparent from Table 2, it was proved that samples 201, 202 and 203, which used comparative yellow couplers Y-2, Y-3 and Y-6, respectively, resulted in inferior color formation (relatively low Dmax) and relatively high fog density. On the contrary, samples 204 through 215 using yellow couplers according to this invention resulted in relatively high maximum density, relatively low fog density and a reduced increase of fogging after storage.

What is claimed is:

1. A silver halide color photographic material comprising on a support a silver halide emulsion layer comprising a yellow dye forming coupler represented by formula (I):

A—B formula (I)

wherein A is represented by the following formula (Ia), (Ia'), (Ia"), (Ib), (Ib'), (Ib"), (Ic), (Ie), (Ie'), (Ie"), (If) or (If'); and B is represented by the following formula (II):

formula (Ia)

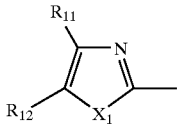

formula (Ia')

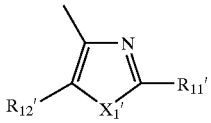

formula (Ia")

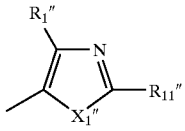

wherein $R_{11}$, $R_{12}$, $R_{12}'$ and $R_{12}''$ each represents a hydrogen atom or a substituent; $R_{11}'$ and $R_{11}''$ each represents a hydrogen atom, an alkyl group, cycloalkyl group, aryl group, heterocyclic group, alkoxy group, aryloxy group, alkoxycarbonyl group, aryloxycarboxyl group, acylamino group, sulfonamido group, carbamoyl group, sulfamoyl group, ureido group, acyl group, sulfonyl group, sulfonyloxy group, alkylamino group, arylamino group or cyano group; $X_1$, $X_1'$ and $X_1''$ each represents —N($R_{13}$)—, an oxygen atom or sulfur atom, in which $R_{13}$ represents a hydrogen atom or a substituent;

formula (Ib)

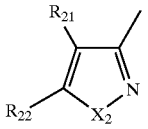

formula (Ib')

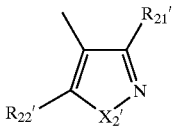

formula (Ib")

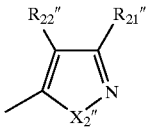

wherein $R_{21}$, $R_{22}$, $R_{21}'$, $R_{22}'$, $R_{21}''$ and $R_{22}''$ each represents a hydrogen atom or a substituent; $X_2$, $X_2'$ and $X_2''$ each represents —N($R_{23}$)—, an oxygen atom or sulfur atom, in which $R_{23}$ represents a hydrogen atom or a substituent;

formula (Ic)

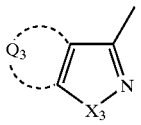

wherein $X_3$ represents an oxygen atom or sulfur atom; $Q_3$ represents a nonmetallic atom group necessary to form a carbon containing ring;

formula (Ie)

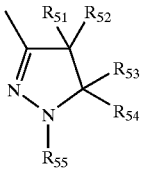

formula (Ie')

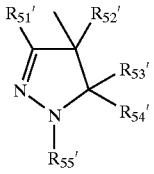

formula (Ie")

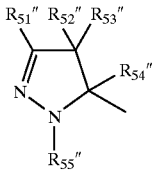

wherein $R_{51}$, $R_{52}$, $R_{53}$, $R_{54}$, $R_{55}$, $R_{51}'$, $R_{52}'$, $R_{53}'$, $R_{54}'$, $R_{55}'$, $R_{51}''$, $R_{52}''$, $R_{53}''$, $R_{54}''$ and $R_{55}''$ each represents a hydrogen atom or a substituent, provided that two selected from $R_{51}$ to $R_{55}$, two selected from $R_{51}'$ to $R_{55}'$, or two selected from $R_{51}''$ to $R_{55}''$ may combine with each other to form a ring;

formula (If)

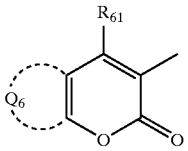

formula (If')

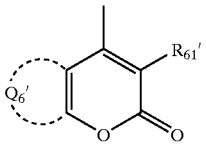

wherein $R_{61}$ and $R_{61}'$ each represents a hydrogen atom or a substituent; $Q_6$ and $Q_6'$ each represents a nonmetallic atom group necessary to form a carbon containing ring;

formula (II)

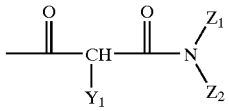

wherein $Y_1$ represents a hydrogen or a group capable of being released upon reaction with an oxidation product of a color developing agent; $Z_1$ and $Z_2$ each represents a hydrogen atom or a substituent.

2. The photographic material of claim 1, wherein in formula (I), A is represented by formula (Ia), (Ia') or (Ia").

3. The photographic material of claim 1, wherein in formula (I), A is represented by formula (Ib), (Ib') or (Ib").

4. The photographic material of claim 1, wherein in formula (I), A is represented by formula (Ic).

5. The photographic material of claim 1, wherein in formula (I), A is represented by formula (Ie) (Ie') or (Ie").

6. The photographic material of claim 1, wherein in formula (I), A is represented by formula (If), (If').

7. The photographic material of claim 1, wherein in formula (II), $Z_1$ is a phenyl group and $Z_2$ is a hydrogen atom.

8. The photographic material of claim 7, wherein $Z_1$ is represented by following formula (i):

formula (i)

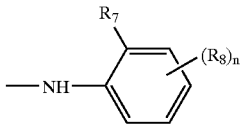

wherein $R_7$ and $R_8$ each represents a hydrogen atom or a substituent; and is an integer of 0 to 4.

9. The photographic material of claim 7, wherein $Z_1$ is represented by the following formula (ii) or (iii):
formula (ii)
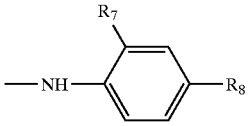
-continued
formula (iii)
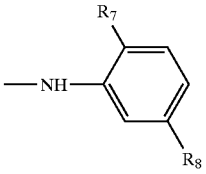
wherein $R_7$ represents a chlorine atom or an alkoxy group; and $R_8$ represents a substituent.
* * * * *